US008109497B2

(12) United States Patent
Okamoto et al.

(10) Patent No.: US 8,109,497 B2
(45) Date of Patent: Feb. 7, 2012

(54) SHEET POST-PROCESSING APPARATUS

(75) Inventors: Koji Okamoto, Misato (JP); Ken Obikane, Minamialps (JP); Jun Kondo, Minamialps (JP)

(73) Assignees: Canon Finetech Inc., Saitama-Ken (JP); Nisca Corporation, Yamanashi-Ken (JP)

( * ) Notice: Subject to any disclaimer, the term of this patent is extended or adjusted under 35 U.S.C. 154(b) by 193 days.

(21) Appl. No.: 12/385,836

(22) Filed: Apr. 21, 2009

(65) Prior Publication Data

US 2009/0261521 A1 Oct. 22, 2009

(30) Foreign Application Priority Data

Apr. 22, 2008 (JP) ..... 2008-111415

(51) Int. Cl.
*B65H 37/04* (2006.01)

(52) U.S. Cl. ..... 270/58.14; 270/20.1; 270/21.1; 270/32; 270/37; 270/45; 270/58.07; 270/58.08; 270/58.18; 270/58.19; 270/58.28

(58) Field of Classification Search ..... 270/20.1, 270/21.1, 32, 37, 45, 51, 58.07, 58.08, 58.14, 270/58.15, 58.18, 58.19, 58.28; 493/352, 493/353, 356, 357
See application file for complete search history.

(56) References Cited

U.S. PATENT DOCUMENTS

| | | | | |
|---|---|---|---|---|
| 5,377,965 | A * | 1/1995 | Mandel et al. | 270/37 |
| 6,381,443 | B1 * | 4/2002 | Kawata et al. | 399/407 |
| 6,910,686 | B2 * | 6/2005 | Awano | 270/37 |
| 7,137,625 | B2 * | 11/2006 | Yamada et al. | 270/58.07 |
| 7,360,958 | B2 * | 4/2008 | Awano | 400/621 |
| 7,451,970 | B2 * | 11/2008 | Kawata | 270/58.14 |
| 2004/0113348 | A1 * | 6/2004 | Awano | 270/58.07 |
| 2005/0062210 | A1 * | 3/2005 | Kato et al. | 270/58.08 |
| 2007/0045926 | A1 * | 3/2007 | Fukatsu et al. | 270/58.07 |
| 2007/0120310 | A1 * | 5/2007 | Awano | 270/45 |
| 2008/0106032 | A1 * | 5/2008 | Kanda | 271/279 |

FOREIGN PATENT DOCUMENTS

| | | |
|---|---|---|
| JP | 2003-261260 | 9/2003 |
| JP | 2004-115237 | 4/2004 |
| JP | 2004-195569 | 7/2004 |

* cited by examiner

*Primary Examiner* — Leslie A Nicholson, III

(74) *Attorney, Agent, or Firm* — Manabu Kanesaka

(57) ABSTRACT

A sheet post-processing apparatus includes a cutting device for cutting a fore-edge portion of a center-folded bunch of sheets disposed in a position spaced from a sheet discharge outlet to eliminate the risk for inflicting a wound on the body of an operator, an end binding device for gathering sheets received from a carry-in entrance and performing binding processing in the end portion of a bunch of sheets, a saddle-stitching device for gathering sheets received from the carry-in entrance and performing binding processing in the center portion of a bunch of sheets, and a center-folding device for performing center-folding processing on the bunch of sheets subjected to the saddle-stitching processing. A cutting device is subjected to the center-folding processing. A second discharge outlet is disposed in the other side face of the apparatus frame to discharge the bunch of sheets subjected to the center-folding processing in the center-folding device.

7 Claims, 30 Drawing Sheets

FIG. 5 (a)
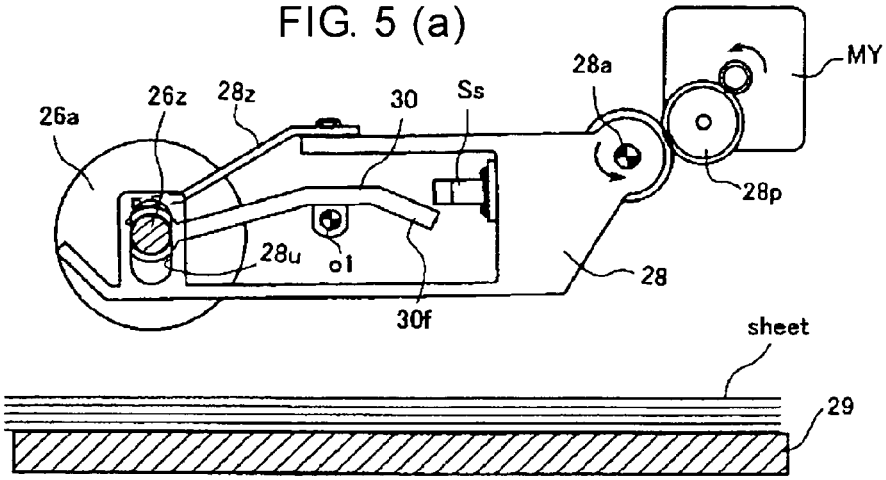
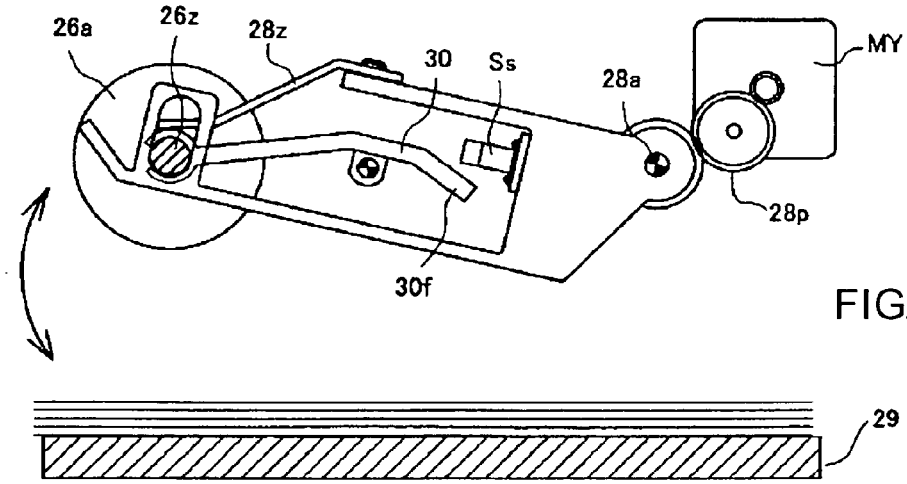
FIG. 5 (b)
FIG. 5 (c)
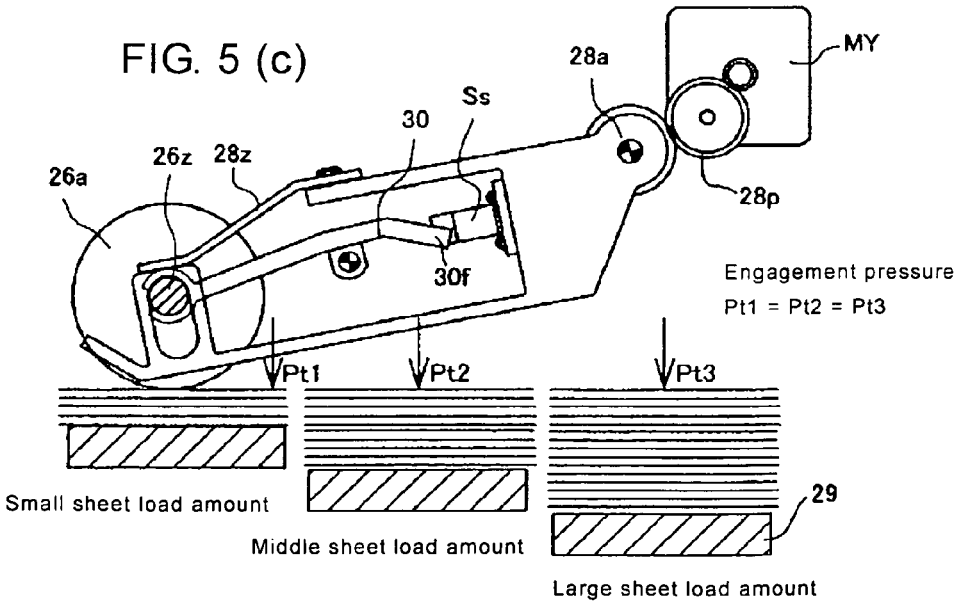

FIG. 15 (a)
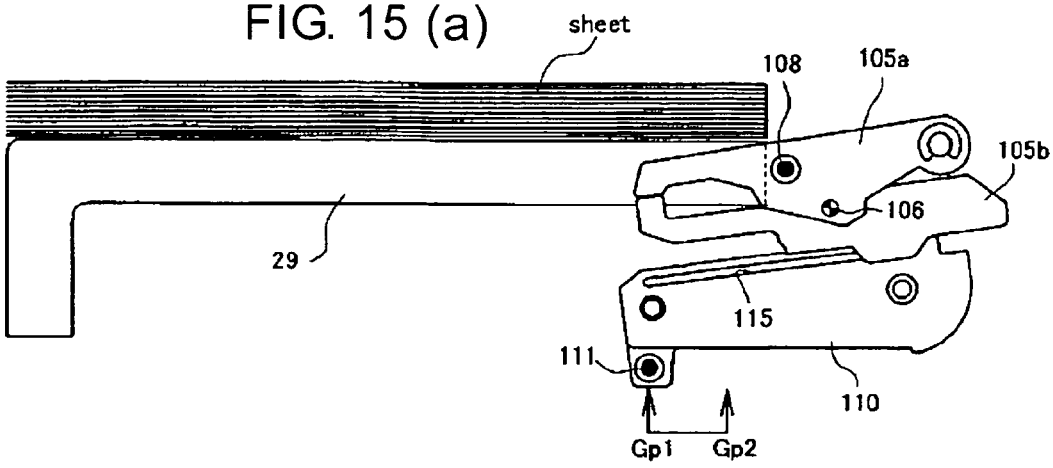
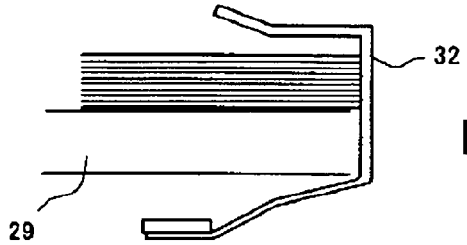
FIG. 15 (b)
FIG. 15 (c)
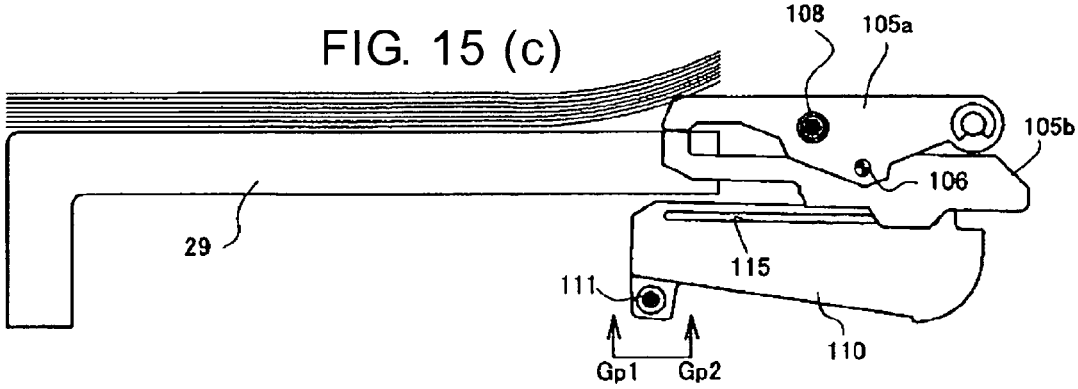
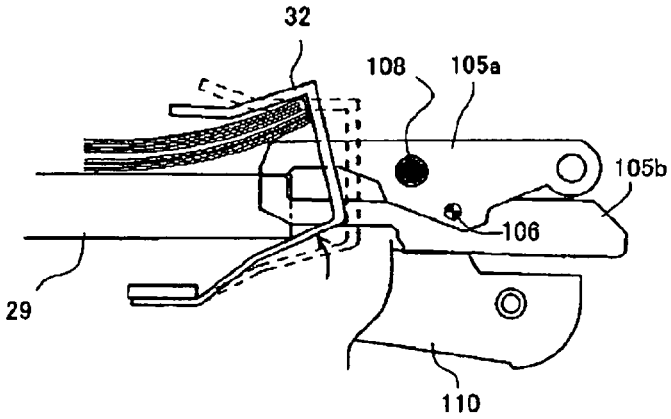
FIG. 15 (d)

FIG. 16 (e) Releasing attitude
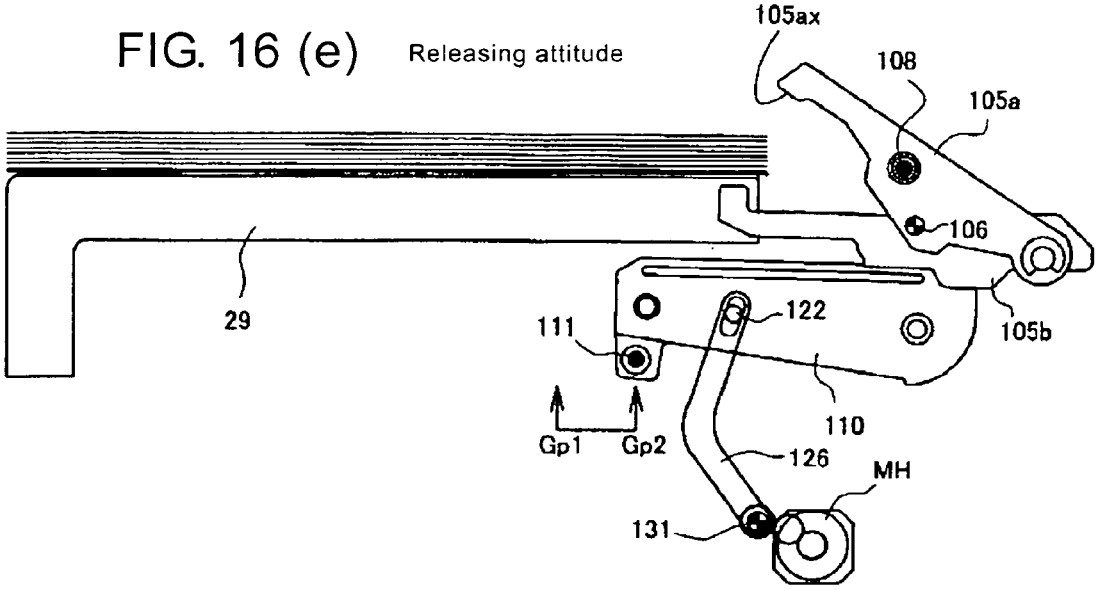
FIG. 16 (f) Nip attitude
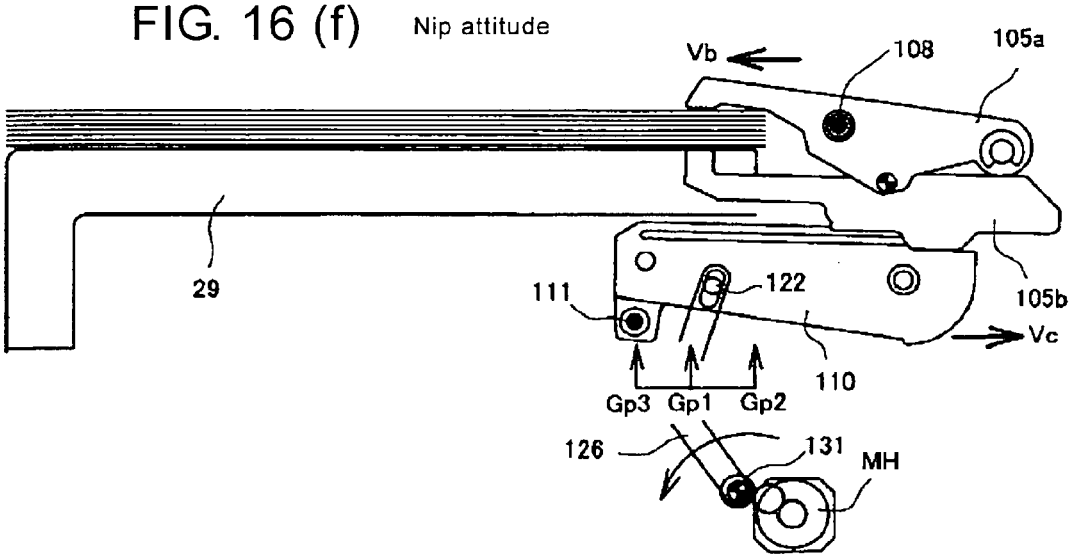
FIG. 16 (g)
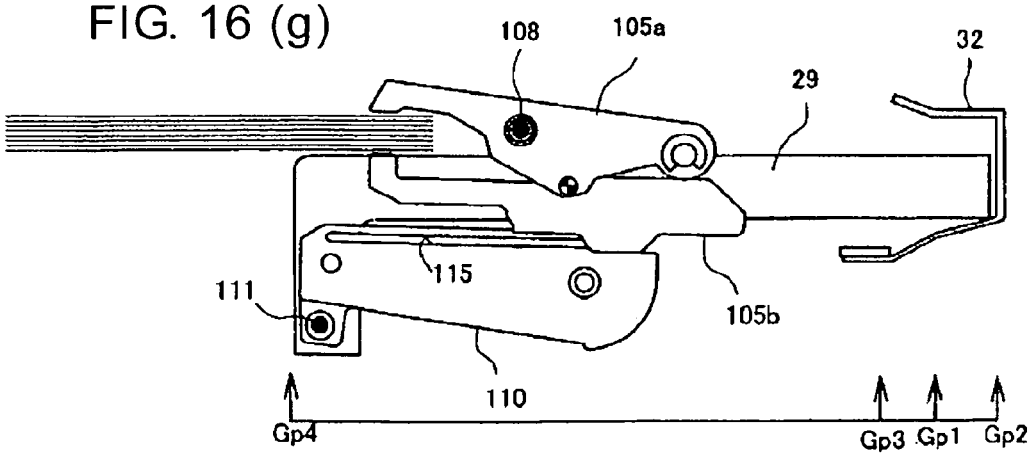

A-A Cross-sectional view

SHEET POST-PROCESSING APPARATUS

BACKGROUND OF THE INVENTION

1. Technical Field

The present invention relates to a sheet post-processing apparatus for sequentially receiving sheets successively fed from an image formation apparatus of, for example, a copier, printer or the like to process in a bunch form, and performing post-processing such as end binding processing, punching processing, saddle-stitching center-folding processing and the like on the bunch of sheets.

2. Description of the Related Art

Conventionally, sheet post-processing apparatuses have been known which gather sheets discharged from an image formation apparatus such as a copier or the like, and perform end binding processing, saddle-stitching center-folding processing to make a booklet, and further, bookbinding processing by applying an adhesive to the spine of a bunch of sheets to attach a front cover. In recent sheet post-processing apparatuses, with improvements in performance of a stapler for performing binding processing, for example, such post-processing has been made possible that a bunch of several tens of sheets are bound in book form. With increases in the number of sheets to form a single bunch of sheets, when a bunch of sheets subjected to saddle-stitching processing undergo center-folding processing to be in book form, in the so-called fore-edge portion (fore-edge end) that is an open side of the bunch of sheets, center-folded inner sheet edges jut more outwardly than outer sheet edges, and the problem arises that the appearance of the booklet is not good. To solve such a problem, sheet post-processing apparatuses have been developed which have trimming means for trimming the fore-edge portion of a bunch of sheets subjected to center-folding processing.

As a first conventional example of such a sheet post-processing apparatus provided with the trimming means, Patent Document 1 discloses a paper processing apparatus having a configuration where a stapling processing section for processing sequentially fed sheets in a bunch form to bind a bunch of sheet is disposed in the center portion of the apparatus, and under the stapling processing section are disposed a saddle-stitching unit for binding the center portion of the paper bunch, and a center-folding unit 50 for folding the paper bunch along the bound portion. Herein, it is configured that a cutter unit 60 for cutting an edge portion of the bound paper bunch is provided in the downstream stage of the center-folding unit 50, and that a press lever 65 included in the cutter unit 60 holds the paper bunch when the paper is cut.

Further, as a second conventional example of the sheet post-processing apparatus provided with the trimming means, Patent Document 2 discloses a paper processing apparatus in which disposed are a paper carry-in entrance 55 situated in one side face, a saddle-stitching paper discharge outlet 56 disposed in the other side face that is the side opposite to the paper carry-in entrance 55, a saddle-stitching compile tray 21 extending from above the one side face side to below the other side face side, while aligning and holding a plurality of sheets fed from the paper carry-in entrance 55, and a saddle-stitching stapler 24 for binding a predetermined portion of the paper bunch held and aligned, and provided further are a folding knife 25 for folding the bound paper bunch, a rotary cutter unit 30 provided above the saddle-stitching compile tray 21 in the vertical direction to cut the folded paper using a blade traveling in the horizontal direction, and a booklet tray 51 to load the paper which is cut by the rotary cutter unit 30 and discharged from the saddle-stitching paper discharge outlet 56.

Furthermore, as a third conventional example of the sheet post-processing apparatus provided with the trimming means, Patent Document 3 discloses a post-processing apparatus which has a feeder for feeding a cover sheet, a carrying path for carrying the cover sheet and paper, center-folding means for making a fold in the direction perpendicular to the carrying direction of the cover sheet and paper on the path, carrying means for carrying the cover sheet and paper each with the fold made and opened on a sheet basis, loading means for loading the cover sheet and paper, saddle-stitching means having staple putting means and staple receiving means for performing saddle-stitching processing on a paper bunch formed of the cover sheet and paper on the loading means, and trimming means for trimming a fore edge of the paper bunch subjected to the saddle-stitching processing to be a book, and which has the feature that the feeder, trimming means and the saddle-stitching means are arranged in the vertical direction.

[Patent Document 1] Japanese Laid-Open Patent Publication No. 2003-261260

[Patent Document 2] Japanese Laid-Open Patent Publication No. 2004-195569

[Patent Document 3] Japanese Laid-Open Patent Publication No. 2004-115237

However, in the sheet post-processing apparatus thus provided with the trimming means, since it is necessary to arrange the end binding processing means, saddle-stitching processing means, center-folding means and also the trimming means in the limited space within the apparatus frame, as in the above-mentioned first and third conventional examples, the trimming means for finally trimming a fore-edge portion of a bunch of sheets subjected to the center-folding processing is situated in the lower portion of the apparatus frame or near the sheet discharge outlet for discharging the bunch of sheets subjected to the post-processing. Further, a sheet branch portion for turning a sheet fed from the carry-in entrance to the center-folding means is disposed in the carrying path between the punch means and the end binding means. Therefore, the space becomes small which is under the end binding means and surrounded by the center-folding means and the discharge outlet.

Therefore, in such a conventional sheet post-processing apparatus, it is not possible to reserve a sufficient spade to drop trimming debris occurring in the trimming processing to store, a debris storage box is filled fully with the trimming debris, and the need arises to halt the apparatus frequently. Further, a discharge outlet for discharging a trimming-processed bunch of sheets should also be disposed in the lower portion of the apparatus, the discharge tray is filled fully with bunches of sheets in a short time, and it is necessary to halt the apparatus frequently as in removing the trimming debris.

Further, in the second conventional example as described above, such a configuration is adopted that in the apparatus frame 10 are provided, from the top, a carrying path for passing a sheet with an image formed without processing and sequentially discharging onto a first discharge tray 52, an end binding processing path for forming a bunch of sheets to perform end binding processing and collecting bunches of sheets on a second discharge tray 54, and a saddle-stitching center-folding processing path for performing saddle-stitching center-folding processing on a bunch of sheets and trimming a fore edge of the bunch of sheets which are arranged in the vertical direction. Therefore, as well as the problem that the apparatus size increases, since the trimming means for performing dangerous processing of trimming a fore edge of a bunch of sheets is disposed near the sheet discharge outlet of the apparatus frame, the risk is high for causing an accident of inflicting a wound on the finger and/or hand of an operator when the operator handles a jam and the like.

The present invention was made to solve various problems in the conventional sheet post-processing apparatus as described above, and it is an object of the invention to secure a space for sufficiently storing trimming debris, while enabling the high number of trimmed bunches of sheets to be stored as much as possible within the limited space inside the sheet post-processing apparatus, thereby reduce the frequency of halting the sheet post-processing apparatus and dramatically improve efficiency of the sheet post-processing.

BRIEF SUMMARY OF THE INVENTION

Therefore, the present invention provides a sheet post-processing apparatus having a carry-in entrance (23*a*) disposed in one side face of an apparatus frame to receive a sheet fed from an image formation apparatus, end binding means (31) for gathering sheets received from the carry-in entrance in a bunch form and performing binding processing in the end portion of a bunch of sheets, saddle-stitching means (40) for gathering sheets received from the carry-in entrance in a bunch form and performing binding processing in the center portion of a bunch of sheets, center-folding means (folding processing mechanism 44 described later) for performing center-folding processing on the bunch of sheets subjected to the saddle-stitching processing, cutting means (trimmer unit 90 described later) for cutting a fore edge of the bunch of sheets subjected to the center-folding processing, a first discharge outlet (29*x*) disposed in the other side face of the apparatus frame to discharge the bunch of sheets subjected to the end binding processing, and a second discharge outlet (22*x*) disposed below the first discharge outlet to discharge the bunch of sheets subjected to the center-folding processing in the center-folding means, characterized in that the saddle-stitching means and the center-folding means are disposed below the carry-in entrance on the side of the one side face of the apparatus frame, the end binding means is disposed, above the saddle-stitching means and the center-folding means, between the carry-in entrance and the first discharge outlet, and that the cutting means is disposed within a space, below the end binding means, surrounded by the saddle-stitching means, the center-folding means and the second discharge outlet.

By this means, the sheet post-processing apparatus has a rational arrangement of means (units) for performing various kinds of post-processing, and thereby enables the apparatus size to be drastically reduced as compared with the conventional apparatus. Further, since the first discharge outlet can be situated in a relatively high position, it is possible to use the lower area outside the first discharge outlet as a space for a discharge tray, and to enhance the discharge capacity. Furthermore, since the lower space inside the apparatus frame can be used as a storage space for cutting debris, the storage amount of debris is also increased, and it is possible to reduce the frequency of halting the apparatus and improve the processing efficiency of the entire apparatus.

Moreover, the branch portion is disposed on the upstream side of the punch means in the carrying direction, in other words, the punch means is disposed in the carrying path between the sheet branch portion, which turns a sheet fed from the carry-in entrance to the center-folding means, and the end binding means, and therefore, the center-folding means can be shifted to the lower side from the lower center in the apparatus. It is thereby possible to effectively use the lower space inside the apparatus frame, and the lower space can be used as a storage section for center-folded sheets.

Then, since the punch means is disposed on the downstream side of the carrying path, it is possible to install the saddle-stitching center-folding processing means sufficiently close to the sheet carry-in entrance side, such a configuration also enables the cutting means to be situated on the inner side than the second discharge outlet, and the risk is eliminated that an operator receives a wound in the finger and/or hand by the cutting apparatus. Further, it is made possible to maximize the storage capacity of bunches of sheets in a stack tray, and by sharing a plurality of trays as the stack tray and a booklet tray, the effect is produced of dramatically improving the entire storage capacity of bunches of sheets subjected to various kinds of post-processing in the sheet post-processing apparatus.

BRIEF DESCRIPTION OF THE DRAWINGS

FIG. 5 contains explanatory views of a sheet discharge mechanism of the processing tray, where FIG. 5(*a*) is an explanatory view showing a configuration of a switch back roller, FIG. 5(*b*) is an explanatory view showing a standby state of the switch back roller, and FIG. 5(*c*) is an explanatory view showing a sheet engagement state of the switch back roller;

FIG. 15 contains operating state explanatory views of the sheet-bunch carrying-out means, where FIG. 15(*a*) shows a first standby position state, and FIG. 15(*c*) shows an initial state to back to a second standby position;

FIG. 16 contains operating state explanatory views of the sheet-bunch carrying-out means, where FIG. 16(*e*) shows a second standby position state, FIG. 16(*f*) shows a state where the bunch of sheets are nipped, and FIG. 16(*g*) shows a state where the bunch of sheets are carried out;

DETAILED DESCRIPTION OF THE INVENTION

Figure 1:
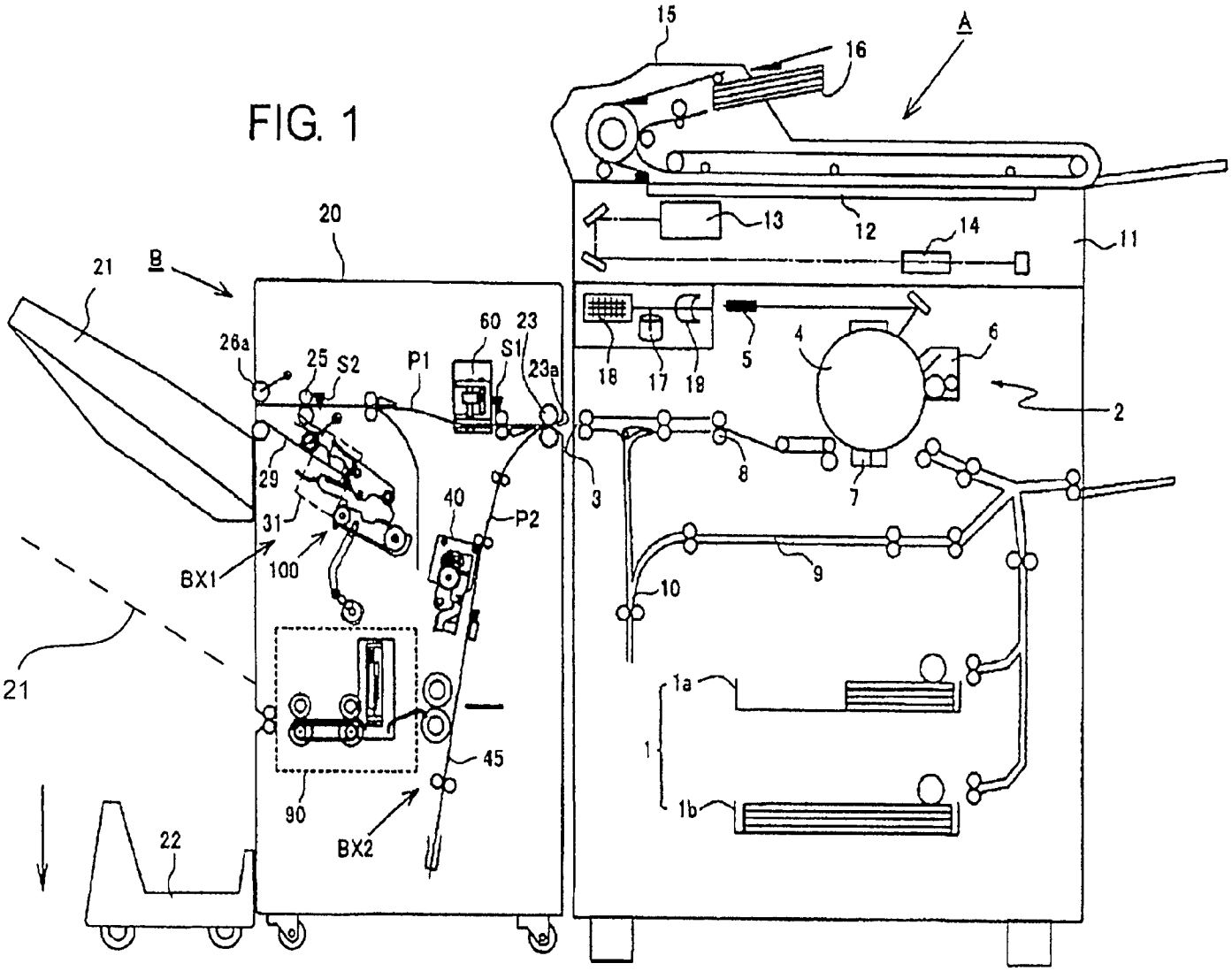
FIG. 1 is an entire configuration view of an image formation system according to the invention.
Figure 2:
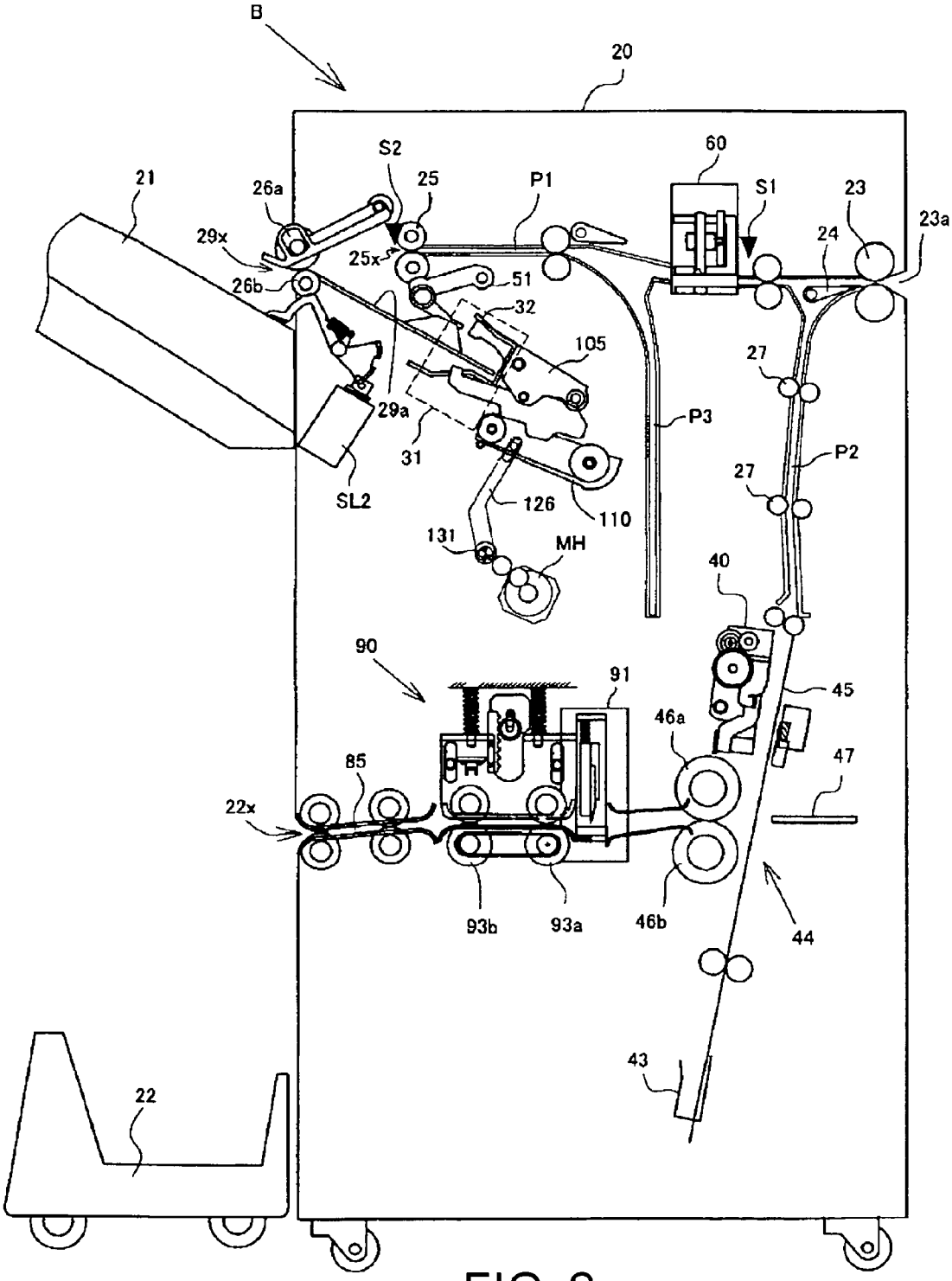
FIG. 2 is an entire configuration view of a post-processing apparatus (sheet handling apparatus) in the system of FIG. 1.
Figure 3:
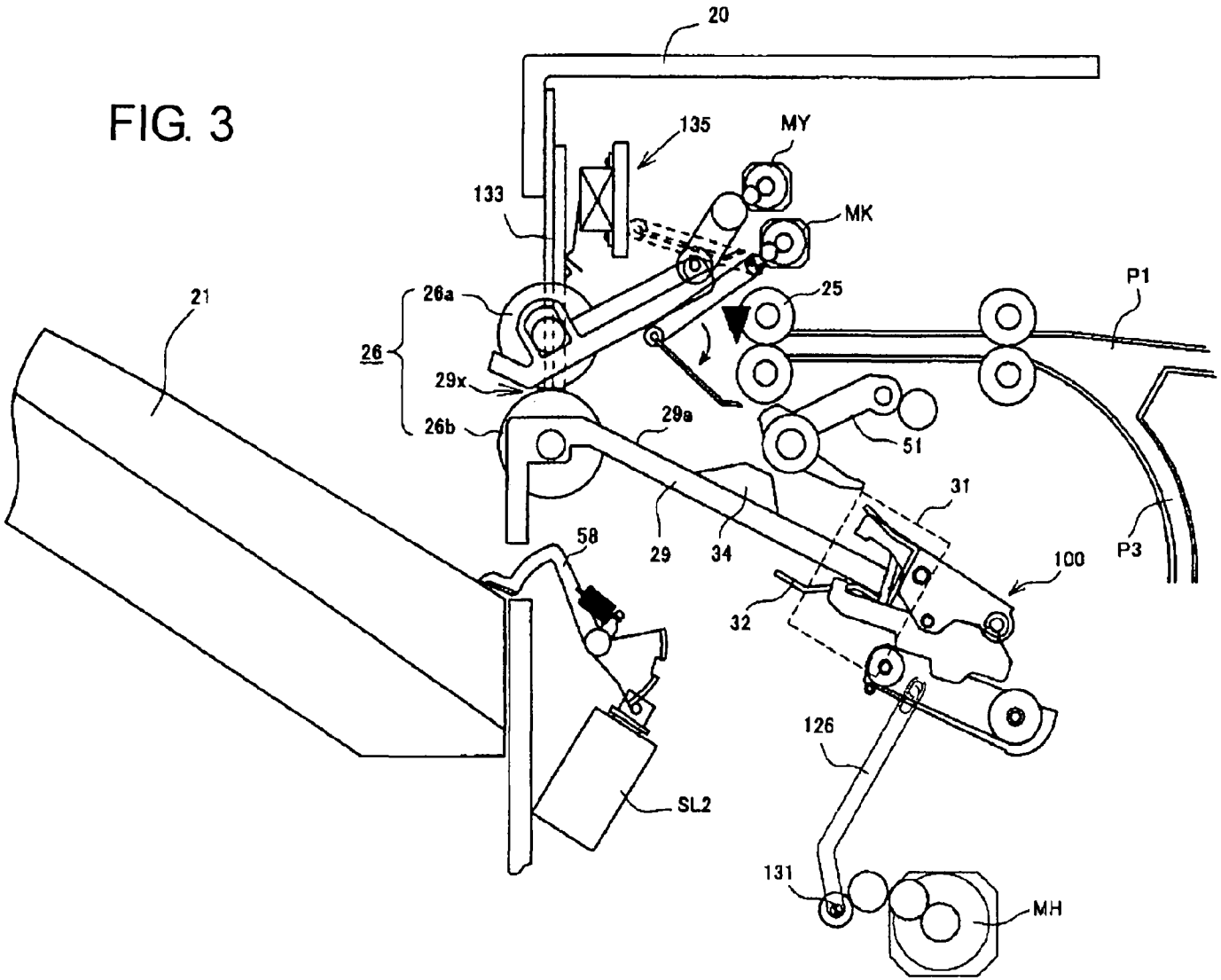
FIG. 3 is an explanatory view of main parts of the post-processing apparatus of FIG. 2.

The present invention will specifically be described below based on preferred embodiments of the invention as shown in accompanying drawings. FIG. 1 is an entire configuration view showing an image formation system provided with an image formation apparatus A and a post-processing apparatus B according to the invention, FIG. 2 is an explanatory view of a detailed configuration of the post-processing apparatus B, and FIG. 3 is an explanatory view of main parts of the apparatus B.

[Configuration of the Image Formation System]

The image formation system as shown in FIG. 1 is formed of the image formation apparatus A and the post-processing apparatus (sheet processing apparatus; which is the same in the following description) B. Then, a carry-in entrance 23*a* of the post-processing apparatus B is coupled to a sheet discharge outlet 3 of the image formation apparatus A, and it is configured that sheets with images formed thereon in the image formation apparatus A are stapled in the post-processing apparatus B and stored in a stack tray 21 and saddle tray (booklet tray) 22.

[Configuration of the Image Formation Apparatus]

The image formation apparatus A will be described according to FIG. 1. The image formation apparatus A is configured so that a sheet is fed to an image formation section 2 from a paper feeding section 1, printed in the image formation section 2, and discharged from the sheet discharge outlet 3. In the paper feeding section 1, sheets with different sizes are stored in paper cassettes 1*a* and 1*b*, and designated sheets are separated on a sheet basis and fed to the image formation section 2. In the image formation section 2 are arranged, for example, an electrostatic drum 4, and a print head (laser emitter) 5, developer 6, transfer charger 7 and fuser 8 disposed around the drum, an electrostatic latent image is formed on the electrostatic drum 4 with the laser emitter 5, the developer 6 adds toner to the image, and the image is transferred onto the sheet with the transfer charger 7, and heated and fused with the fuser 8. The sheet with the image thus formed is sequentially carried out from the sheet discharge outlet 3. "9" shown in the figure denotes a circulating path, and is a path for two-side printing for revising the side of the sheet with printing on its front side from the fuser 8 via a switch-back path 10, and feeding the sheet again to the image formation section 2 so as to print on the back side of the sheet. The side of the two-side printed sheet is reversed in the switch-back path 10, and the sheet is carried out from the sheet discharge outlet 3.

"11" shown in the figure denotes an image scanning apparatus, where an original sheet set on a platen 12 is scanned with a scan unit 13, and electrically read with a photoelectric conversion element not shown. The image data is subjected to, for example, digital processing in an image processing section, and then transferred to a data storing section 14, and an image signal is sent to the laser emitter 5. Further, "15" shown in the figure is an original feeding apparatus, and is a feeder apparatus for feeding an original sheet stored in a stack tray 16 to the platen 12.

Figure 30:
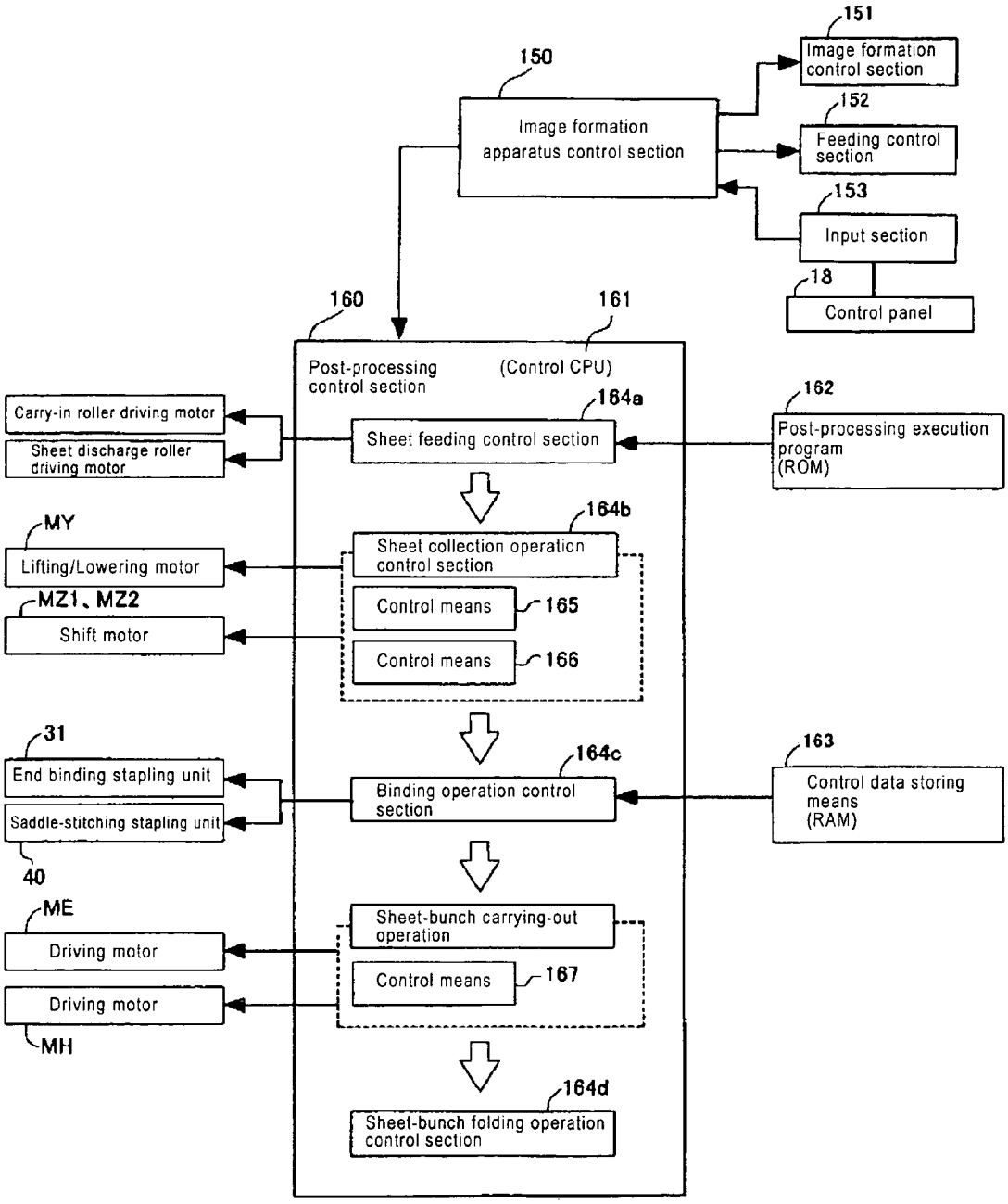
FIG. 30 is a block diagram of a control configuration in the image formation system of FIG. 1.

The image formation apparatus A with the above-mentioned configuration is provided with a control section (controller) 150 as shown in FIG. 30, and from a control panel 18 are set image printing conditions such as, for example, sheet size designation, color/monochrome printing designation, number-of-printed sheet designation, one-side/two-side printing designation, scaling printing designation and the like. Meanwhile, it is configured in the image formation apparatus A that image data read by the scan unit 13 or image data transferred from an external network is stored in a data storing section 17, the image data is transferred to a buffer memory 19 from the data storing section 17, and that a data signal is sequentially output to the laser emitter 5 from the buffer memory 17.

A post-processing condition is also input and designated from the control panel 18, concurrently with the image formation conditions such as one-side/two-side printing, scaling printing, monochrome/color printing and the like. Selected as the post-processing condition is, for example, a "print-out mode", "binding finish mode", "brochure finish mode" or the like.

[Configuration of the Post-processing Apparatus]

The post-processing apparatus B according to the invention has a punch means (punch unit described later) 60 for performing punching processing on a sheet received from the carry-in entrance 23*a*, and the punch means 60 is disposed in a carrying path between a sheet branch portion, which turns a sheet fed from the carry-in entrance 23*a* to a saddle-stitching means and center-folding means, and an end binding means. Then, the apparatus B has a stack tray 21 disposed on the side face side of the apparatus frame, and the stack tray 21 is configured to move up and down to receive a bunch of sheets subjected to end binding processing discharged from a first discharge outlet 29*x*, and a bunch of sheets subjected to center-folding processing discharged from a second discharge outlet 22*x* described later. Herein, the stack tray 21 has a plurality of sheet discharge trays capable of moving up and down, and when a volume of bunches of sheets discharged onto the uppermost sheet discharge tray reaches a predetermined amount, a sheet discharge tray located under the uppermost sheet discharge tray receives bunches of sheets that are sequentially discharged.

The post-processing apparatus B further has a booklet stacker 22 disposed below the stack tray 21, and the booklet stacker 22 receives a bunch of sheets discharged from the second discharge outlet 22*x*, and when bunches of sheets stacked on the stack tray reach a predetermined amount, sequentially receives bunches of sheets subsequently discharged from the second discharge outlet 22*x*.

The post-processing apparatus B is configured as described below to receive a sheet with the image formed thereon from the sheet discharge outlet 3 of the image formation apparatus A, and to (i) store the sheet in the stack tray 21 ("print-out mode" as described above), (ii) collate sheets from the sheet discharge outlet 3 in a bunch form to staple, and store in the stack tray (first stack tray) 21 ("binding finish mode" as described above), or (iii) collate sheets from the sheet discharge outlet 3 in a bunch form, staple its center, fold in book form and store in the saddle tray (second stack tray) 22 ("brochure finish mode" as described above).

A casing (exterior cover) 20 of the post-processing apparatus B is provided with the carry-in entrance 23*a*, and the carry-in entrance 23*a* is coupled to the sheet discharge outlet 3 of the image formation apparatus A. In the casing 20 are provided a first processing section BX1 that collects sheets from the carry-in entrance 23*a* for each set to perform a binding finish, and a second processing section BX2 that collects sheets from the carry-in entrance 23*a* for each set to perform a brochure finish. A first carry-in path P1 is provided between the first processing section BX1 and the carry-in entrance 23*a*, and a second carry-in path P2 is provided between the second processing section BX2 and the carry-in entrance 23*a*, so that the sheet from the carry-in entrance 23*a* is distributed and guided to the first processing section BX1 or the second processing section BX2 (sheet branch portion). The carry-in entrance 23*a* is provided with carry-in rollers 25, sheet sensor S1, and a path switching means (flapper member) 24 that distributes the sheet to the first or second carry-in path P1 or P2.

The first carry-in path P1 is provided with a buffer path P3 between a punch unit 60 and a processing tray 29. The buffer path 3 is a path for piling the predetermined number of sheets received from the carry-in entrance 23*a*, thereby delaying the sheets by a predetermined time, and then carrying the sheets to the end binding means side. Therefore, as shown in FIG. 2, the buffer path 3 is disposed to branch off from the first carrying-path P1 in the vertical direction of the casing 20 on the upstream side in the path reaching the processing tray 29. Then, the sheet from the first carry-in path P1 is switched back and stays in this path. Accordingly, when the post-processing (end binding processing described later) is performed on a bunch of sheets collected for each set on the processing tray 29, it is made possible that a subsequent sheet sent to the carry-in entrance 23*a* temporary stays, and that the subsequent sheet in this path is moved to the processing tray 29 after a predetermined time has elapsed and the processed sheets on the processing tray 29 are carried out.

The first carry-in path P1 is disposed substantially in the horizontal direction in the upper portion of the apparatus housing formed of the casing 20, the first processing section BX 1 is disposed on the downstream side of the first carry-in path P1, and the stack tray 21 is disposed on the downstream side of BX1. The second carry-in path P2 is disposed substantially in the vertical direction in the lower portion of the casing 20, the second processing section BX2 is disposed on the downstream side of the second carry-in path P2, and the saddle tray (booklet stacker) 22 is disposed on the downstream side of BX2. In addition, in the first carry-in path P1, the punch unit 60 described later is disposed between the carry-in entrance 23*a* and the first processing section BX1. In the second carry-in path P2, a trimmer unit 90 described later is disposed between the second processing section BX2 and the saddle tray 22.

The first carry-in path P1 is provided at its path outlet end with sheet discharge rollers 25 and a sheet discharge outlet 25*x*. A sheet discharge sensor S2 is disposed in the sheet discharge outlet 25*x*, and is configured to detect a sheet passed through the first carry-in path P1 to detect a jam and count the number of passed sheets. Then, a level difference is formed on the downstream side of the sheet discharge outlet 25*x*, and the processing tray 29 described below is disposed. Further, the second carry-in path P2 is provided with feeding rollers 27, a level difference is formed on the downstream side of the rollers 27, and a collection guide 45 described later is disposed.

[Configuration of the First Processing Section]

The first processing section BX1 is formed of the processing tray 29 disposed in the first carry-in path P1, an end binding stapling unit 31 disposed in the processing tray 29, and an aligning means 51.

[Configuration of the Processing Tray]

The processing tray 29 is formed of a synthetic resin plate or the like, and is provided with a sheet support surface 29*a* to support sheets loaded therewith. The sheet support surface 29*a* is disposed to form a level difference on the downstream side of the sheet discharge outlet 25*x*, and stores sheets from the sheet discharge outlet 25*x*. The sheet support surface 29*a* as shown in the figure is formed in dimension with a length shorter than the length of the sheet in the discharge direction, and supports the rear end portion of the sheet from the sheet discharge outlet 25*x*, while the sheet front end portion is supported (bridge-supported) on the uppermost sheet on the stack tray 21.

The processing tray 29 is provided with a sheet end regulating means 32, against which the rear end (or front end) of the sheet from the sheet discharge outlet 25*x* is pushed to be aligned. Then, above the processing tray 29 are disposed switch back rollers 26 (movable roller 26*a*, fixed roller 26*b*) for feeding a sheet carried onto the tray to the sheet end regulating means 32, aligning means 51, and side aligning means 34. Each structure will be described below.

[Configuration of the Sheet End Regulating Means]

Figure 4:
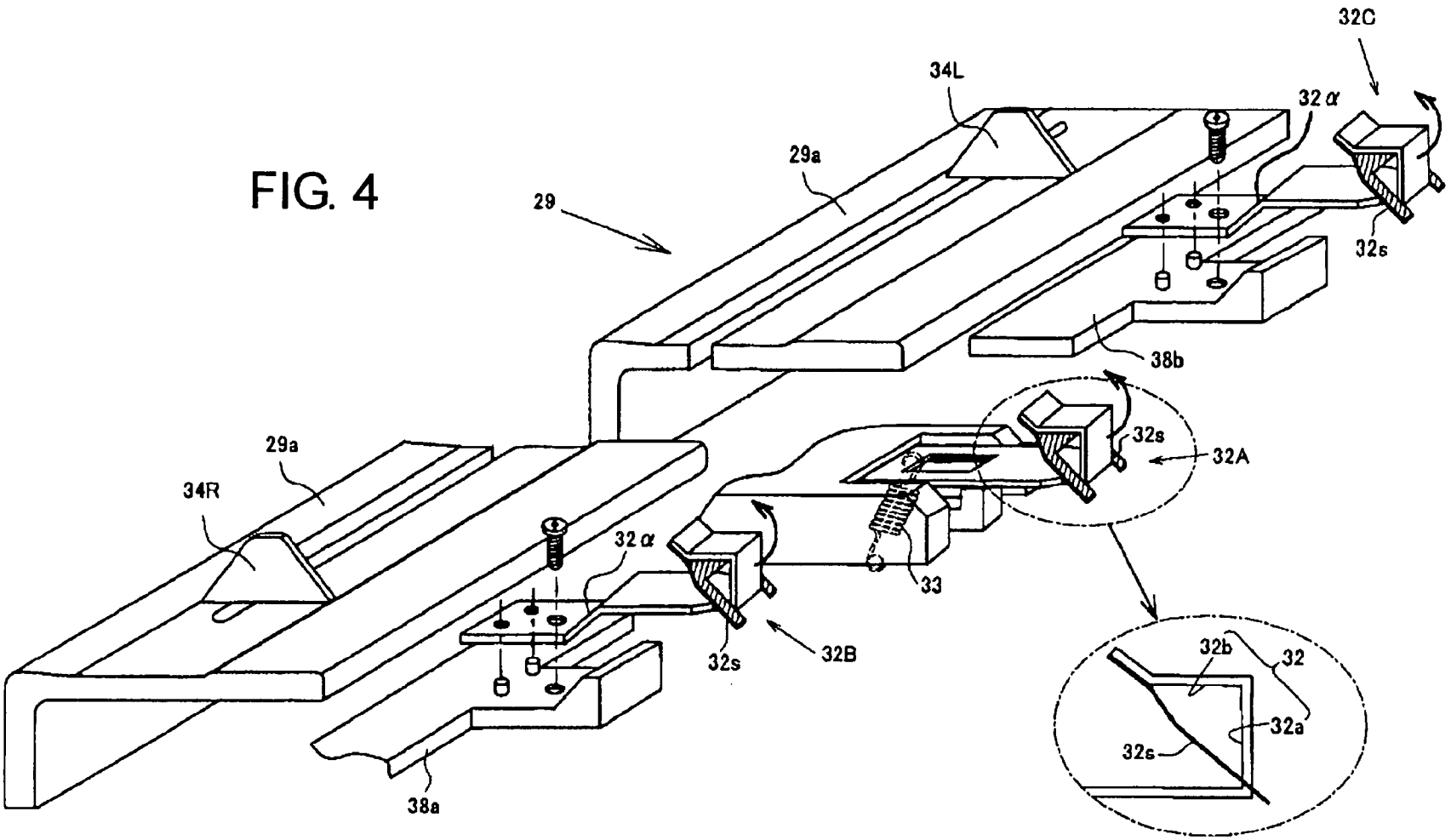
FIG. 4 is a configuration explanatory view of a rear end regulating means and aligning means of a processing tray.

In the processing tray 29 is disposed a sheet end regulating means 32 for positioning one end edge of the front end and rear end of the fed sheet. The sheet end regulating means 32 as shown in FIG. 4 is formed of a sheet end face regulating surface 32*a* with which the rear end edge of a sheet is pushed against to be regulated, and a stopper member having a sheet upper face regulating surface 32*b* for positioning the top surface of the uppermost sheet to regulate. The sheet end regulating means 32 is disposed in the rear end edge of the processing tray 29, pushes the rear end edge of a sheet fed by the switch back roller 26 and aligning means 51 described later to regulate, and positions the sheet in a predetermined post-processing position (binding position, which is the same in the following). At this point, the sheet upper face regulating surface 32*b* regulates a curled surface of the sheet of which the front end curls, while the sheet end face regulating surface 32*a* positions and regulates the sheet end edge.

The sheet end face regulating surface 32*a* and sheet upper face regulating surface 32*b* shown in the figure are integrally formed as the stopper member made of resin, metal plate or the like, and can be formed of separate members. In the sheet end regulating means 32 shown in the figure, the fixed stopper member 32A is situated in the center in the sheet width direction, first and second movable stopper members 32B and 32C are situated in the sheet right and left end portions, members 32A, 32B and 32C are arranged at predetermined intervals, and the means 32 is comprised of such a plurality of stopper members and others. In addition, "32*s*" shown in the figure denotes a plate spring attached to each stopper member to correct curl at the front end of the sheet.

Thus, the first and second movable stopper members 32B and 32C positioned in the sheet right and left portions thus move to positions corresponding to the sheet size. Therefore, with the bottom wall of the processing tray 29 are fitted and supported a right slide member 38*a* and left slide member 38*b* to be movable in the sheet width direction. Then, the first movable stopper member 32B and second movable stopper member 32C are fixed to the right and left slide members 38*a* and 38*b*. The right and left slide members 38*a* and 38*b* are coupled to alignment plates 34R and 34L for aligning the sheet side to move in synchronization therewith as described later.

In the sheet end regulating means 32 configured as described above, at least the sheet upper face regulating surface 32*b* is configured to be able to move up and down in the sheet load direction. This is because a sheet-bunch carrying-out means 100 as described later sometimes lifts a bunch of sheets on the processing tray upward in carrying out the bunch of sheets on the tray, and the sheet upper face regulating means 32*b* should be moved up and down according to up-and-down movements of the bunch of sheets.

Therefore, as shown in FIG. 4, the fixed stopper member 32A is pivotally supported by the bottom wall of the processing tray 29, biased and supported downward as viewed in the figure by a biasing spring 33. Further, the first and second movable stopper members 32B and 32C are respectively attached to the right and left slide members 38*a* and 38*b* to be elastically deformable (32*a* portion in the figure).

[Configuration of the Sheet Carrying Means]

In the processing tray 29 is disposed the sheet carrying means (switch back roller) 26 for guiding a sheet fed from the sheet discharge outlet 25*x* to the sheet end regulating means 32. The sheet carrying means 26 is made of a friction rotating body such as a roller, belt or the like for carrying a sheet fed to the processing tray 29 from the sheet discharge outlet 25*x* to the sheet end regulating means 32. The following description is given according to the switch back roller mechanism as shown in the figure.

As shown in FIG. 5, the switch back roller 26 is disposed above the processing tray 29, and is configured to carry the uppermost sheet on the processing tray in the forward and backward directions. Then, the switch back roller 26 is axially supported by a lifting/lowering support arm 28 to move up and down between an operation position (state of FIG. 5(*c*)) coming into contact with the sheet on the processing tray 29 and a standby position (state of FIG. 5(*b*)) separate upward from the sheet. In other words, the lifting/lowering support arm 28 is pivotably supported by the apparatus frame (not shown) by a pivot rotary shaft 28*a*, and the pivot rotary shaft 28*a* is coupled to a lifting/lowering motor (arm driving means, which is the same in the following) MY via a pinion 28*p*. In addition, a position sensor not shown is disposed in the lifting/lowering support arm 28, and detects a position of the lifting/lowering support arm 28 so as to control lifting and lowering between the standby position and the operation position.

The movable-side switch back roller 26*a* axially supported by the lifting/lowering arm 28 is coupled to a forward/backward motor not shown via a transmission means, and rotates forward and backward in the discharge direction of the sheet carried onto the processing tray 29 and the opposite direction. Therefore, the roller rotary shaft 26*z* of the switch back roller 26*a* is axially supported by a long groove 28*u* formed in the lifting/lowering support arm 28 as shown in FIG. 5(*a*), and thus supported to be able to move up and down in the sheet load direction (vertical direction as viewed in the FIG. 5(*a*)). Then, a paper surface contact sensor Ss is provided in the movable-side switch back roller 26*a*. In addition, "28*z*" in the figure denotes a plate spring biasing the roller rotary shaft 26*z* always downward, and is to prevent a malfunction of the paper surface detection sensor Ss caused by the shaft floating upward when the switch back roller 26*a* moves downward.

[Paper Surface Contact Sensor]

The switch back roller 26*a* is provided with the paper surface contact sensor Ss for detecting a position of the roller rotary shaft 26*z* moving up and down along the long groove 28*u*. The paper surface contact sensor Ss is secured to the lifting/lowering support arm 28, and is configured to detect a position of the roller rotary shaft 26*z* traveling (moving upward) in the long groove 28*u* by the contact pressure that the switch back roller 26*a* comes into contact with the uppermost sheet on the processing tray. Therefore, the lifting/lowering arm 28 is provided with a sensor lever 30 having a rotation center o1 in a position different from the pivot rotary shaft 28*a*, and the roller rotary shaft 26*z* is axially coupled to the front end portion of the sensor lever 30. Then, the paper surface contact sensor Ss is formed of a photosensor for detecting a sensor flag 30*f* formed in the rear end portion of the sensor lever 30.

Thus configured switch back roller 26*a* moves up and down between the standby position (FIG. 5(*b*)) above the processing tray and the operation position (FIG. 5(*c*)) coming into contact with the sheet carried onto the processing tray by causing the lifting/lowering support arm 28 to pivot up and down by the lifting/lowering motor MY. Then, the paper surface contact sensor Ss disposed in the lifting/lowering support arm 28 detects that the switch back roller 26*a* comes into contact with the sheet carried onto the processing tray 29.

[Configuration of the Control Means]

A control means 165 for controlling the lifting/lowering motor MY is configured as described below. The control means 165 is formed of a control CPU 161 as described later, and controls the lifting/lowering support arm 28 to move up and down between the standby position and the operation position. First, the control means 165 controls the lifting/lowering support arm 28 to rest in the standby position using a position sensor (not shown) disposed in the arm 28. Then, when the sheet sensor S2 detects the front end of a sheet carried out from the sheet discharge outlet 25*x*, after a lapse of predicted time that the sheet front end is passed through immediately below, the control means 165 rotates the lifting/lowering motor MY counterclockwise as viewed in FIG. 5(*a*). Upon the rotation, the lifting/lowering support arm 28 rotates around the pivot rotary shaft 28*a* counterclockwise in FIG. 5(*a*). By this means, since the roller rotary shaft 26*z* of the switch back roller 26*a* is supported by the long groove 28*u*, the roller 26 moves downward from the standby position (FIG. 5(*b*)) to the operation position (FIG. 5(*c*)) at the substantially same velocity as that of the lifting/lowering support arm 28. At this point, the sensor lever 30 coupled to the switch back roller 26*a* moves (falls) in the same direction at the same velocity as those of the lifting/lowering support arm 28.

At this point, the control means 165 sets that the downward velocity (rotation speed of the lifting/lowering motor MY) Va of the lifting/lowering support arm 28 is equal to or slower than the velocity (free fall velocity) Vr that the movable-side switch back roller 26*a* falls inside the long groove 28*u* under the roller's own weight (Va≦Vr). This is because when the falling velocity Va of the lifting/lowering support arm 28 is faster than the velocity of the switch back roller 26*a* freely falling inside the long groove 28*u*, the roller becomes unstable. The paper surface contact sensor Ss is thus prevented from malfunctioning due to a rebound or the like. In other words, by limiting the velocity Vr that the switch back roller 26*a* falls using the velocity of the lifting/lowering support arm 28, and thereby causing the roller 26*a* to fall gently, the paper surface contact sensor Ss is prevented from malfunctioning such as chattering and the like.

Next, when the periphery of the switch back roller 26*a* comes into contact with the top of the uppermost sheet on the processing tray 29, the switch back roller 26*a* is rested on the uppermost sheet, and the lifting/lowering support arm 28 pivots and falls in the same direction. At this point, with respect to the paper surface contact sensor Ss, the sensor lever 30 pivots around the rotation center o1 in its center clockwise (in the direction shown by the arrow in FIG. 5(*c*)). Then, the paper surface contact sensor Ss detects the sensor lever 30 and is "ON". The detection signal of the paper surface contact sensor Ss causes the lifting/lowering motor MY to halt. By thus controlling, the switch back roller 26*a* comes into contact with the uppermost sheet always with a constant pressure-contact force (for example, self weight) irrespective of whether the load amount of sheets stacked on the processing tray 29 is large or small (see FIG. 5(*c*)).

In tandem with falling of the switch back roller 26*a* to the operation position, the control means 165 drives the forward/backward rotation motor (not shown) to rotate the switch back roller 26*a* forward and backward. Then, the sheet carried onto the uppermost sheet on the processing tray 29 from the sheet discharge outlet 25*x* receives a constant transport force, and is moved in the sheet discharge direction and the direction opposite to the sheet discharge direction. In addition, in the apparatus as shown in the figure, when a sheet from the sheet discharge outlet 25*x* is carried from the sheet discharge outlet in the sheet discharge direction, the switch back roller 26*a* rotates clockwise as viewed in the figure, and draws the sheet front end into the processing tray 29. Then, when the sheet rear end is passed through the sheet discharge outlet 25*x*, the switch back roller 26*a* is rotated backward, and carries the sheet by switch back to the sheet end regulating means 32 side. In the process of sheet transport, the sheet and the switch back roller 26*a* are engaged with each other with a constant pressing force irrespective of the load amount of sheets on the processing tray, and a beforehand set given transport force is applied to the sheet.

Figure 6:
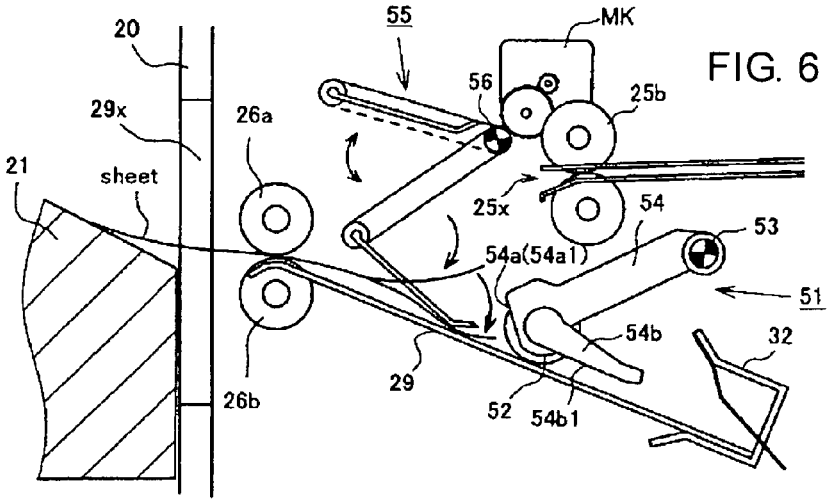
FIG. 6 contains explanatory views of a sheet aligning mechanism of the processing tray, where FIG. 6(*a*) is an explanatory view showing the entire structure, FIG. 6(*b*) is an explanatory view showing a state with a small sheet load amount, FIG. 6(*c*) is an explanatory view showing a state with a large sheet load amount, FIG. 6(*d*) is an explanatory view showing a positional relationship between a carry-in guide and carrying-out guide, FIG. 6(*e*) is an explanatory view showing a structure of a kick means, and FIG. 6(*f*) is an explanatory view showing its driving mechanism.
Figure 6:
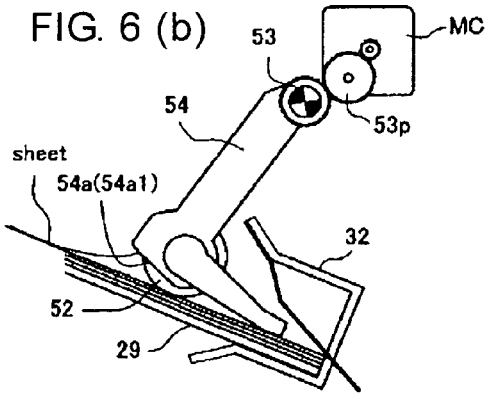
Figure 6:
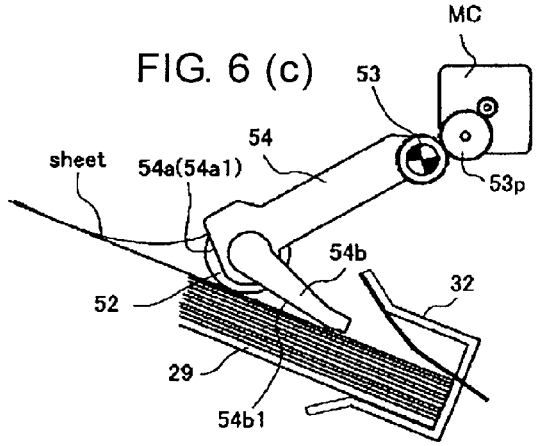
Figure 6:
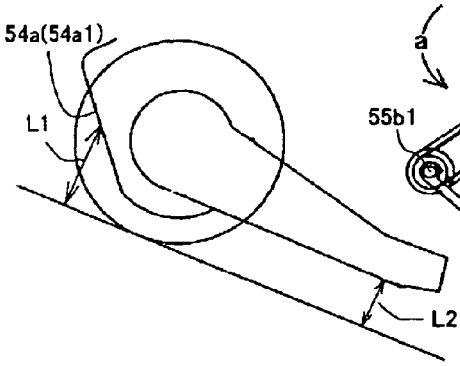
Figure 6:
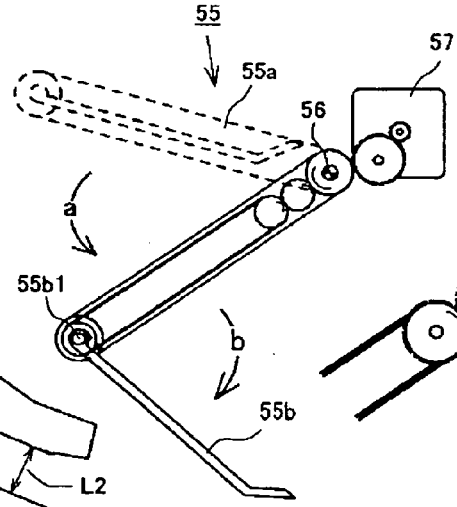
Figure 6:
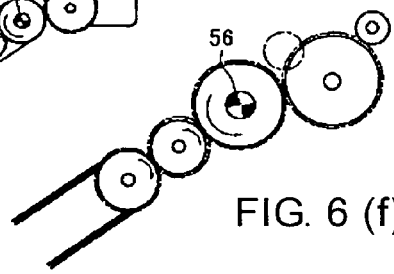

On the processing tray 29 is provided the aligning mechanism (aligning means) 51 for carrying a sheet to the sheet end regulating means 32 together with the switch back roller 26*a*. As shown in FIG. 6(*a*), the aligning means 51 is formed of a friction rotating body 52 which is disposed immediately below the sheet discharge outlet 25*x* and draws the rear end of the sheet fed to the processing tray 29 to move toward the sheet end regulating means 32.

The friction rotating body 52 is formed of a rotating body such as a roller, belt or the like made of a rubber material, sponge (porous foam), etc., and engages with the uppermost sheet on the tray to carry in the predetermined direction by its friction force. The friction rotating body 52 as shown in the figure is configured to move up and down corresponding to the load amount of sheets collected on the processing tray 29. Therefore, the friction rotating body (roller) 52 is axially supported by a lifting/lowering support arm 54 pivotally supported by the apparatus frame (not shown in the figure) on a pivot rotary shaft 53. A driving pinion 53*p* is attached to the pivot rotary shaft 53, and the driving pinion 53*p* is coupled to a stepping motor MC. Then, a torque limiter (not shown in the figure) is incorporated into between the driving pinion 53*p* and pivot rotary shaft 53. Accordingly, in the lifting/lowering support arm 54, when the friction rotating body 52 attached to the arm 54 comes into contact with the uppermost sheet on the processing tray 29, the torque limiter idles by the reaction force, and the body 52 engages with the uppermost sheet always by a constant pressure.

Therefore, the friction rotating body 52 engages with the uppermost sheet irrespective of whether the load amount of sheets collected on the processing tray 29 is large or small, and the lifting/lowering support arm 54 halts in this position. Then, after the lifting/lowering support arm 54 halts on the uppermost sheet, the torque limiter not shown idles and applies a predetermined pressing force to the friction rotating body 52. In addition, a floating pulley is axially supported by the pivot rotary shaft 53, and a driving motor not shown is coupled to the pulley. Then, the rotation force of the driving motor is conveyed to the friction rotating body 52 from the pulley by a belt or the like. Thus configured friction rotating body 52 rotates counterclockwise as viewed in FIG. 6 in the operation position shown in FIGS. 6(*b*) and 6(*c*), and transfers the sheet carried onto the processing tray toward the sheet end regulating means 32.

To the lifting/lowering support arm 54 are attached a carry-in guide 54*a* on the upstream side of the friction rotating body 52 and a carrying-out guide 54*b* on the downstream side. Then, the carry-in guide 54*a* is formed in the shape of a guide for guiding the sheet front end to the friction rotating body 52, while the carrying-out guide 54*b* is situated between the friction rotating body 52 and the sheet end regulating means 32, and formed in the shape of a guide for guiding the sheet front end to the sheet end regulating means 32.

[Carry-in Guide]

As shown in FIG. 6(*a*), the carry-in guide 54*a* is integrally formed with the lifting/lowering support arm 54, and provided with a tapered plane 54*a*1 tilting so that the sheet carry-in side is high while the friction rotating body side is low so as to guide the sheet front end to the periphery direction of the friction rotating body 52. Accordingly, even when the rear end of the sheet fed toward the sheet end regulating means 32 by the switch back roller 26*a* is curled and warped up, the sheet is guided to the friction rotating body 52 along the tapered plane 54*a*1. The carry-in guide 54*a* is integrally formed with the lifting/lowering support arm 54, and therefore, is lifted according to the load amount of sheets on the processing tray. The reason why the carry-in guide 54 is thus integrally formed with the friction rotating body 52 is as described below. When the roller diameter of the rotating body is formed to be small (for downsizing), a sheet with the rear end curled is entangled with the roller and jams. Then, when the sheet is guided by the carry-in guide, the relationship of angle between the guide plane (tapered plane as described above) and the roller periphery varies and causes a jam corresponding to the load amount of sheets. To solve such a problem, the friction rotating body 52 and carry-in guide 54*a* are integrally formed and configured to move up and down corresponding to the load amount of sheets.

[Carrying-out Guide]

The carrying-out guide 54*b* is provided with a guide plane 54*b*1 for guiding the rear end side of the sheet fed by the friction rotating body 52 to the sheet end regulating means 32 from above the sheet. The carrying-out guide 54*b* is also integrally formed with the lifting/lowering support arm 54 as in the carry-in guide 54*a*, and integrally configured with the friction rotating body 52. Accordingly, the guide 54*b* is raised upward corresponding to the load amount of sheets on the processing tray.

Therefore, as shown in FIG. 6(*d*), with respect to the uppermost sheet on the processing tray 29, the carry-in guide 54*a* and carrying-out guide 54*b* are set so that a distance (L1) between the carry-in guide 54*a* and the uppermost sheet is larger than another distance (L2) between the carrying-out guide 54*b* and the uppermost sheet (L1>L2).

[Configuration of Kicker Means]

The carry-in guide 54*a* works together with a kicker means 55 situated on its upstream side to guide the sheet from the sheet discharge outlet 25*x* to the friction rotating body 52. The kicker means 55 will be described. As mentioned previously, a level difference is formed between the sheet discharge outlet 25*x* and the processing tray 29, and the rear end of the sheet fed from the sheet discharge outlet 25*x* by the switch back roller 26*a* falls onto the processing tray 29. Therefore, the sheet discharge outlet 25*x* is provided with the kicker means 55.

As shown in FIG. 6(*a*), the kicker means 55 is formed of a base end pivot lever 55*a* attached to the apparatus frame by a rotary shaft 56 and a front end kick lever 55*b*. The rotary shaft 56 of the base end pivot lever 55*a* is coupled to a driving motor MK with a gear. Further, the front end kick lever 55*b* is rotatably coupled to the front end. Then, as shown in FIGS. 6(*e*) and 6(*f*), the rotary shaft 56 pivots by a predetermined rotation angle by the driving motor MK, and a shaft 55*b*1 of the front end kick lever 55*b* is coupled to the rotary shaft 56 via a gear and belt. Then, the kicker means 55 in the chain-line position (standby position) in FIG. 6(*e*) pivots in the direction shown by the arrow a in FIG. 6(*e*) (counterclockwise rotation) when the driving motor 57 is rotated in the clockwise direction in the figure. At this point, the front end kick lever 55*b* is coupled to the rotary shaft 56 via the gear and belt, and therefore, rotates in the direction shown by the arrow b in FIG. 6(*e*) (clockwise direction). Accordingly, by rotating the driving motor 57 forward (clockwise direction shown in FIG. 6(*e*)), the kicker means 55 shifts from the chain-line state to the solid-line state in FIG. 6(*e*), and at this point, hits the rear end of the sheet from the sheet discharge outlet 25*x* onto the processing tray 29 in the lower portion.

Then, the control CPU 161 described later applies power to the driving motor 57 at timing at which the sheet rear end is passed through the sheet discharge roller 25 with a detection signal that the sheet rear end is passed through the sheet discharge sensor S2 of the sheet discharge outlet 25*x*, and causes the kicker means 55 to kick and drop the sheet rear end onto the tray. The arrangement is made so that the sheet rear end dropped by the kicker means 55 is guided to the friction rotating body 52 by the carry-in guide 54*a*.

[Configuration of the Side Aligning Means]

In the processing tray 29 is disposed the side aligning means 34 for pushing and aligning the width of a sheet. The side aligning means 34 adopts a center reference for positioning a sheet carried into the processing tray 29 from the sheet discharge outlet 25*x* with reference to the center of the sheet, or a side reference for positioning the sheet with reference to a left or right side edge of the sheet. Descriptions are given according to the perspective view shown in FIG. 4 and operating state views shown in FIGS. 7 and 8.

Figure 7:
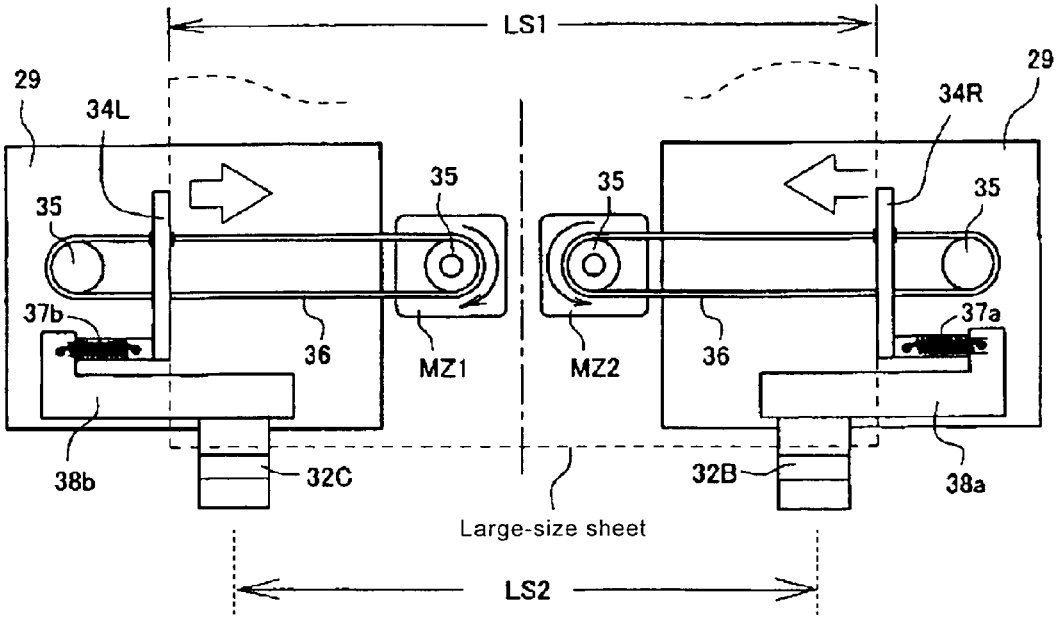
FIG. 7 shows a position moving mechanism of the rear end regulating means in the processing tray, where FIG. 7(*a*) is an explanatory view showing a regulation state of a large-size sheet, and FIG. 7(*b*) is an explanatory view showing a regulation state of a middle-size sheet.
Figure 7:
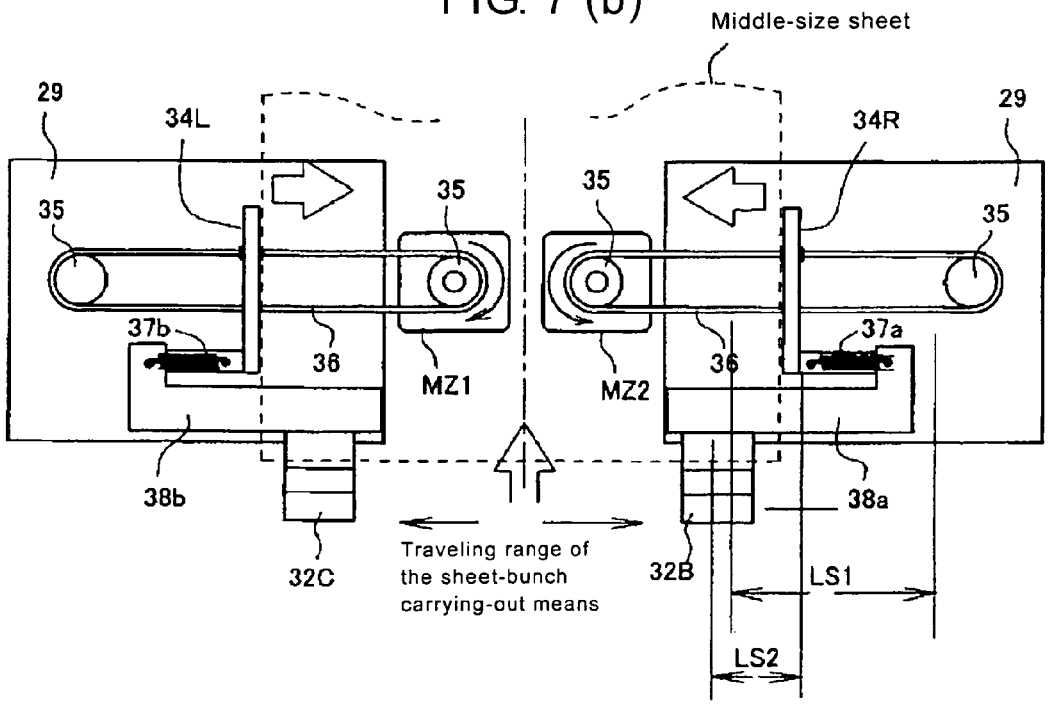

As shown in FIG. 4, the side aligning means 34 is formed of a left aligning plate 34L for engaging with the left-side edge of a sheet on the processing tray 29, and a right aligning plate 34R for engaging with the right-side edge of the sheet. Each of the left and right aligning plates 34L, 34R is fitted and supported with a guide groove (see FIG. 4) formed in the sheet support surface 29*a* of the processing tray, and is able to travel to positions in the sheet width direction. Then, a pair of pulleys 35 are disposed along each guide groove as shown in FIG. 7 in the bottom of the processing tray 29. A belt 36 is laid between the pulleys 35. Each of the left and right aligning plates 34L, 34R is fixed to the belt 36. Further, one of the pulleys 35 is coupled to a shift motor MZ1 or MZ2.

Figure 8:
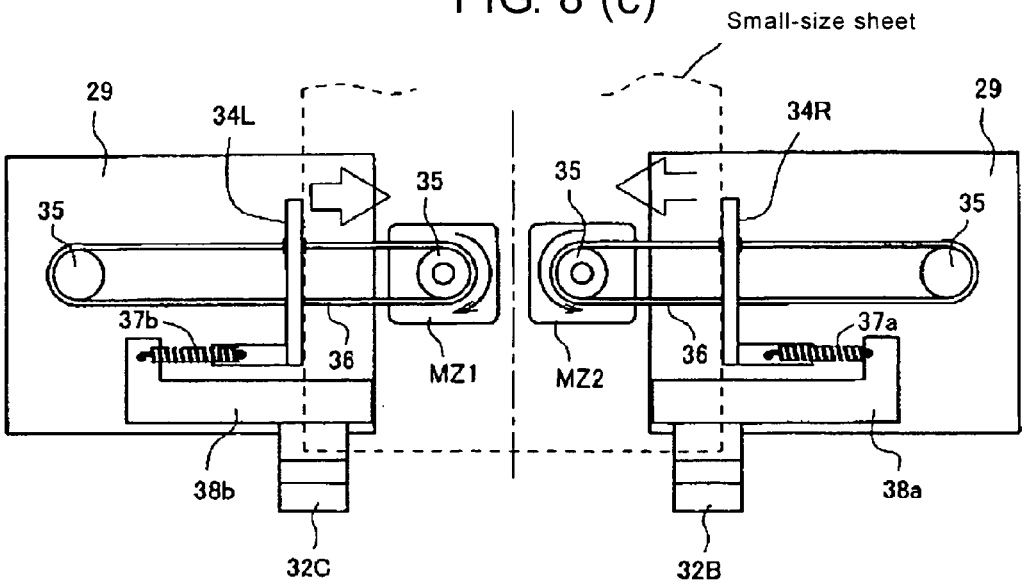
FIG. 8 shows the position moving mechanism of the rear end regulating means in the processing tray, where FIG. 8(*c*) is an explanatory view showing a regulation state of a small-size sheet, and FIG. 8(*d*) is an explanatory view showing an offset state of large-size sheets.
Figure 8:
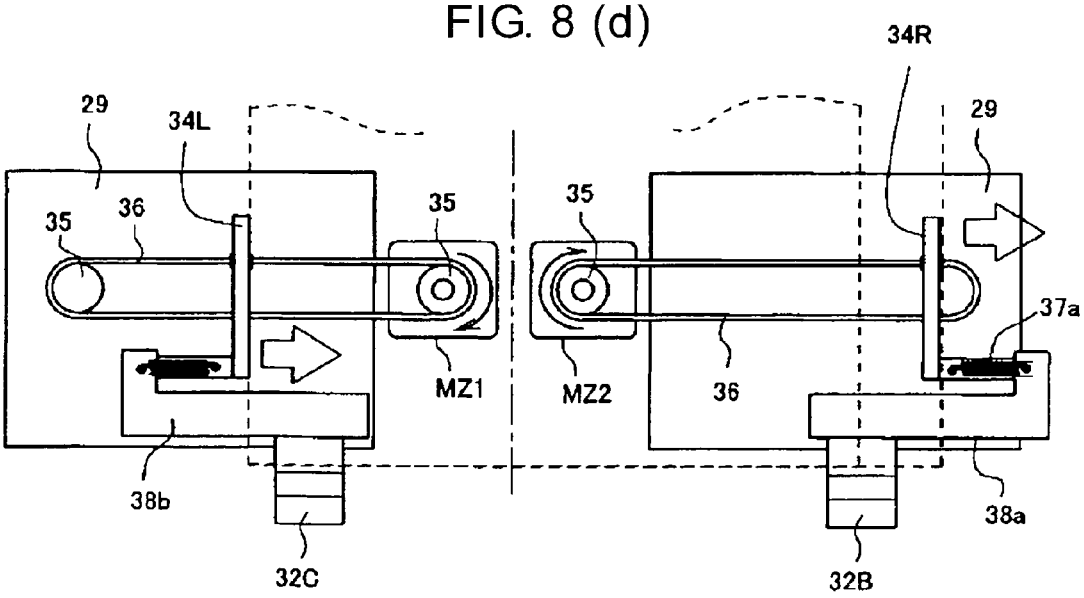

The left aligning plate 34L and right aligning plate 34R integrally formed as a pair at the left and right with such a configuration travel to positions leftward and rightward in the sheet width direction by driving respective shift motors MZ1, MZ2. Therefore, by driving and rotating the left and right shift motors MZ1, MZ2 by the same amount in the opposite directions in synchronization with each other, it is possible to align the sheet carried onto the processing tray in the center reference. FIG. 7(*a*) shows a state for aligning a large-size sheet, and FIG. 7(*b*) shows a state for aligning a middle-size sheet. Further, FIG. 8(*c*) shows a state for aligning a small-size sheet. Meanwhile, a bunch of sheets aligned in the center reference on the processing tray are allowed to be offset by driving and rotating the left and right shift motors MZ1, MZ2 by the same amount in the same direction. FIG. 8(*d*) shows the case of shifting large-size sheets to offset. When the post-processing position is displaced to a corner of the sheets (corner stapling as described later), the need arises to move the post-processing means 31 to the apparatus side, and results in an increase in apparatus size. Therefore, the large-size sheets are thus offset by a predetermined amount. By offsetting a bunch of sheets stacked on the processing tray 29 by a predetermined amount, the post-processing is made possible such as corner biding and the like. It is thereby achieved to obtain a small compact apparatus.

[Cooperative Mechanism of the Aligning Plates and Movable Stopper]

A pair of aligning plates 34L, 34R at the left and right configured as described above coordinate with the sheet end regulating means 32 mentioned previously as described below. Further, the sheet end regulating means 32 is provided with the left movable stopper (second movable stopper member) 32C and the right movable stopper (first movable stopper member) 32B. The right and left movable stoppers 32B, 32C are coupled to the right and left slide members 38*a* and 38*b* fitted and supported with the processing tray 29 to be movable in the sheet width direction.

Therefore, the left and right movable stoppers 32C, 32B are coupled to the left and right aligning plates 34L, 34R by coupling springs 37 as shown in FIG. 7(*a*). In other words, the right slide member 38*a* provided with the right movable stopper 32B is coupled by a coupling spring 37*a*, and the left slide member 38*b* provided with the left movable stopper 32C is coupled by a coupling spring 37*b*. Then, the left and right aligning plates 34L, 34R reciprocate between a stoke LS1 in the sheet width direction. In contrast thereto, the right and left movable stoppers 32B, 32C reciprocate between a stoke LS2. Therefore, the right and left movable stoppers 32B, 32C are provided with stopper members not shown on the processing tray 29 side.

Then, the strokes LS1, LS2 are set at LS1>LS2, and the right and left movable stoppers 32B, 32C travel by the same amount in conjunction with movements of the left and right aligning plates 34L, 34R until hitting the stopper members. After hitting the stopper members, the right and left movable stoppers 32B, 32C stop in these positions, and the aligning plates 34L, 34R further travel At this point, the coupling springs 37*a*, 37*b* for coupling the plate and stopper elongate (extend). Accordingly, the left and right aligning plates 34L, 34R move to positions between the stroke LS1 corresponding to the sheet size, while the movable stoppers 32B, 32C move between the stroke LS2. The reason why the stroke of the right and left movable stoppers 32B, 32C is set shorter is that the sheet-bunch carrying-out means 100 described later is situated in the sheet center.

As described above, in the case where the right and left movable stoppers 32B, 32C constituting the sheet end regulating means 32 work in conjunction with the side aligning means 34 and travel strokes are different between the stopper and means 34, the form of using the coupling spring 37 is described in the embodiment as shown in the figure, but the left and right aligning plates 34L, 34R and the right and left movable stoppers 32B, 32C may be provided with a "slide transmission mechanism" or "deceleration transmission mechanism".

In the case of the "slide transmission mechanism", it is configured that the left and right aligning plates 34L, 34R and the right and left movable stoppers 32B, 32C are coupled by slide friction clutches, and that after the right and left movable stoppers 32B, 32C hit the stopper members, the clutch plates perform sliding movement. Meanwhile, in the "deceleration transmission mechanism", the left and right aligning plates 34L, 34R and the right and left movable stoppers 32B, 32C are coupled by gear transmission mechanisms, and the gear ratio is set so that the left and right aligning plates 34L, 34R travel in the stroke LS1, while the right and left movable stoppers 32B, 32C travel in the stroke LS2.

Control of the side aligning means 34 will be described. The left and right aligning plates 34L, 34R are provided with position sensors in beforehand set home positions, and positioned in the home position in starting the apparatus. Then, the control CPU 161 described later receives size information of a sheet undergoing image formation from the image formation apparatus A, and based on the information, the control means 166 places the left and right aligning plates 34L, 34R in predetermined standby positions. The standby positions are set at positions (positions to form a travel width enabling alignment) spaced a predetermined distance away from the width size of a sheet fed to the processing tray 29. Then, after a lapse of predicted time the rear end of the sheet carried out from the sheet discharge outlet 25*x* is carried onto the processing tray (after a lapse of timer time from the sheet discharge sensor S2), the control CPU 161 rotates the left and right shift motors MZ1, MZ2 in the opposite directions by a predetermined amount in synchronization with each other. Upon the rotation, the sheet carried onto the processing tray is pushed in the width and aligned.

[Corner Stapling Mode]

Further, the control CPU 161 is configured to offset sheets by shifting the left and right aligning plates 34L, 34R by a predetermined amount in the sheet width direction, in binding a bunch of sheets collected for each set on the processing tray by the stapling means (end binding stapling unit) 31 described later. In the case of an apparatus configuration for shifting the stapling means 31 to this position in binding a sheet corner, the apparatus is increased in size in the sheet width direction. Therefore, the apparatus shown in the figure offsets a bunch of sheets on the processing tray by driving shift motors MZ1, MZ2 of the left and right aligning plates 34L, 34R in the same direction by the same amount in the corner stapling mode.

[Configuration of the Sheet-bunch Carrying-out Means]

Figure 9:
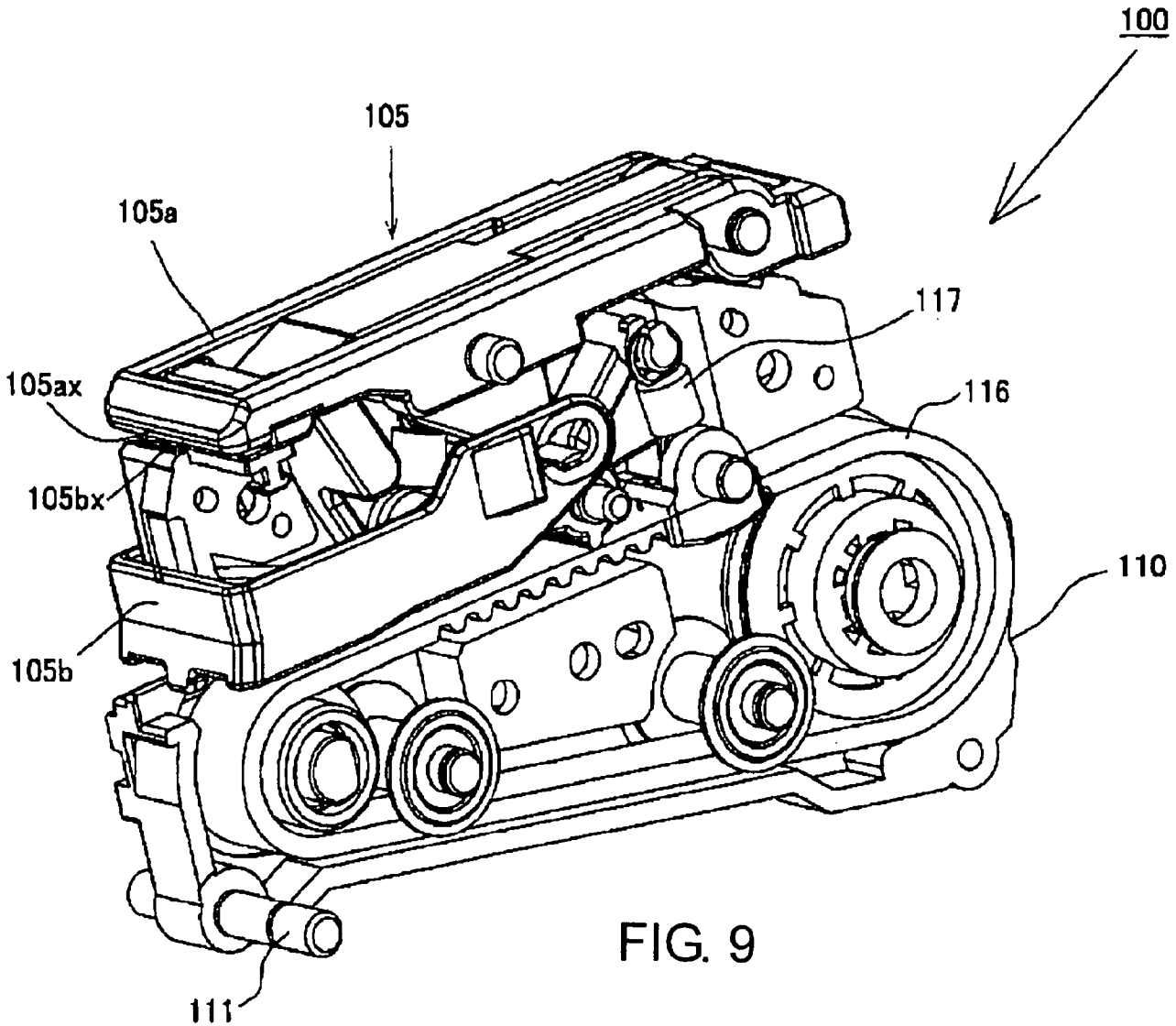
FIG. 9 is a perspective view showing an entire configuration of a sheet-bunch carrying-out means.
Figure 10:
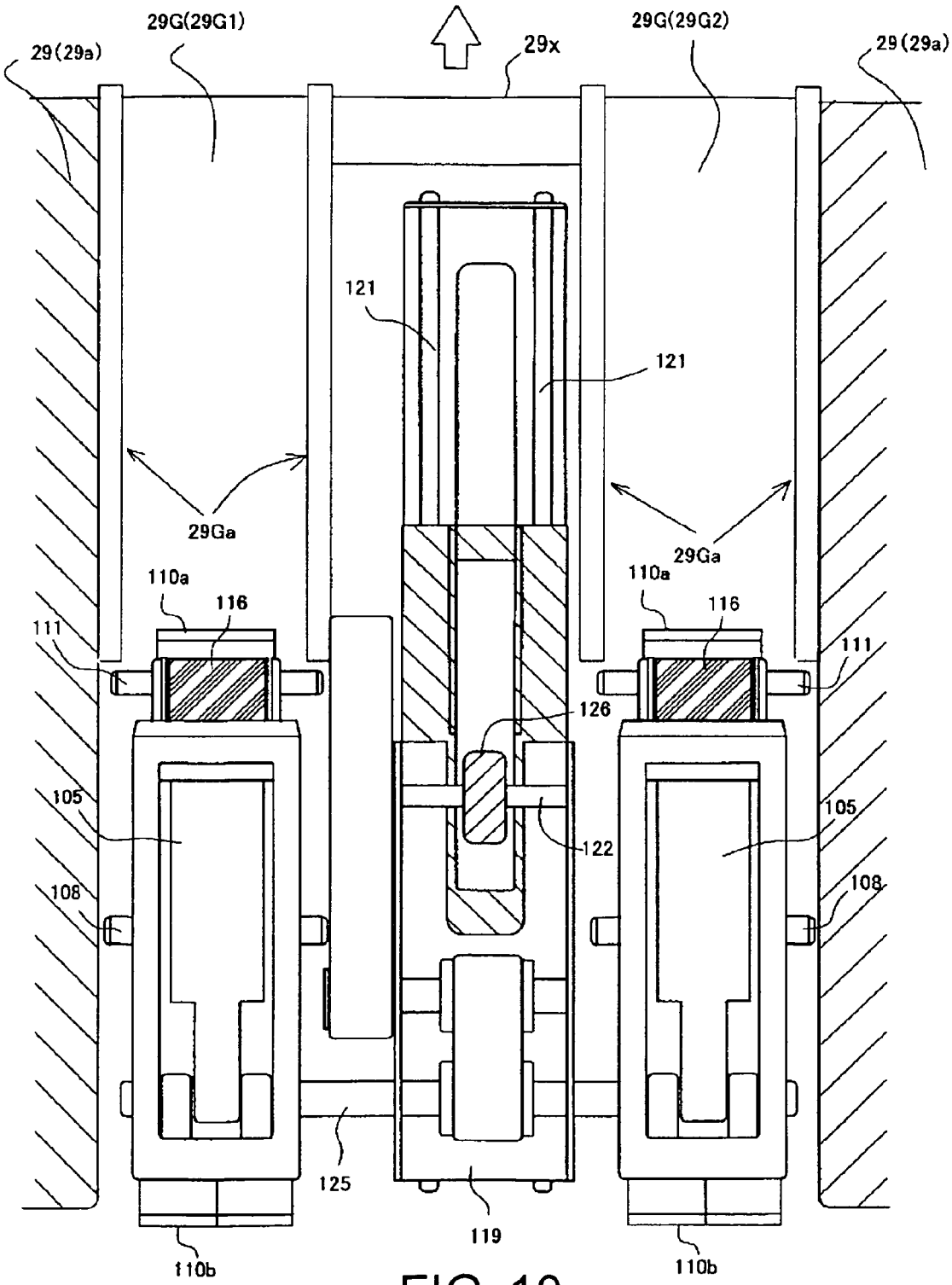
FIG. 10 is an explanatory view showing a planar structure of the sheet-bunch carrying-out means.
Figure 12:
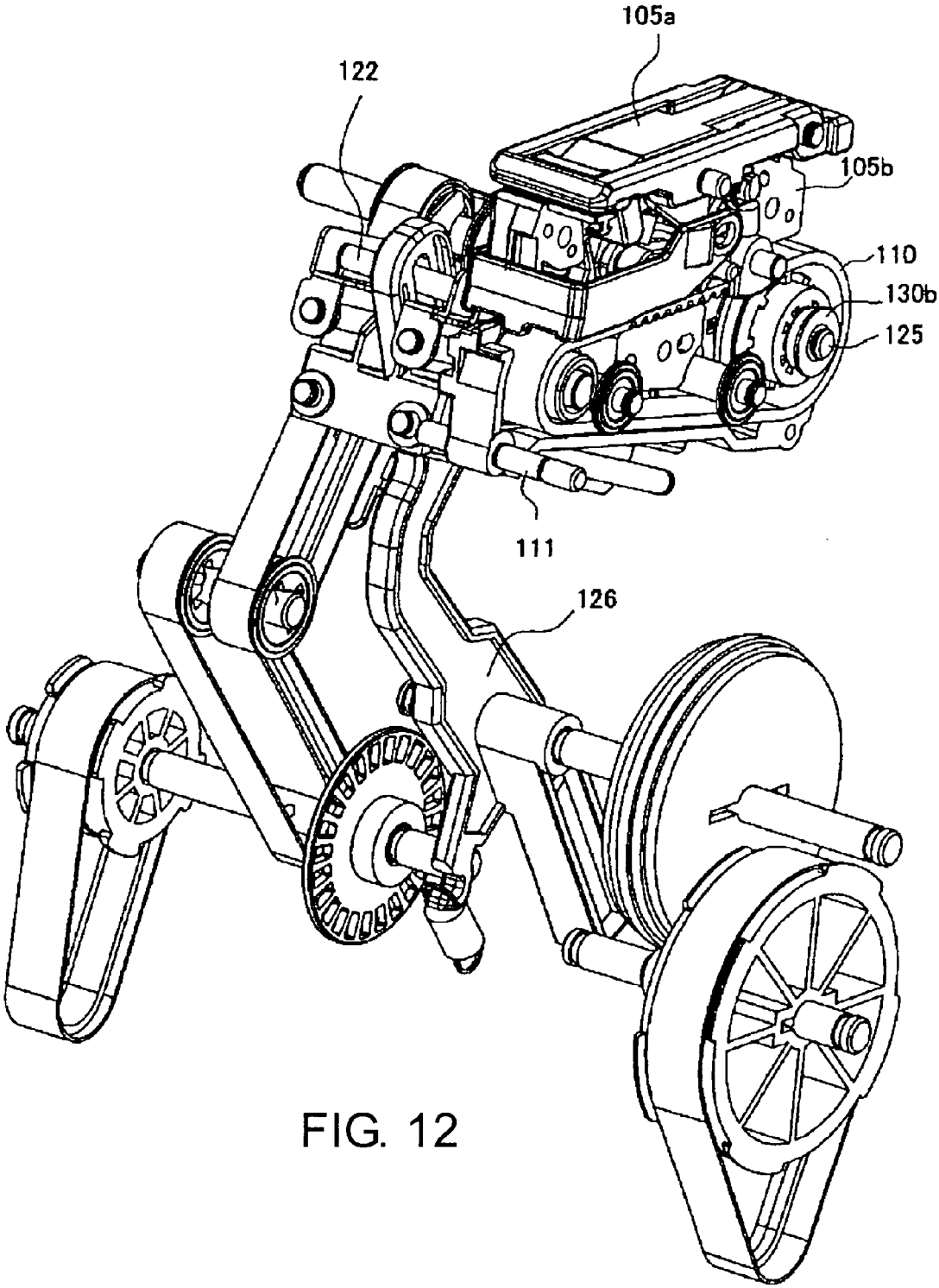
FIG. 12 is an explanatory view of a driving mechanism of the sheet-bunch carrying-out means.

In the processing tray 29 is disposed the sheet-bunch carrying-out means 100 for carrying out a bunch of processed sheets to the stack tray 21 on the downstream side. The sheet-bunch carrying-out means 100 is disposed in the bottom of the processing tray 29, and is formed of a sheet engagement member 105 which protrudes above the sheet support surface 29*a* and engages with a bunch of sheets, and a carrier member 110 that supports the sheet engagement member 105 mounted thereon. FIG. 9 is an explanatory view showing a perspective structure of the sheet-bunch carrying-out means 100, FIG. 10 is an explanatory view showing the planar structure, and FIG. 12 is an explanatory view of a driving mechanism.

As shown in FIG. 9, the sheet-bunch carrying-out means 100 is formed of the sheet engagement member 105, carrier member 110, engagement member driving means 127, and carrier-member driving means 114. The sheet engagement member 105 is formed of a movable gripper 105*a* and fixed gripper 105*b*. Further, the carrier member 110 is mounted with the sheet engagement member 105, and is configured to reciprocate between a base end portion (post-processing position) and a front end portion (bunch carrying-out position) of the processing tray 29. Each structure will be described below.

[Sheet Engagement Member]

The sheet engagement member 105 is formed of an engagement member such as a protruding piece, gripper or the like for engaging with a rear end edge of a bunch of sheets collected on the processing tray, and is disposed inside a guide groove 29G formed on the sheet support surface 29*a* of the processing tray 29. As shown in FIG. 10, in the processing tray 29, the guide groove 29G is formed in the sheet-bunch carrying-out direction (hereinafter, simply referred to as a "bunch carrying-out direction") between the processing position and the stack tray 21 disposed on the downstream side of the processing tray 29. In the apparatus as shown in the figure, two guide grooves 29G1, 29G2 are formed spaced apart from each other in the sheet width direction, and the sheet engagement member 105 is disposed in each of the left and right guide grooves 29G1, 29G2 as described below.

Figure 13:
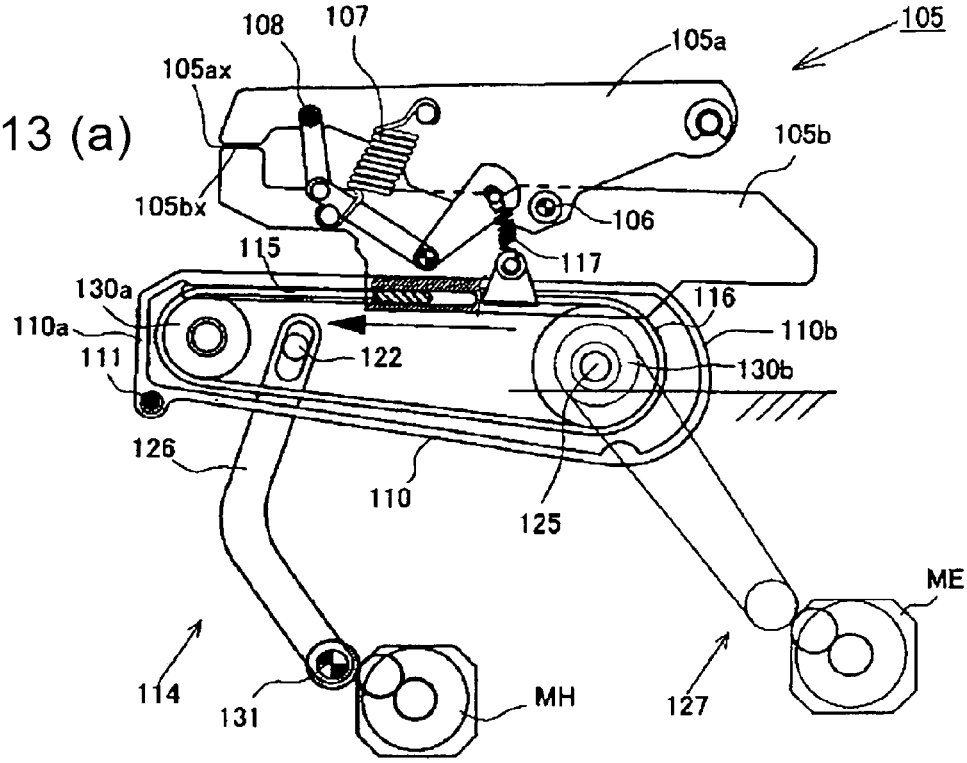
FIG. 13 contains explanatory views of a grip mechanism of the sheet-bunch carrying-out mechanism, where FIG. 13(*a*) is an explanatory view of a state where a bunch of sheets are nipped, and FIG. 13(*b*) is an explanatory view of a state where the bunch of sheets are released from the nip.
Figure 13:
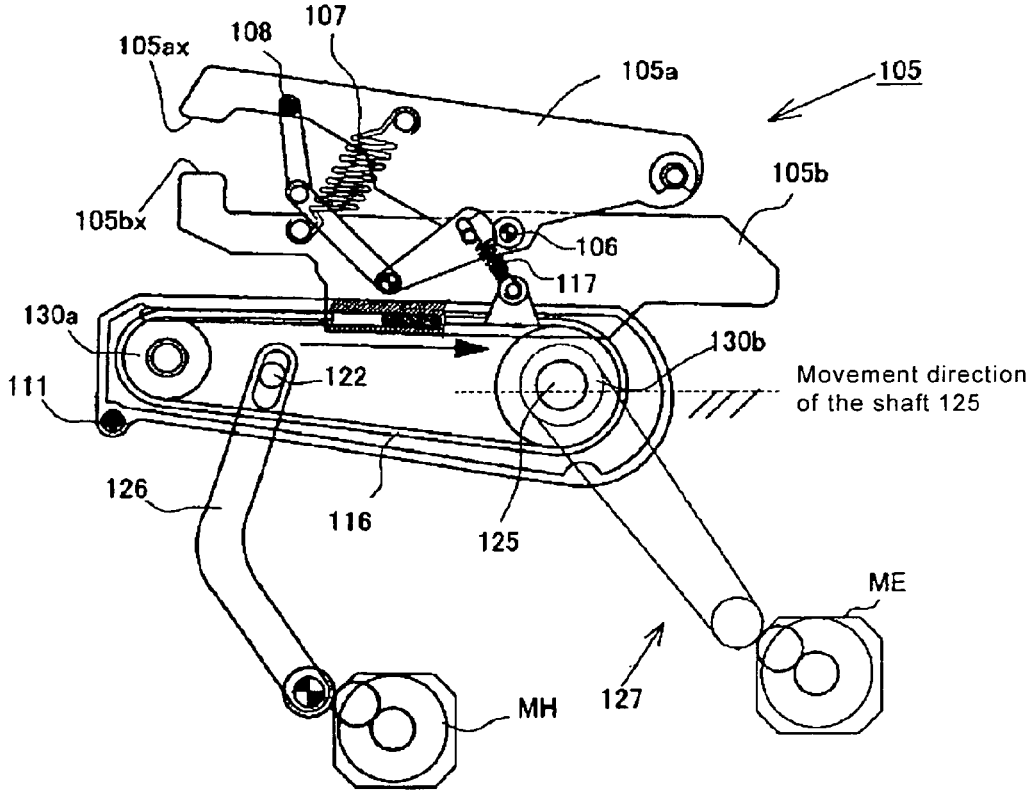
Figure 14:
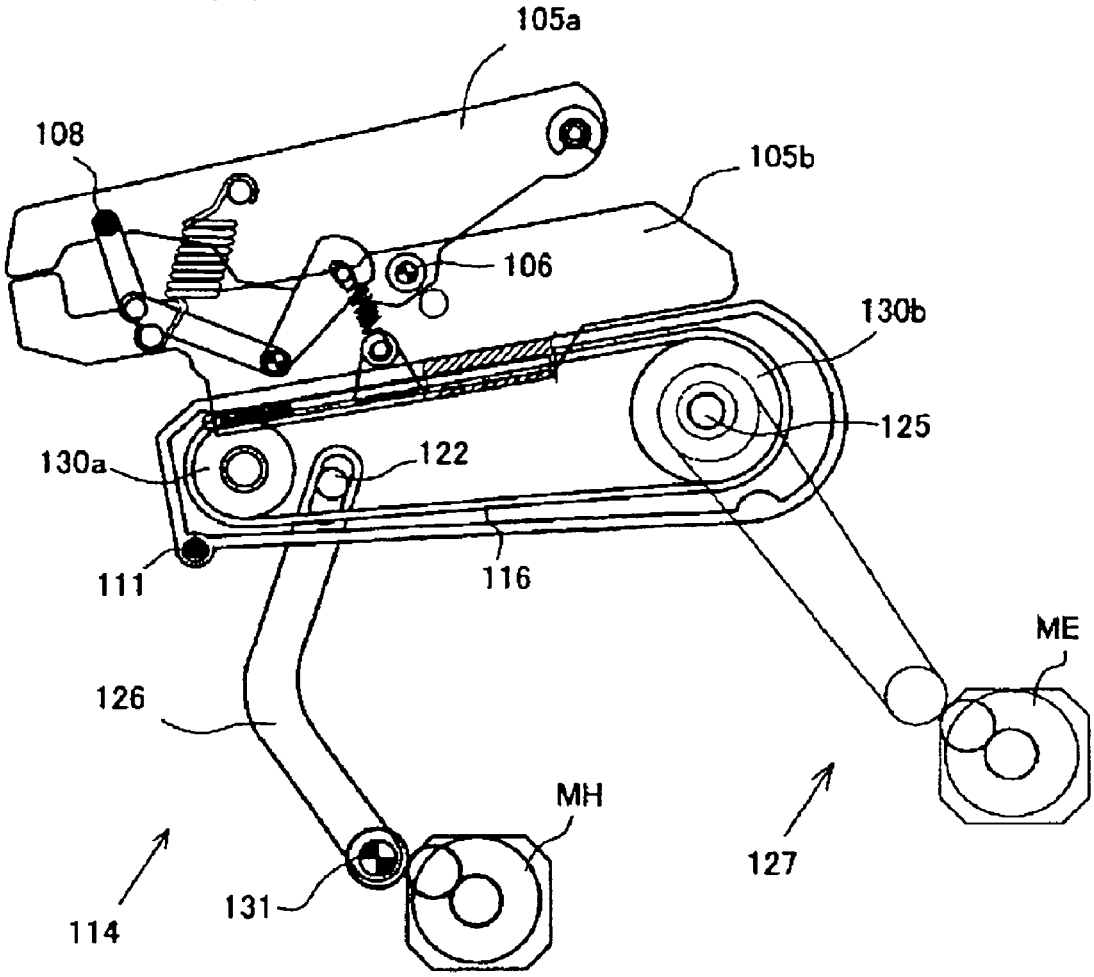
FIG. 14 is an explanatory view of the grip mechanism of the sheet-bunch carrying-out mechanism, where FIG. 14(*c*) is an explanatory view of a state where the bunch of sheets are carried out to a stack tray.

The sheet engagement member 105 as shown in the figure is formed of a gripper mechanism for gripping the rear end edge of a bunch of sheets on the processing tray 29 to carry out. As shown in FIGS. 9 and 13, the movable gripper 105*a* and fixed gripper 105*b* are coupled by a pivot pin (coupling pin) 106 to mutually pivot. Then, a biasing spring 107 is provided between the movable and fixed grippers, and a front-end nip portion 105*ax* of the movable gripper 105*a* and a front-end nip portion 105*bx* of the fixed gripper 105*b* are always brought into contact with each other by pressuring (see FIG. 13(*a*)).

Then, the fixed gripper 105*b* is fitted and supported in the guide groove 115 formed in the carrier member 110 to be able to move to positions in the carrying-out direction. Further, the rear end portion of the movable gripper 105*a* is coupled to a traveling belt 116 incorporated into the carrier member 110 by a coupling spring 117. Accordingly, when the traveling belt 116 of the carrier member 110 described later travels leftward as viewed in FIG. 13, the fixed gripper 105*b* and movable gripper 105*a* shift in the sheet-bunch carrying-out direction with the front-end nip portions 105*ax* and 105*bx* pressed and brought into contact with each other (state of FIG. 13(*a*)). When the traveling belt 116 inversely travels rightward as viewed in FIG. 13, the movable gripper 105*a* pivots clockwise about the pivot pin 106 as the center, and the front-end nip portion 105*ax* separates from the front-end nip portion 105*bx* of the fixed gripper 105*b* to release the nip (state of FIG. 13(*b*)).

[Carrier Member]

Described next is the carrier member 110 mounted with the above-mentioned sheet engagement member (hereinafter, a "gripper member (means)") 105 to support. As shown in FIGS. 9 and 13, the carrier member 110 is formed of a frame member with an appropriate shape for supporting the gripper member (means) 105, and is supported movable in the sheet-bunch carrying-out direction along the guide groove 29G formed in the processing tray 29.

The support structure will be described. A rear end portion 110*b* of the carrier member 110 is supported to reciprocate linearly along a slide member 119 as shown in FIG. 10. Meanwhile, a front end portion 110*a* of the carrier member 110 reciprocates while drawing a loop along loop guide grooves 29Ga described below. By this means, the gripper member (means) 105 mounted on the carrier member 110 shifts from a standby position to a carrying-out position by an upper path protruding above the processing tray, and returns to the standby position by a lower path sinking in the processing tray after carrying out a bunch of sheets to the stack tray 21. "111" shown in the figure denotes a guide pin provided at the front end portion of the carrier member 110, and is fitted with the loop guide groove 29Ga.

[Slide Member]

As shown in FIG. 10, the slide member 119 is fitted and supported with guide rails 121 disposed in the bottom of the processing tray 29, and supported to be able to reciprocate by a predetermined stroke in the same direction (vertical direction in FIG. 10) as that of the guide groove 29G. A driving rotary shaft 125 is laid over the slide member 119, and the rear end portion 110*b* of the carrier member 110 is axially coupled to the driving rotary shaft 125. FIG. 13 shows a state of this axially coupling, where the carrier member 110 is coupled to reciprocate in a predetermined stroke in the sheet-bunch carrying-out direction by the driving rotary shaft 125 in the rear end portion 110*b*, while the front end portion 110*a* is pivotable about the driving rotary shaft 125. In addition, the slide member 119 is coupled to a driving arm (crank member) 126 described later, and reciprocates between a predetermined stroke by the driving arm (crank member) 126. Further, the driving rotary shaft 125 is coupled to a driving pulley of the traveling belt 116 described later, and further, coupled to the engagement member driving means 127.

[Loop Guide Groove]

Figure 11:
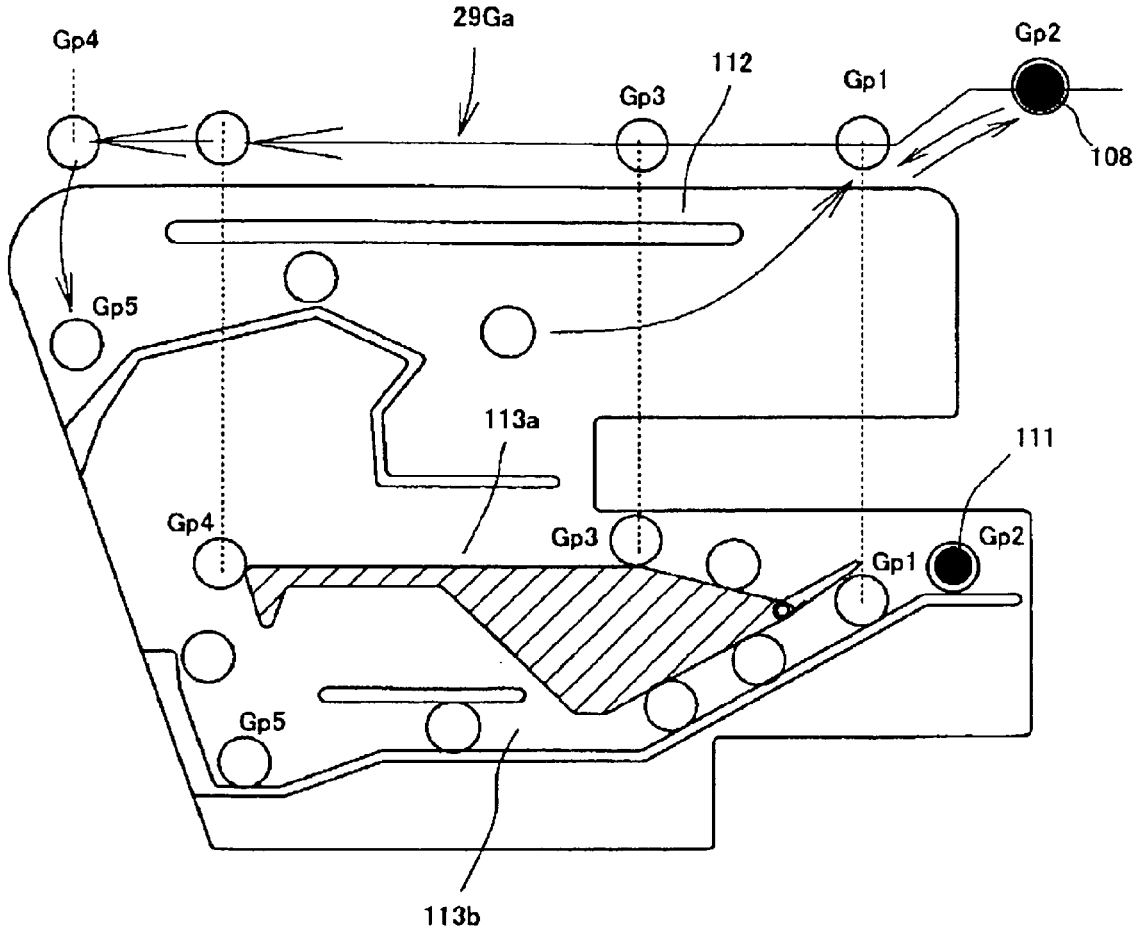
FIG. 11 is an explanatory view of a guide mechanism of the sheet-bunch carrying-out means.

The mutually opposite loop guide grooves 29Ga are formed on left and right side walls of the guide groove 29G (see FIG. 10). The guide pin 111 formed in the front end portion 110*a* of the carrier member 110 is fitted and supported with the loop guide grooves 29Ga. As shown in FIG. 11, each loop guide groove 29Ga is formed in the shape of a loop having an upper traveling path 113*a* and lower traveling path 113*b* along the sheet support surface 29*a* of the processing tray. Then, the guide pin 111 travels (outward) from the standby position to the carrying-out position along the upper traveling path 113*a*, and travels (homeward) from the carrying-out position to the standby position along the lower traveling path 113*b*.

As described above, when the carrier member 110 supported by the slide member 119 and loop guide grooves 29Ga travels from the standby position to the stack tray 21 side as shown in FIG. 11, the guide pins 111 track the upper traveling path 113*a*, and the carrier member 110 thereby travels in the substantially horizontal attitude. Meanwhile, when the carrier member 111 returns to the standby position from the stack tray 21, the guide pins 111 track the lower traveling path 113*a*, and the carrier member 110 thereby travels while tilting.

Further, as shown in FIG. 11, in the guide groove 29G is provided a loop groove 112 for guiding a guide pin 108 provided in the sheet engagement member (movable gripper member) 105*a*. The movable gripper 105*a* and fixed gripper 105*b* travel along the loop groove 112.

Figure 17:
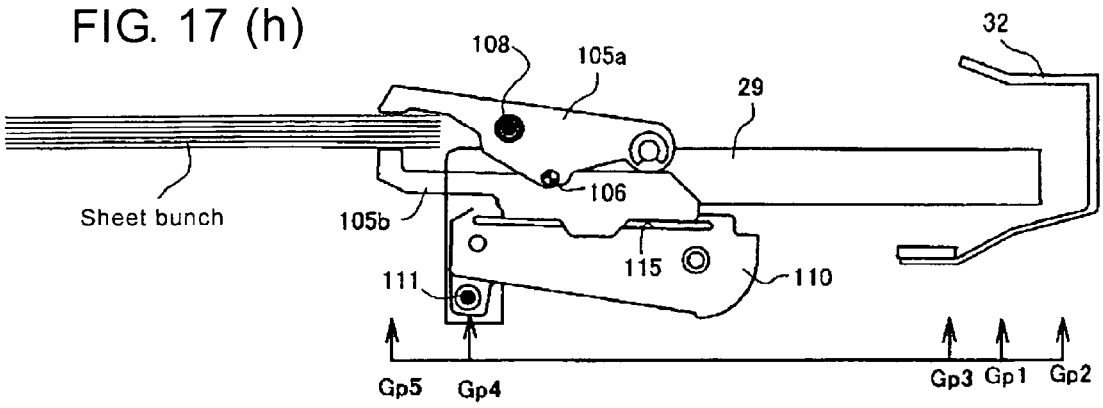
FIG. 17 contains operating state explanatory views of the sheet-bunch carrying-out means, where FIG. 17(*h*) shows a state where a bunch of sheets are moved to above the stack tray, FIG. 17(*i*) shows a state where the bunch of sheets are carried out onto the stack tray, FIG. 17(*j*) shows a state immediately after the bunch of sheets are stacked on the stack tray, and FIG. 17(*k*) is a state where the means returns to the first standby position.
Figure 17:
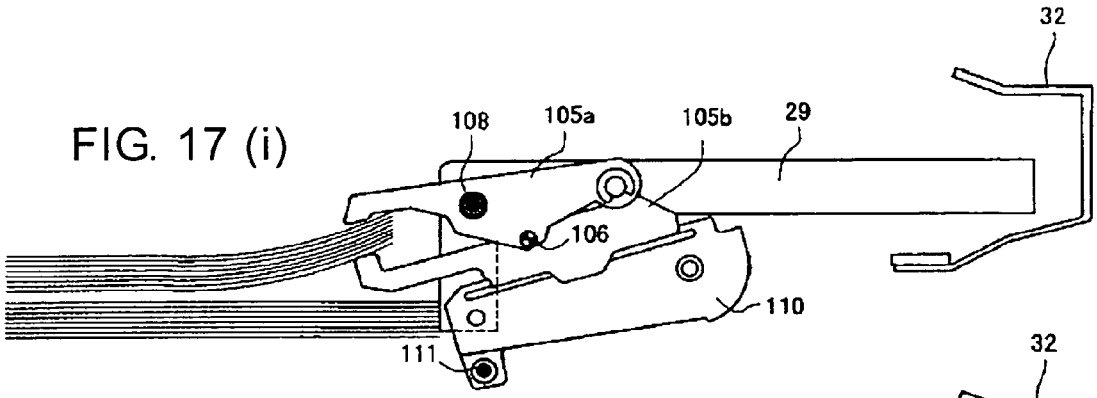
Figure 17:
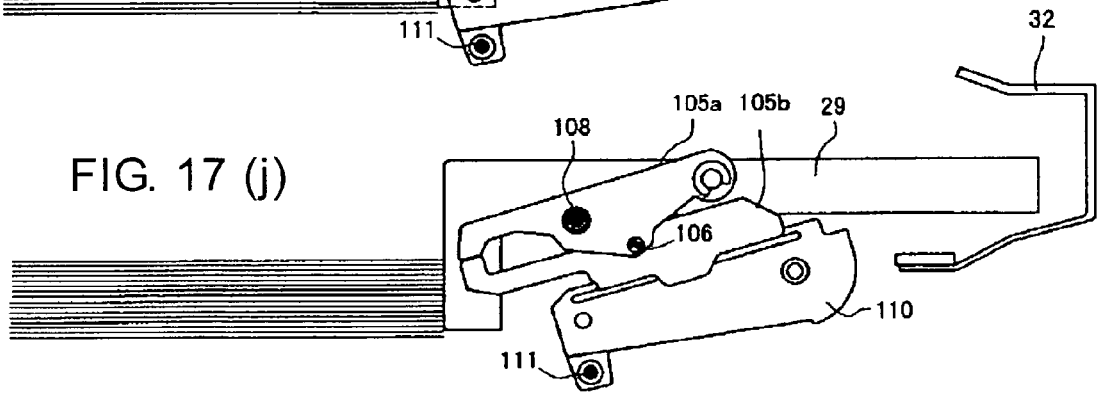
Figure 17:
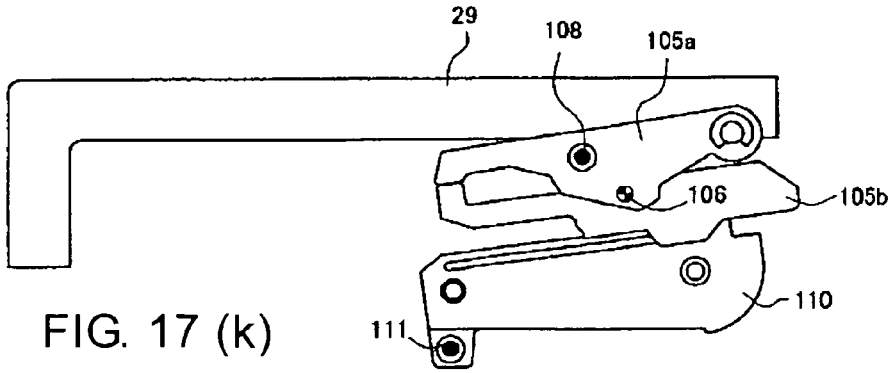

Then, as described later, the sheet engagement member (gripper member) 105 mounted on the carrier member 110 is in an operation attitude protruding above the processing tray 29 when the guide pins 111 of the carrier member 110 are guided by the upper traveling path 113*a* and travel in the sheet-bunch carrying-out direction, while being in a standby attitude sinking in the guide groove when the guide pints 111 are guided by the lower traveling path 113*b* and travel to the standby position. These states will be described later according to FIGS. 15 to 17.

Thus configured carrier member 110 is provided with a pair of pulleys, 130*a*, 130*b*, at the front and back in the sheet-bunch carrying-out direction as shown in FIG. 13, and the traveling belt 116 is looped between the pulleys. Then, one driving pulley 130*b* is axially supported on the driving rotary shaft 125 described previously. Accordingly, by rotation of the driving rotary shaft 125, the sheet engagement member (gripper member) 105 is configured to be movable between a base-end storing position (state of FIG. 15(*a*) described later) overlapping with the carrier member 110 and a front-end carrying-out position (state of FIG. 17(*h*) described later) protruding from the carrier member 110 in the sheet-bunch carrying-out direction.

[Installation Structure of the Sheet Engagement Member]

The carrier member 110 is disposed in the bottom of the processing tray 29, and the sheet engagement member (gripper member) 105 is mounted on the top of the carrier member 110. In the sheet engagement member (gripper member) 105, as described previously, the movable gripper 105*a* is coupled to the upper portion of the fixed gripper 105*b* with the pivot pin 106. Then, the fixed gripper 105*b* is supported by the carrier member 110 to be able to move to positions in the sheet-bunch carrying-out direction. "115" shown in the figure denotes the slide guide groove formed in the carrier member 110, and the fixed gripper 105*b* is fitted and supported with the guide groove 115. Further, the movable gripper 105*a* is supported by the fixed gripper 105*b* to be pivotable by the pivot pin 106, and the rear end portion is coupled to the traveling belt 116 incorporated into the carrier member 110 by the coupling sprint 117. The carrier member 110 and sheet engagement member (gripper member) 105 are respectively provided with the carrier driving means 114 and engagement member driving means 127 as shown in FIGS. 12 and 13.

[Carrier Driving Means]

As shown in FIG. 10, the carrier member 110 is coupled (connected) to the slide member 119 with the driving rotary shaft 125. Then, as conceptually shown in FIG. 13, the slide member 119 is integrally formed with a shaft pin 122, and the driving arm 126 is fitted with the shaft pin 122. The driving arm 126 is coupled to a driving motor MH to pivot about a pivot shaft 131 axially supported on the apparatus frame by the crank member. Then, the driving arm 126 and shaft pin 122 are coupled in a slit (long-hole) manner. Accordingly, when the driving arm 126 is moved back and forth by a predetermined angle by the driving motor MH, the slide member 119 reciprocates back and forth in a predetermined stroke. By back-and-forth motion of the driving arm 126, the rear end portion 110*b* of the carrier member 110 moves back and forth with a linear locus, while the front end portion 110*a* moves back and forth with a loop locus along the loop guide groove 29Ga. Thus, the carrier member 110 is provided with the carrier driving means 114 that moves the carrier member 110 to positions in the sheet-bunch carrying-out direction along the processing tray 29.

[Engagement Member Driving Means]

The fixed gripper 105*b* and movable gripper 105*a* forming the sheet engagement member (gripper member) 105 are mutually coupled with the pivot pin 106. Then, the fixed gripper 105*b* is supported by the carrier member 110 to be able to move back and forth in the sheet-bunch carrying-out direction along the slide guide groove 115. Further, the rear end portion of the movable gripper 105*a* is coupled to the traveling belt 116 of the carrier member 110 by the coupling sprint 117 (see FIG. 13 for the aforementioned description). Then, as conceptually shown in FIG. 13, in the traveling belt 116 provided in the carrier member 110, the driving pulley 130*b* thereof is coupled to a driving motor ME. The driving motor ME is formed of a motor capable of rotating forward and backward, and the traveling belt 116 moves leftward as viewed in FIG. 13 when the motor ME is rotated forward. According to moving of the traveling belt 116, the movable and fixed grippers 105*a*, 105*b* move (bunch carrying-out direction) from the standby position to the carrying-out position along the slide guide groove 115.

Further, when the driving motor ME is rotated backward, as shown in FIG. 13(*b*), the movable and fixed grippers 105*a*, 105*b* move from the carrying-out position to the standby position (in the return direction). Concurrently with the movement, when the traveling belt 116 further travels from the standby position to the back side, the coupling spring 117 moves clockwise according to the driving pulley 130*b*. By the backward operation of the driving pulley 130*b*, the coupling spring 117 pulls the rear end portion of the movable gripper 105*a* downward. At this point, the movable gripper 105*ax* rotates clockwise about the pivot pin 106, and the nip portion 105*ax* at the front end is extended upward to open (see FIG. 13(*b*)). Thus, the sheet engagement member (gripper member) 105 is provided with the engagement member driving means 127 for moving the sheet engagement member (gripper member) 105 to positions in the sheet-bunch carrying-out direction along the carrier member 110.

[Operation of the Sheet Engagement Member]

The operation of the sheet engagement member (gripper member) 105 configured as described above will be described below. Although a configuration of its control means will be described later, the gripper means (gripper member) 105 is controlled to move to "first standby position Gp1", "second standby position Gp2", "nip position Gp3", "bunch carrying-out position Gp4", "nip releasing position Gp5", and "first standby position Gp1" in this order.

[First Standby State]

The control means 167 described later moves the gripper means (gripper member, which is the same in the following) 105 to the first standby position Gp1 as shown in FIG. 15(*a*) by the "initial operation" (describe later) in starting the apparatus. In this first standby position Gp1, the gripper means 105 is in a standby attitude sinking in the guide groove 29G of the processing tray 29. In this attitude, sheets carried onto the processing tray 29 are pushed against the sheet end regulating means 32 and aligned as shown in FIG. 15(*b*). Accordingly, in this attitude, sheets from the sheet discharge outlet 25*x* are collected for each set on the processing tray 29, and undergo post-processing in a beforehand set processing position of a bunch of sheets.

[Backward Operation of the Gripper Means]

Upon receiving a job finish signal from the image formation apparatus A, the control means 167 backs the gripper means 105 toward the second standby position Gp2 on the rear side. Therefore, the control means 167 rotates the driving motor MH of the driving arm 126 backward by a predetermined amount. In the process of backing toward the second standby position Gp2, in the gripper means 105, the guide pins 111 of the carrier member 110 shift to the upper traveling path 131*a* from the lower traveling path 131*b* of the loop guide groove 29Ga. Then, the movable gripper 105*a* protrudes above the sheet support surface 29*a* (see FIG. 15(*c*)). At this point, sheet front ends are pushed upward by the movable gripper 105*a*, and the sheet end regulating means 32 elastically deforms, follows the sheet front ends, and bends to deform upward as shown in FIG. 15(*d*). By this means, smooth movement of the gripper means 105 is ensured.

[Second Standby Position State]

Next, the control means 167 rotates the driving motor MH of the driving arm 126 backward by a predetermined amount, and halts the motor. Then, the control means 167 rotates the driving motor ME of the driving pulley 130*b* provided in the carrier member 110 clockwise (see FIGS. 13(*a*) and 13(*b*)). Upon the rotation, the movable gripper 105*a* shifts from a nip attitude of FIG. 15(*c*) to a nip releasing attitude of FIG. 16(*e*). In this state, the gripper means 105 is positioned in the second standby position Gp2.

[Nip Operation]

Then, the control means 167 rotates the driving motor MH of the driving arm 126 forward, and moves the carrier member 110 in the bunch carrying-out direction. Concurrently with this driving control, the control means 167 rotates the driving pulley 130*b* of the carrier member 110 clockwise (see FIGS. 13(*a*) and 13(*b*)). At this point, by adjusting the moving velocity Vb of the traveling belt 116 with respect to the moving velocity Vc of the carrier member 110, it is possible to rest the gripper member 105. In other words, by moving the gripper member 105 in the direction opposite to the moving direction of the carrier member 110 with respect to the sheets on the processing tray, the gripper means 105 is at rest with respect to the sheets. For example, when the velocities Vc and Vb are the same velocity, the equation of Vc=−Vc holds, and the gripper means 105 remains at rest. By this means, the gripper means 105 performs the grip operation with reliability.

Next, the control means 167 continues the forward rotation of the driving motor MH of the driving arm 126, and concurrently therewith, rotates the driving pulley 130*b* of the carrier member 110 counterclockwise (see FIGS. 13(*a*) and 13(*b*)). Upon the rotation, as described in FIGS. 13(*a*) and 13(*b*), movement of the traveling belt 116 loosens the coupling spring 117, and the movable gripper 105*a* is pressed and brought into contact with the fixed gripper 105*b*, and at this point, nips the rear end portion of a bunch of sheets on the processing tray. This state is shown in FIG. 16(*f*).

[Bunch Carrying-out Position Movement]

The control means 167 halts the driving pulley 130*b* of the carrier member 110, and continues the forward rotation of the driving motor MH of the driving arm 126. Upon the rotation, the bunch of sheets nipped by the gripper means 105 are moved from the state of FIG. 16(*f*) to a state of FIG. 16(*g*) along the processing tray 29. In a state where the bunch of sheets are moved to the carrying-out position in the state of FIG. 16(*g*), the control means 167 rotates the driving pulley 130*b* of the carrier member 110 counterclockwise. Upon the rotation, the fixed and movable grippers 105*a*, 105*b* coupled to the traveling belt 116 protrude to above the processing tray from the carrier member 110 in a state of FIG. 17(*h*). By this means, the rear end of the bunch of sheets is carried out above the stack tray 21, and the front end thereof is stored on the uppermost sheet on the tray.

[Nip Release State]

Next, the control means 167 temporarily halts the driving motor MH of the driving arm 126. Upon the halt, the carrier member 110 falls in the loop guide groove 29Ga. The gripper means 105 thereby falls onto the uppermost sheet on the tray in a state of FIG. 17(*i*). Then, the control means 167 rotates the driving motor MH of the driving arm 126 backward. Upon the rotation, the carrier member 110 returns to the first standby position side along the lower traveling path 113*b* of the loop guide groove 29Ga. At this point, the bunch of sheets nipped by the gripper means 105 are stopped by the tray sidewall, and released from the nip (state of FIG. 17(*j*)).

[Return State]

Further, the control means 167 continues the rotation of the driving motor MH of the driving arm 126 to return the carrier member 110 to the first standby position Gp1 from the bunch carrying-out position Gp4. Then, the gripper member 105*a* returns to the state of sinking in the guide groove 29G of the processing tray 29 in a state of FIG. 17(*k*).

[Safety Mechanism of the Tray Sheet Discharge Outlet]

In the processing tray 29, a safety mechanism 135 as described below is disposed at an exit end (hereinafter, referred to as a "tray sheet discharge outlet") 29*x* for carrying out a bunch of sheets to the stack tray 21. The safety mechanism 135 is formed of a "foreign body detecting means 137" disposed in the tray sheet discharge outlet 29*x* and "control means" for prohibiting the operation of the post-processing means (stapling means) 31 based on the detection information from the foreign body detecting means 137.

The foreign body detecting means 137 is formed of a shield member 133 for opening and closing the tray sheet discharge outlet 29*x*, and a position detection sensor St for detecting a position of the shield member 133. The shield member 133 is disposed at the exit end (tray sheet discharge outlet) 29*x* to open and close a sheet discharge opening formed above the sheet support surface 29*a*. The shield member 133 shown in the figure is formed of a shutter plate coming into contact with the uppermost sheet on the tray support surface, and always comes into contact with the upper surface of the uppermost sheet under its own weight to shield the opening. The reason why the shield member 133 is provided at the exist end (tray sheet discharge outlet) 29*x* is to prevent a foreign body such as, for example, an office article from entering the post-processing section and prevent an operator from putting the finger accidentally.

The shield member 133 is attached to the apparatus frame (exterior casing 20 in the apparatus shown in the figure) to be able to move up and down not to prevent a sheet from being loaded on the processing tray 29, or prevent a bunch of sheets, which are subjected to post-processing and to be carried out to the stack tray 21, from being carried out. Then, when a paper jam occurs in the sheet to be gathered on the processing tray 29, or an operation fault such as clogging of staples or the like occurs in the post-processing means (stapling means) 31, the shield member 133 is opened upward to handle the jam.

The shield member 133 configured to move up and down to open and close the sheet discharge opening of the exterior casing 20 as described above is provided with a position sensor St for detecting an open/close state. Therefore, the shield member 133 is provided with a detected section (sensor flag) 134, and a sensor means 138 (micro-switch in the member as shown in the figure) provided with a sensor actuator Se for detecting the detected section 134 is disposed on the apparatus frame side. A detection signal of the sensor means 138 is transferred to a control means 168 described later to prohibit the operation of the post-processing means (stapling means) 31.

Therefore, the height position of the shield member 133 varies corresponding to the sheet load amount on the processing tray 29, and is a low position when the sheet load amount is small, while being a high position when the load amount is large. At this point, when it is configured that the sensor means 138 detects a constant height position of the shield member 133 to permit or prohibit the operation of the post-processing means 31, the following problem occurs. When the maximum permissible thickness loaded on the processing tray is set at a large value, with the value set, it is necessary to set a high position also on the height position of the shield member 133 for the sensor means 138 to detect (when a low position is set, the operation of the post-processing means is prohibited in the normal operation.) Therefore, when an abnormal operation is performed that the shield member 133 is lifted upward in a state where about several sheets are loaded on the processing tray, such a problem occurs that the post-processing means 31 operates without the sensor means 138 detecting the shield member 133.

To solve the aforementioned problem, the apparatus shown in the figure adopts the method of (i) adjusting the height of a detection position of the sensor means 138 corresponding to a thickness of a bunch of sheets to load, or (ii) detecting a plurality of height positions by the sensor means 138, and determining whether or not to prohibit the post-processing operation corresponding to a thickness of a bunch of sheets to load. Each configuration will be described below.

Figure 18:
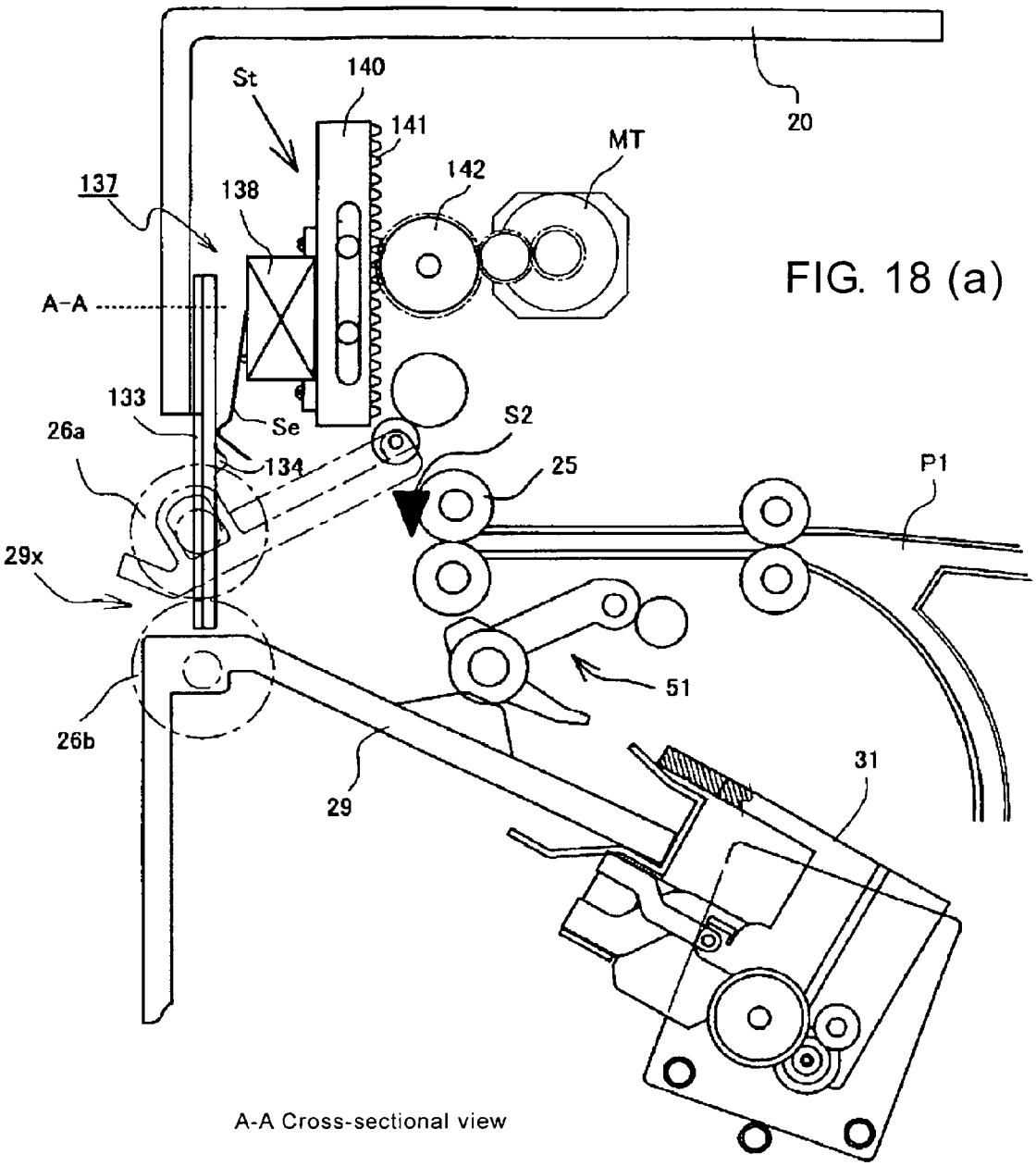
FIG. 18(*a*) is an explanatory view showing a safety mechanism of a bunch means carrying-out outlet in the processing tray, FIG. 18(*b*) shows a cross-sectional view taken along line A-A.
Figure 18:
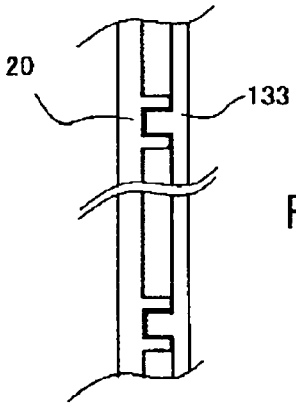

(i) An embodiment of adjusting the height of a detection position of the sensor means 138 corresponding to a thickness of a bunch of sheets. As shown in FIG. 18, the micro-switch forming the sensor means 138 is supported by a guide rail (not shown) and the like to be able to move up and down along the sheet load direction in the apparatus frame 20. Then, a sensor bracket 140 installed with the micro-switch is provided with a rack gear 141, and the rack gear 141 is meshed with a pinion 142 coupled to a stepping motor MT. Accordingly, by rotating the stepping motor MT, the sensor means 138 is able to move up and down in the sheet load direction, and the actuator Se of the sensor means 138 varies the height portion for detecting the detected section 134 disposed in the shield member 133.

Figure 19:
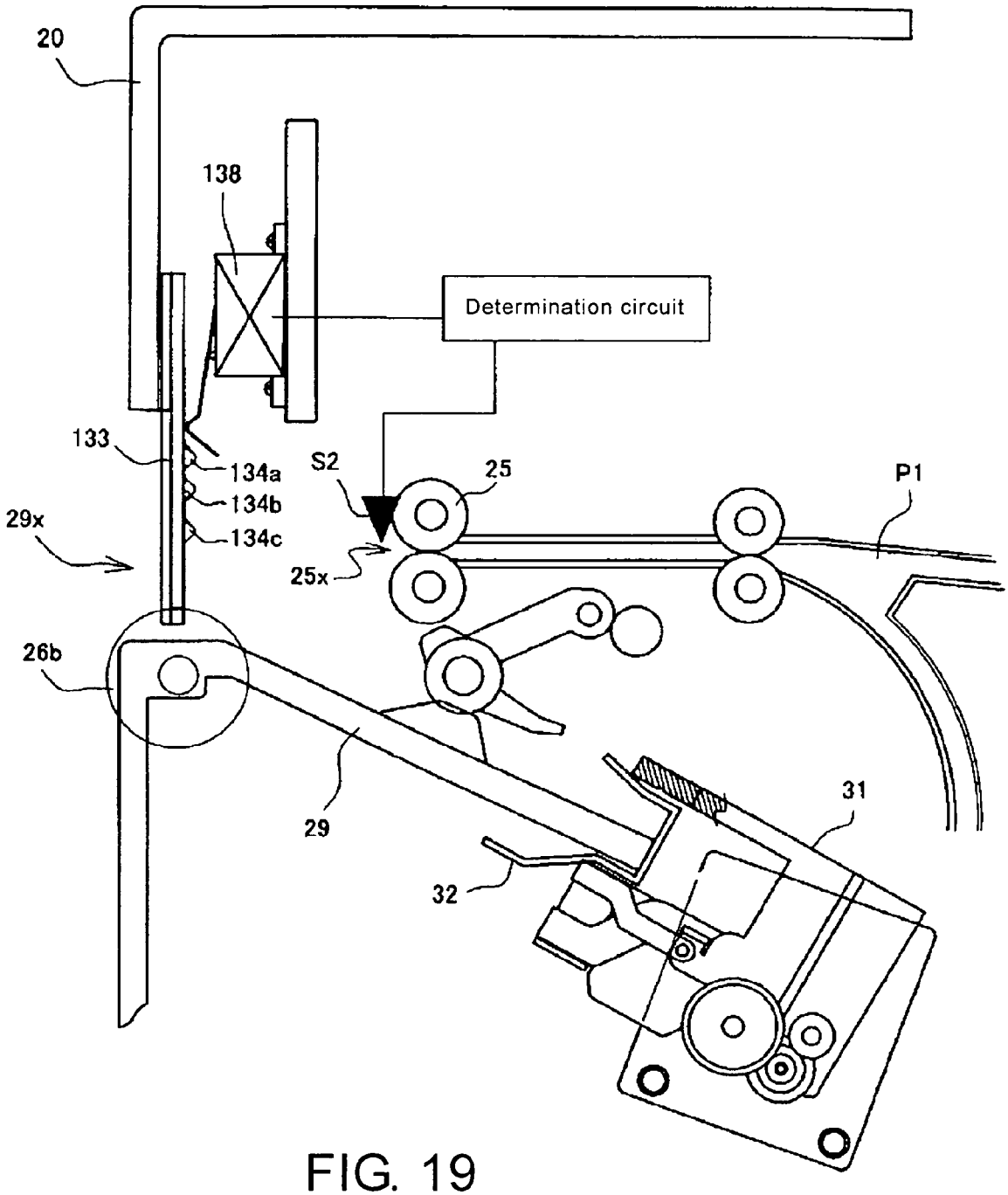
FIG. 19 is an explanatory view showing another safety mechanism of a bunch means carrying-out outlet in the processing tray different from the form in FIG. 18.

(ii) An embodiment of detecting a plurality of height positions by the sensor means 138. As shown in FIG. 19, in the shield member 133 configured to be able to move up and down in the sheet load direction as described previously, as a plurality of detected sections 134 with different height positions, a first flag 134*a*, second flag 134*b* and third flag 134*c* are arranged in this order. Then, the control means 168 described later determines whether or not to prohibit the post-processing operation based on a signal from the sensor means 138 for detecting the plurality of detected sections, 134*a* to 134*c*.

[Control Means]

The control means 168 is formed of the control CPU 161 described later. In above-mentioned embodiment (i) the control means 168 acquires the number of sheets gathered on the processing tray 29 from the image formation apparatus A, for example, using the image data. Then, the means 168 calculates a thickness of a bunch of sheets to be gathered on the processing tray 29 from a beforehand set standard paper thickness, and corresponding to the thickness of a bunch of sheets, sets a height position of the sensor means (micro-switch) 138. For the height position of the micro-switch, a power supply pulse is supplied to the stepping motor MT corresponding to the set height position. Then, the actuator Se of the sensor means 138 detects the detected section (flag) 134 of the shield member 133 in the height position corresponding to the thickness of a bunch of sheets collected for each set on the processing tray 29.

By thus configuring, when the shield member 133 is lifted to a position higher than the thickness of a bunch of sheets collected on the processing tray 29, the sensor means 138 detects the detected section 134. In addition, in this case, the height position of the sensor means 138 is set at a position slightly higher than the thickness of a bunch of sheets collected for each set. Then, the control means 168 is configured to prohibit the processing operation of the post-processing means 31 when the sensor means 138 detects the detected section 134 of the shield member 133.

In above-mentioned embodiment (ii), the control means 168 compares the bunch thickness of a bunch of sheets loaded on the processing tray with beforehand set height positions of flags 134*a* to 134*c* when the sensor means 138 detects the first flag 134*a*. Then, the means 168 is configured to determine "abnormal" when the height position of the flag is high and prohibit the processing operation of the post-processing means 31. Therefore, the control means 168 is provided with a number-of-sheet counter for detecting the number of sheets carried out to the processing tray 29, and calculating means (not shown) for calculating the thickness of a bunch of sheets from the count number. Then, when the sensor means 138 detects the first flag 134*a*, the control means 168 compares the beforehand set height position of the first flag with the bunch thickness of a bunch of sheets loaded on the processing tray to make a determination. Next, when the sensor means 138 detects the second flag 134*b*, the control means 168 compares the beforehand set height position of the second flag with the bunch thickness of a bunch of sheets loaded on the processing tray to determine "whether or not the height is abnormal". Similarly, for the third flag 134*c*, the control means 168 determines "whether or not the height is abnormal".

In addition, the "abnormal determination" in this case is configured that the thickness of a bunch of sheets loaded on the processing tray is compared with a beforehand set detection position (height position) of the flag, and that a state where the shied member 133 is lifted above the uppermost sheet of the processing tray 29 is determined to be "abnormal". The detection results of the first, second and third flags 134*a*, 134*b*, 134*c* are stored in a storage means, and it is identified that a signal from the sensor means 138 is a signal of the first flag, a signal of the second flag, or a signal of the third flag.

By thus configuring, when the sensor means 138 issues a first detection signal from the initial state, the means 168 compares the bunch thickness of a bunch of sheets loaded on the processing tray with the height position of the first flag 134*a*. Sequentially, in the second diction signal, the bunch thickness of a bunch of sheets is compared with the height position of the second flag 134*b* to make a determination. By this means, it is possible to detect an open/close state of the shield member 133 in stages to determine "abnormal" corresponding to the thickness of a bunch of sheets collected on the processing tray 29.

[Configuration of the End Binding Stapling Unit]

Figure 28:
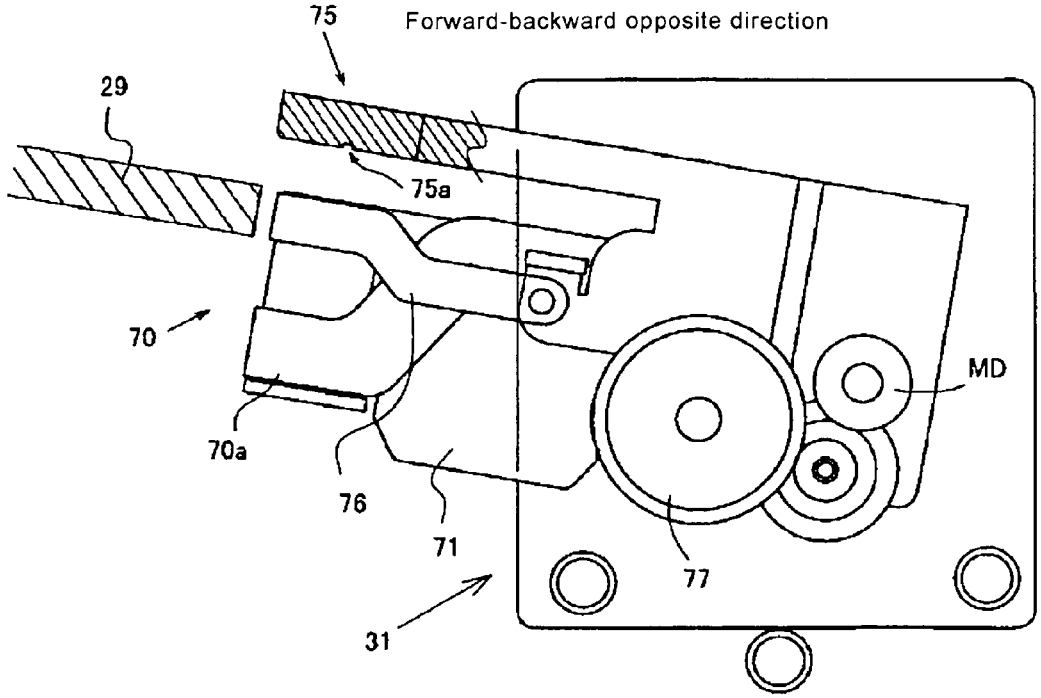
Figure 28:
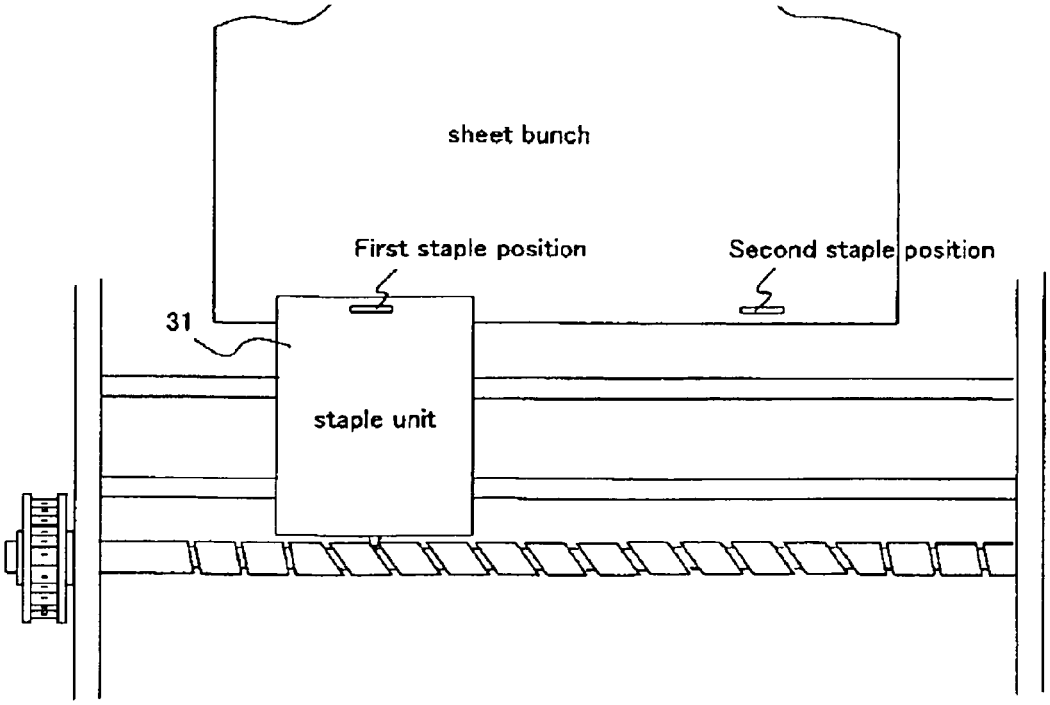

The post-processing means (stapling means) 31 is formed of a driver 70 and clincher 75 as shown in FIG. 28(*a*). The driver 70 is formed of a head member 70*a* that inserts a staple needle into a bunch of sheets set in the binding position, cartridge 71 for storing staple needles, drive cam 77, and staple motor MD for driving the drive cam 77. The clincher 75 is formed of a bending groove 75*a* to bend front ends of the staple needle inserted into a bunch of sheets. Then, in the end binding stapling unit (post-processing means) 31, the driver 70 and clincher 75 are integrally attached to a unit frame. The head member 70*a* of the driver 70 reciprocates vertically as viewed in FIG. 28(*a*) by the drive cam 77, and incorporates a former 73 and bending block 74 thereinto. In addition, configurations of the former 73 and bending block 74 are the same as those in the saddle-stitching stapling unit 40 described later, and will be described later according to FIG. 29.

[Configuration of the Punch Unit]

In the first carry-in path P1, the punch unit 60 is situated between the carry-in roller 23 and sheet discharge roller 25, and punches a file hole in a sheet passed through the first carry-in path P1. A configuration of the punch unit 60 is described according to FIG. 20. The punch unit 60 is formed of punch members 62, blade receiving member (die) 63, driving cams 64 and driving motor MX. A plurality of the punch members 62 is arranged a distance apart from one another in the sheet width direction in a unit frame 61, and axially supported to be able to move up and down in the punching direction. Then, each of the punch members 62 is meshed with the driving cam 64 (slide groove cam, eccentric cam or the like), moved up and down by the driving cam 64 coupled to the driving motor MX, and thereby punches a file hole. Further, the blade receiving member 63 is disposed opposite to the punch members 62 with a sheet passed through the first carry-in path P1 therebetween.

The unit frame 61 is supported by the apparatus frame (not shown) to be able to move to positions in the sheet width direction. This is because the side end edge of a sheet fed to the first carry-in path P1 is aligned with respect to the punch positions. In other words, a sheet sent to the first carry-in path P1 is fed with a dimension error of the sheet, displacement (to the right or left) in the width direction or being skewed to the right or left (right skew or left skew). At this point, when punch holes are formed irrespective of the side end edge position of the sheet, the sheet end edges are not aligned when the sheets are filed. Therefore, a positioning mechanism as described below is required.

[Positioning Mechanism]

The positioning mechanism for aligning relative positions of the punch unit (post-processing means) 60 and the sheet end edge is formed of a sheet end detecting means 67 and positioning means 68. The sheet end detecting means 67 is formed of a sensor means 66 for detecting a side edge of a sheet sent to the processing position, and the positioning means 68 is configured to travel to positions in the relative position between the sheet and post-processing means 60 based on the detection information.

[Sheet End Detecting Means]

Figure 20:
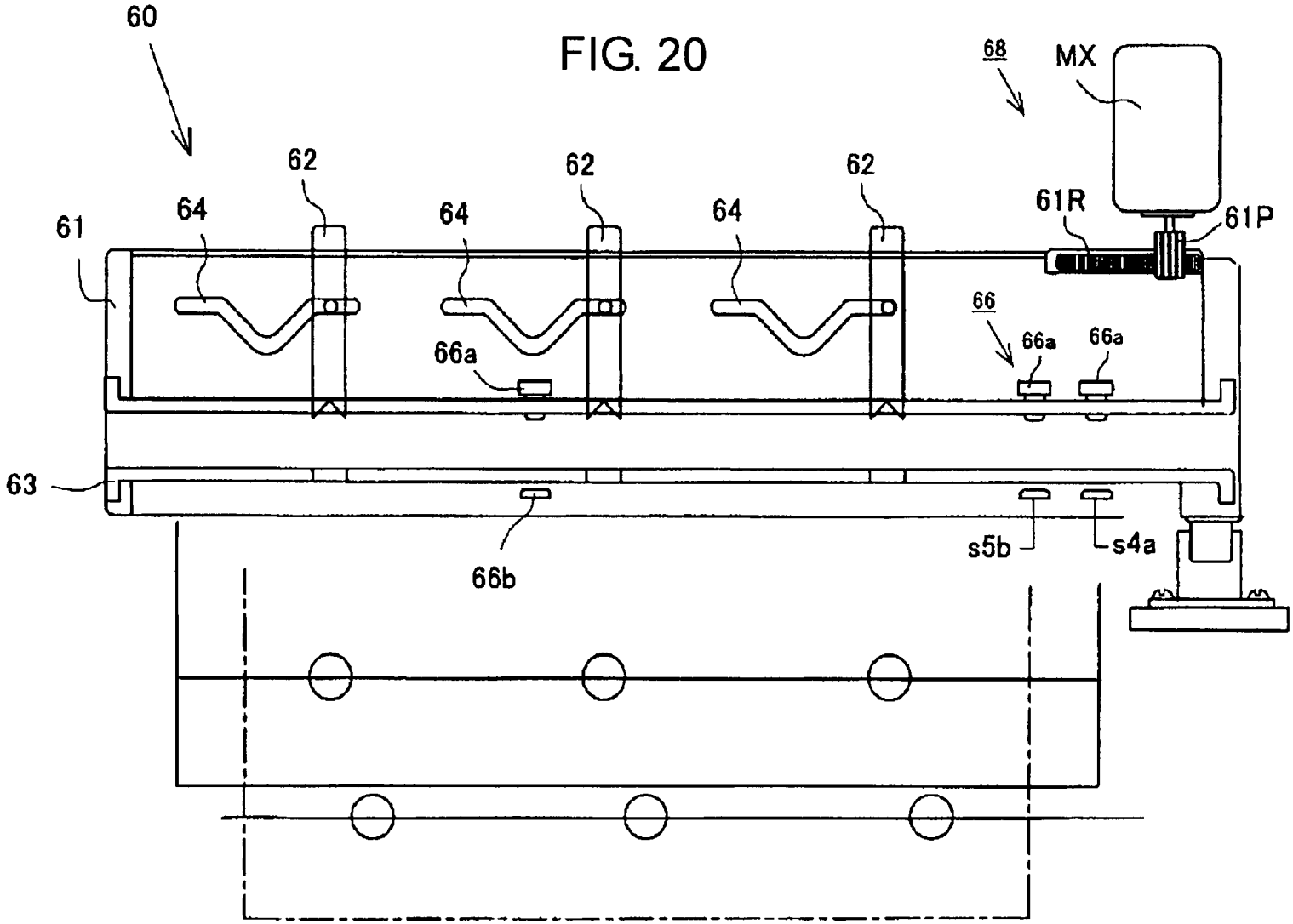
FIG. 20 is an explanatory view of a positioning mechanism of a punch unit in the apparatus of FIG. 3.

As shown in FIG. 20, the sheet end detecting means 67 is formed of the sensor means 66 for detecting one of the left or right side end edge of the sheet sent to the processing position, and a shift means 69 for shifting the sensor means 66 to positions in the sheet width direction from a beforehand set initial position. The sensor means 66 is formed of a pair of a light-emitting element 66*a* and light-receiving element 66*b* arranged opposite to each other, and disposed in a position for detecting the side edge corresponding to the sheet size. In the apparatus as shown in the figure, from the relation that the sheet sizes are JIS A4-size and JIS B5-size, an A4 detection sensor S4*a* and B5 detection sensor S5*b* are disposed in positions for detecting respective sheet side edges. Then, the sensor means 66 is situated in the unit frame 61 for supporting the punch member 62.

[Positioning Means]

The unit frame 61 installed with the punch member 62 and sensor means 66 as described above is supported by a guide rail (not shown) to be able to travel to positions in the sheet width direction. Then, the unit frame 61 is provided with a rack gear 61R, and the driving motor MX is coupled to a pinion 61P meshed with the rack gear 61R. By this means, the unit frame 61 is able to travel to positions leftward and rightward in the sheet width direction according to forward and backward rotation of the stepping motor (driving motor) MX.

[Sensor Position Control Means]

Figure 21:
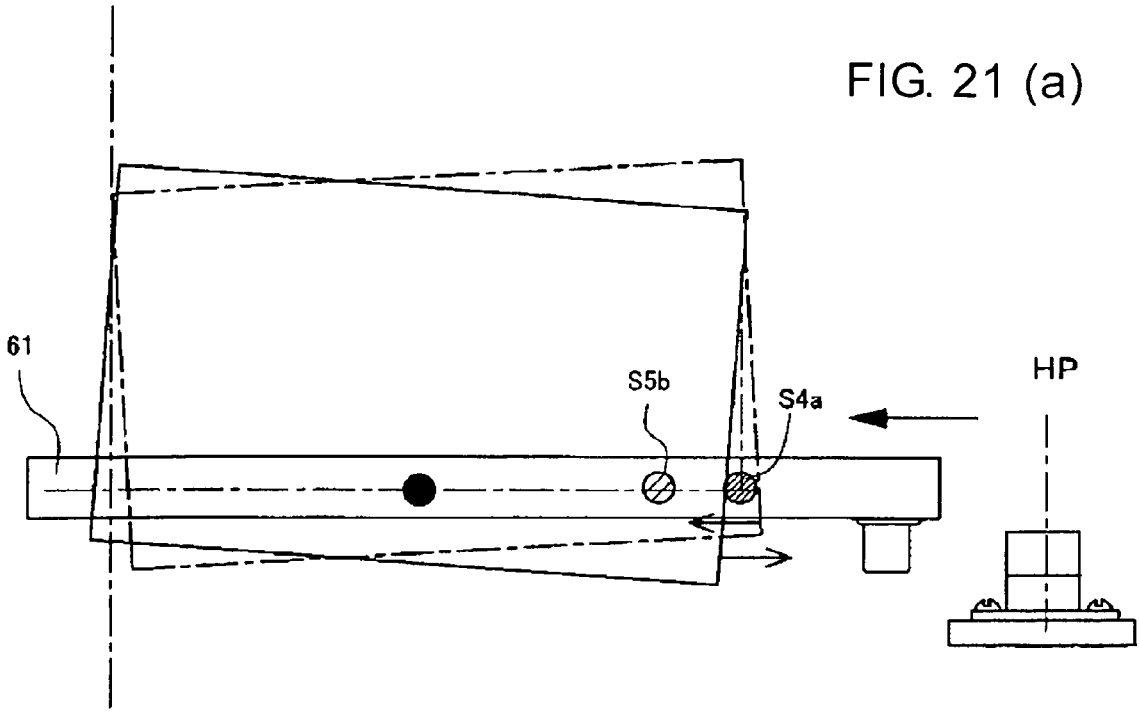
FIG. 21 is an explanatory view of a positioning sate in the positioning mechanism of the punch unit of FIG. 20.
Figure 21:
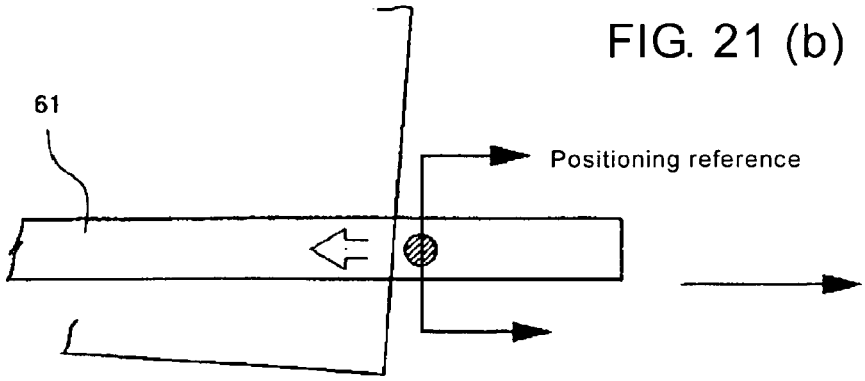
Figure 21:
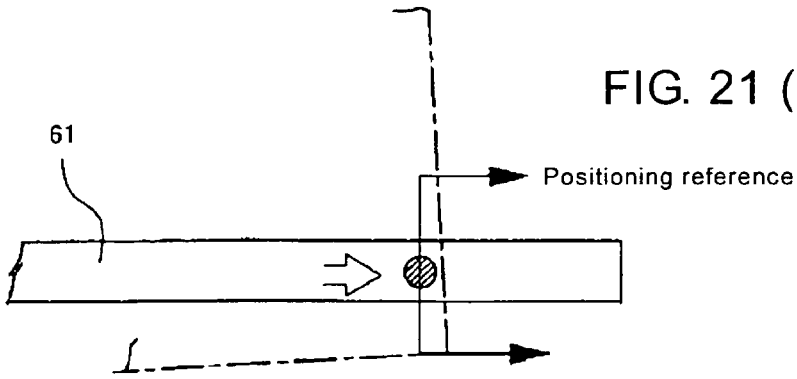

A sensor position control means 169 is formed of the control CPU 161 as described later. The sensor position control means 169 is electrically connected to a driving circuit of the stepping motor MX to move the unit frame 61 to positions leftward and rightward in the sheet width direction from a beforehand set home position. Therefore, for a sheet carried to the processing position, when the sensor means 66 is in the initial position (home position), the sensor position control means 169 is configured to (i) move the sensor means 66 to outward positions (left and right directions in FIG. 21(*c*)) in the sheet width direction to detect the sheet end edge when the sheet is detected, or (ii) move the sensor means 66 to inward positions (left and right directions in FIG. 21(*b*)) to detect the sheet end edge when the sheet is not detected.

For this position detection of the sheet end edge, when the sensor means 66 changes "from OFF to ON" or "from ON to OFF", the position is determined to be the sheet end edge, and the unit frame 61 is halted. Then, the positional relationship between the sensor means 66 and punch member 62 is set so that the post-processing means (punch member) 62 installed in the unit frame 61 punches punch holes in the set positions spaced from the end edge of the sheet.

[Configuration of the Second Processing Section]

As described previously, the second processing section BS2 is formed of the collection guide 45 disposed in the second carry-in path P2, and a saddle-stitching stapling unit 40 and folding processing mechanism 44 disposed in the collection guide 45. In the following, the collection guide 45, saddle-stitching stapling unit 40 and folding processing mechanism 44 will be described in this order.

[Collection Guide]

The collection guide 45 is situated on the downstream side of the second carry-in path P2 continuously, and is configured to sequentially load and store in the upright position sheets from the carry-in entrance 23*a* upwardly. Particularly, the collection guide 45 shown in the figure is disposed in the substantially vertical direction to traverse the casing 20 longitudinally, and configured to collect sheets in the upright position, and the apparatus is thereby configured to be small and compact. Further, the collection guide 45 shown in the figure is formed of a guide plate curved in the center, and is formed in the shape with the length for accommodating the maximum-size sheet therein. The collection guide 45 is configured in the shape curved or bent to protrude to the side in which are arranged the saddle-stitching stapling unit 40 and folding processing mechanism 44 described later. Then, the collection guide 45 is provided with a front end stopper 43 for regulating the sheet front end, and the front end stopper 43 travels to positions corresponding to the sheet size (length in the sheet discharge direction).

[Saddle-stitching Stapling Unit]

Figure 29:
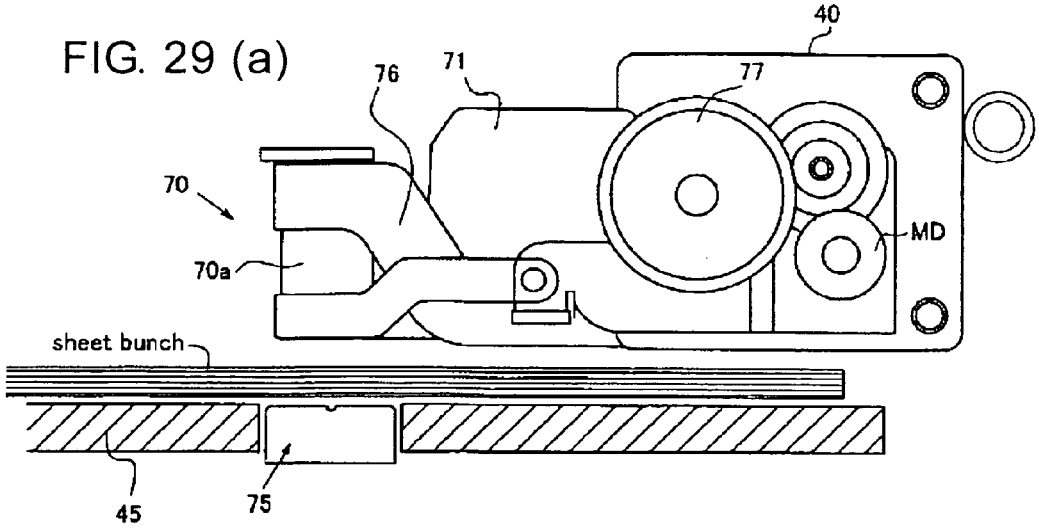
FIG. 29 contains explanatory views of a saddle-stitching stapling means in the apparatus of FIG. 2, where FIG. 29(*a*) is an explanatory view of the entire configuration, and FIG. 29(*b*) is an explanatory view of an anvil portion.
Figure 29:
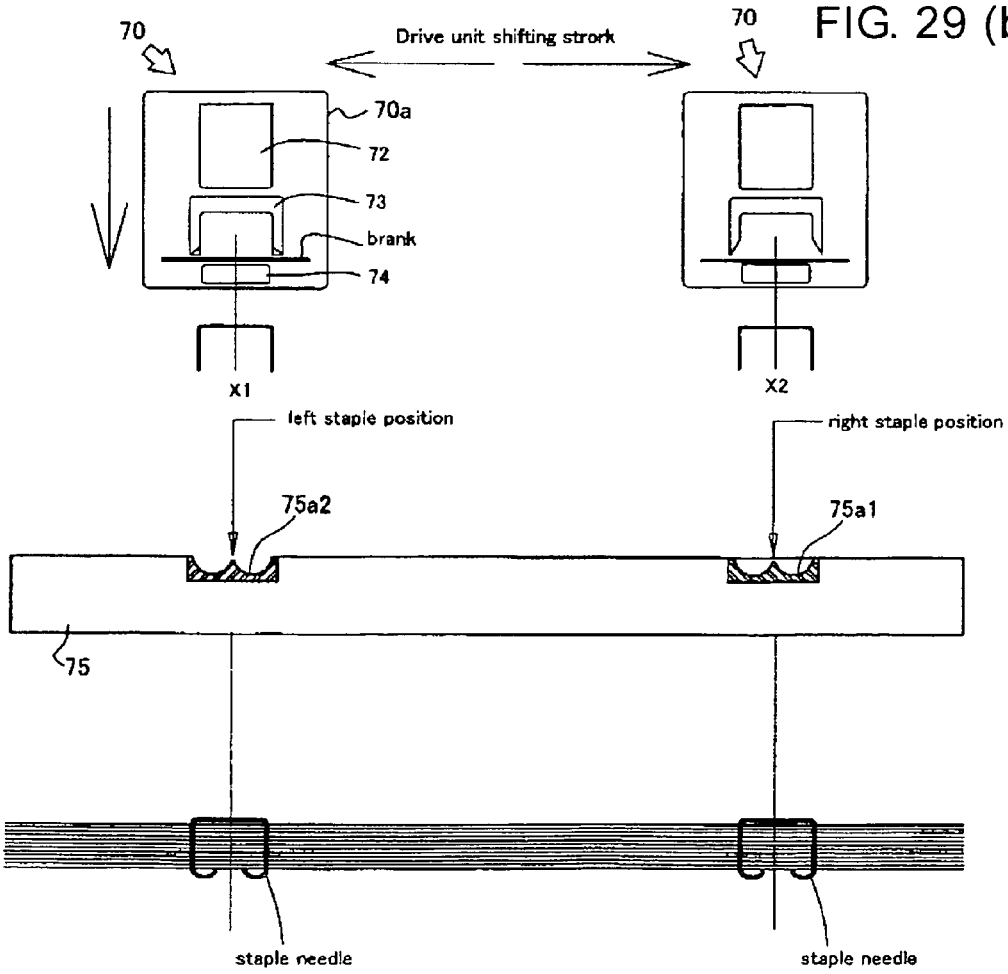

In the collection guide 45 is disposed the saddle-stitching stapling unit (hereinafter referred to as a "saddle-stitching unit") 40 to staple-binding the center portion of a bunch of sheets collected for each set in the collection guide 45. The configuration will be described based on FIGS. 29(*a*) and 29(*b*). The saddle-stitching stapling unit 40 is formed of a driver 70 and clincher 75. The driver 70 is formed of a head member 70*a* that inserts a staple needle into a bunch of sheets set in the binding position, cartridge 71 for storing staple needles, drive cam 77, and staple motor MD for driving the drive cam 77. As shown in FIG. 29(*b*), in the driver 70, into the head member 70*a* of the frame are incorporated a driver member 72, former 73 and bending block 74 in this order in the vertical direction. Then, the driver member 72 and former 73 are supported by the head member 70*a* to be slidable upward and downward so as to reciprocate vertically between the top dead center and the bottom dead center, and the bending block 74 is fixed to the head member 70*a* as a forming mold to bend a linear staple needle in the shape of a U.

Further, the frame is installed therein with the cartridge 71 having staple needles therein to sequentially supply a staple needle to the bending block 74. The driver member 72 and former 73 are coupled to a drive lever 76 pivotably attached to the frame, and are driven vertically between the top dead center and the bottom dead center. The frame is provided with a force-storing spring (not shown) for driving the drive lever 76 up and down, and the force-storing spring is provided with the drive cam 77 for storing force in the force-storing spring and staple motor MD for driving the drive cam 77.

The clincher 75 is situated in a position opposite to the driver 70 with a bunch of sheets therebetween. The clincher 75 as shown in the figure is formed of a structure separated from the driver 70, and bends needle tips of the staple needle inserted into a bunch of sheets by the driver 70. Therefore, the clincher 75 is provided with a folding groove (anvil) 75*a* for bending the front ends of the staple needle. Particularly, the clincher 75 shown in the figure is provided with a plurality of bending grooves 75*a*1, 75*a*2 in two or more portions in the width direction of a bunch of sheets collected in the collection guide 45, and it is a feature that the driver 70 traveling to these positions staple-binds a plurality of positions in the sheet width direction. By thus configuring, it is possible to staple-bind a bunch of sheets supported on the collection guide 45 in two portions at the left and right with the clincher 75 fixed without moving the clincher 75.

Alternately, it is possible to adopt a configuration that a wing member (not shown) for bending needle tips of the staple needle is provided as the clincher 75, and is pivotably rotated in conjunction (synchronization) with needle tips inserted into a bunch of sheets by the driver 70. In this case, a pair of bending wings are pivotally supported by the frame of the clincher 75 in positions opposite to opposite ends of the needle in the shape of a U. Then, a pair of bending wings are made pivot in conjunction with the operation that the driver 70 inserts a staple needle into a bunch of sheets. By the pivot movement of the pair of wings, the front ends of the staple needle are bent while being flat along the backside of the bunch of sheets. In other words, when the staple is bent by the bending groove, the front ends of the needle are in the state bent in the shape of a U (glasses clinch), while being in the state linearly bent (flat clinch) when the staple is bent by the wing member. The invention is capable of adopting both of the configurations.

By such a configuration, for the driver member 72 and former 73 incorporated into the head member 70*a*, the drive cam 77 presses the drive lever 76 from the top dead center located upward to the bottom dead center located downward via the force-storing spring by rotation of the staple motor MD. By the downward operation of the drive lever 76, the driver member 72 and former 73 coupled to the drive lever 76 travel from the top dead center to the bottom dead center. The driver member 72 is formed of a plate-shaped member to press the rear portion of the staple needle bent in the shape of a U, and the former 73 is formed of a member in the shape of a U as shown in FIG. 29(*b*) and bends the staple needle in the shape of a U together with the bending block 74. That is, the cartridge 71 supplies a staple needle to the bending block 74. The linear staple needle is pressed and formed in the shape of a U between the former 73 and the bending block 74. Then, the staple needle bent in the shape of a U is inserted into a bunch of sheets by the driver member 72 being pressed down vigorously toward a bunch of sheets.

[Folding Processing Mechanism]

Figure 27:
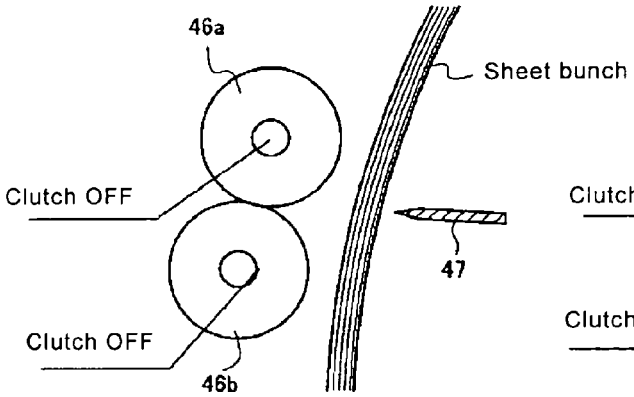
FIG. 27 contains explanatory views of a fold roll mechanism in the apparatus of FIG. 2, where FIG. 27(*a*) shows a state where a bunch of sheets are gathered, FIG. 27(*b*) shows a state where the bunch of sheets are inserted between fold rolls with a fold blade, FIG. 27(*c*) shows an initial state for folding with the fold rolls, and FIG. 27(*d*) shows a state where the bunch of sheets are folded with the fold rolls, FIGS. 28 contains explanatory views of an end binding stapling means in the apparatus of FIG. 2, where FIG. 28(*a*) shows the entire configuration, and FIG. 28(*b*) shows a traveling mechanism in the sheet width direction.
Figure 27:
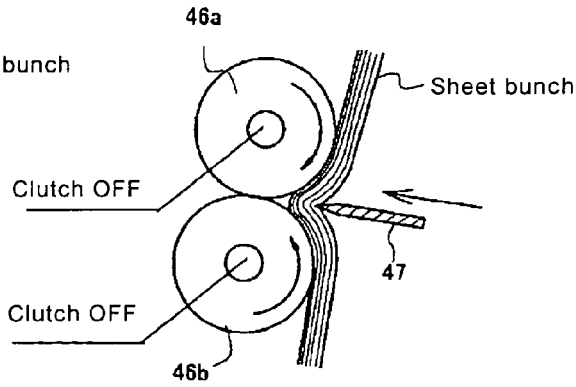
Figure 27:
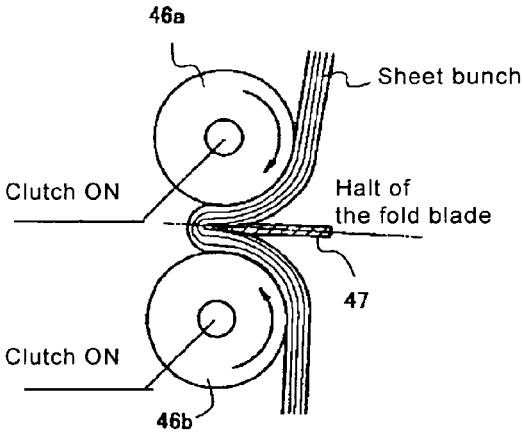
Figure 27:
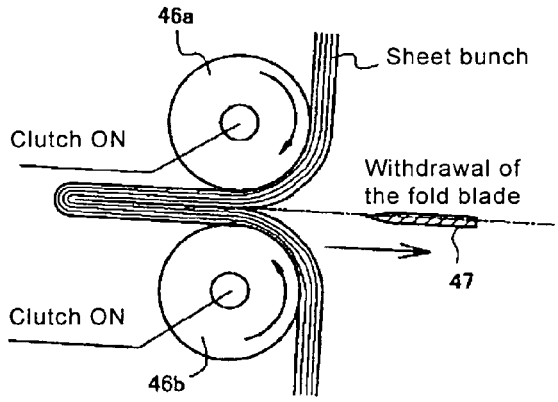

In a folding position situated on the downstream side of the saddle-stitching stapling unit 40 are provided a fold roll means 46 for folding a bunch of sheets, and a fold blade 47 for inserting the bunch of sheets into a nip position of the fold roll means 46. As shown in FIG. 27, the fold roll means 46 is comprised of rolls 46*a*, 46*b* coming into pressure-contact with each other, and each of the rolls is formed substantially in the length of the width of the maximum sheet.

The pair of fold rolls 46*a*, 46*b* are formed of material with a relatively high coefficient of friction such as a rubber roller and the like. This is because of transferring sheets in the rotation direction while folding the sheets by a soft material such as rubber and the like, and the rolls may be formed by performing lining processing on a rubber material. In the fold rolls 46*a*, 46*b* are formed gaps in the sheet-value width direction that are formed in the shape of asperities. These gaps are arranged to accord with asperities of the fold blade 47 described later, and it is considered that the front end of the fold blade is easy to enter the nip between the rolls. In other words, the pair of fold rolls 46*a*, 46*b* coming into pressure-contact with each other are provided with the shape of asperities having gaps in the sheet width direction, and the staple-binding portions of the sheet and a blade edge of the fold blade 47 also formed to have the shape of asperities enter the gaps.

The operation for folding the sheets in the fold roll means 46 will be described below according to FIGS. 27(*a*) to 27(*d*). This pair of fold rolls 46*a*, 46*b* are positioned on the protrusion side where the collection guide 45 is curved or bent, and the fold blade 47 having a knife edge is provided in the position opposite to the means 46 with a bunch of sheets supported by the collection guide 45 located therebetween. The fold blade 47 is supported by the apparatus frame to be able to reciprocate between a standby position of FIG. 27(*a*) and a nip position of FIG. 27(*c*).

Then, a bunch of sheets supported in a bunch form by the collection guide 45 are seized by a front end stopper 43 in a state shown in FIG. 27(*a*), and positioned in a folding position with the fold position staple-bound. After obtaining a set finish signal of the bunch of sheets, a driving control means (sheet-bunch folding operation control section 164*d*, which is the same in the following) makes the clutch means OFF.

Next, the driving control means 164*d* moves the fold blade 47 toward the nip position from the standby position at a predetermined velocity. Then, as in the state shown in FIG. 27(*b*), the bunch of sheets are bent by the fold blade 47 in the fold position and inserted into between the rolls. At this point, the fold rolls 46*a*, 46*b* are rotated according the sheets moving by the fold blade 47. Then, after a lapse of predicted time a bunch of sheets reaches a predetermined nip position, the driving control means 164*d* halts a blade driving motor (not shown), and rests the fold blade 47 in the position shown in FIG. 27(*c*). Almost in tandem therewith, the driving control means 164*d* switches the clutch means to ON, and drives the fold rolls 46*a*, 46*b* to rotate. Upon the rotation, the bunch of sheets are sent in the drawing direction (leftward in FIG. 27(*c*)). Then, the driving control means 164*d* moves the fold blade 47 situated in the nip position to return to the standby position as in the state shown in FIG. 27(*d*), concurrently with drawing of the bunch of sheets by the fold rolls 46*a*, 46*b*.

When thus folded bunch of sheets are first drawn into between a pair of fold rolls 46*a*, 46*b*, a sheet coming into contact with the roll surface is not pulled in between the rolls by the rotating rolls. In other words, since the fold rolls 46*a*, 46*b* are rotated by following (being driven by) inserted (pushed) sheets, it does no happen that only a sheet coming into contact with the roll is first entangled. Further, since the rolls are driven and rotated by following the inserted sheets, the roll surface and sheet contacting the roll do not rub against each other, and image fading does not occur.

[Trimmer Unit]

On the downstream side of the folding processing mechanism 44 is provided a sheet transport path (hereinafter referred to as a "sheet discharge path") 85 for guiding the folded sheets to the saddle tray (second stack tray, which is the same in the following) 22, and the bunch of sheets folded in book form in the folding processing mechanism 44 are carried out to the saddle tray 22. Then, the trimmer unit 90 is disposed in the sheet discharge path 85. This trimmer unit 90 cuts a fore-edge portion of the folded sheets folded in the folding processing mechanism 44 by a predetermined amount to trim. In other words, when a bunch of a plurality of sheets are folded in the center in book form (magazine fold) in the folding processing mechanism 44, folded front edge portions (fore-edge portion) are not aligned, and by cutting the fore-edge portion by a predetermine amount, the sheet end edge is finished neatly.

As a configuration of the trimmer unit 90, various configurations are known, and therefore, not described specifically, but for example, the trimmer unit 90 is formed of a cutting blade (plate-shaped cutting blade or disk-shaped rotating cutting blade) for cutting the end edge of a bunch of sheets, a cutter motor for driving the cutting blade, and trimming edge pressing means for pressing the trimming edge of the bunch of sheets to hold. In the unit as shown in the figure, a unit frame 91 is provided in the sheet discharge path 85, and a cutting blade 92 and pressing member (not shown) are disposed in the unit frame 91 to move up and down. Then, the cutting blade 92 and pressing member are positioned in the sheet width direction, and configured so that the pressing member presses and holds a bunch of sheets when falling from an upper standby position to a lower cutting position, and that the cutting blade 92 cuts the sheets.

Therefore, in the sheet discharge path (sheet transport path) 85 are disposed a "carrying mechanism" for carrying a folded bunch of sheets to a cutting position of the trimmer unit 99 from the folding processing mechanism 44, and a "positioning mechanism" for position the folded sheets in the cutting position.

[Carrying Mechanism]

Figure 22:
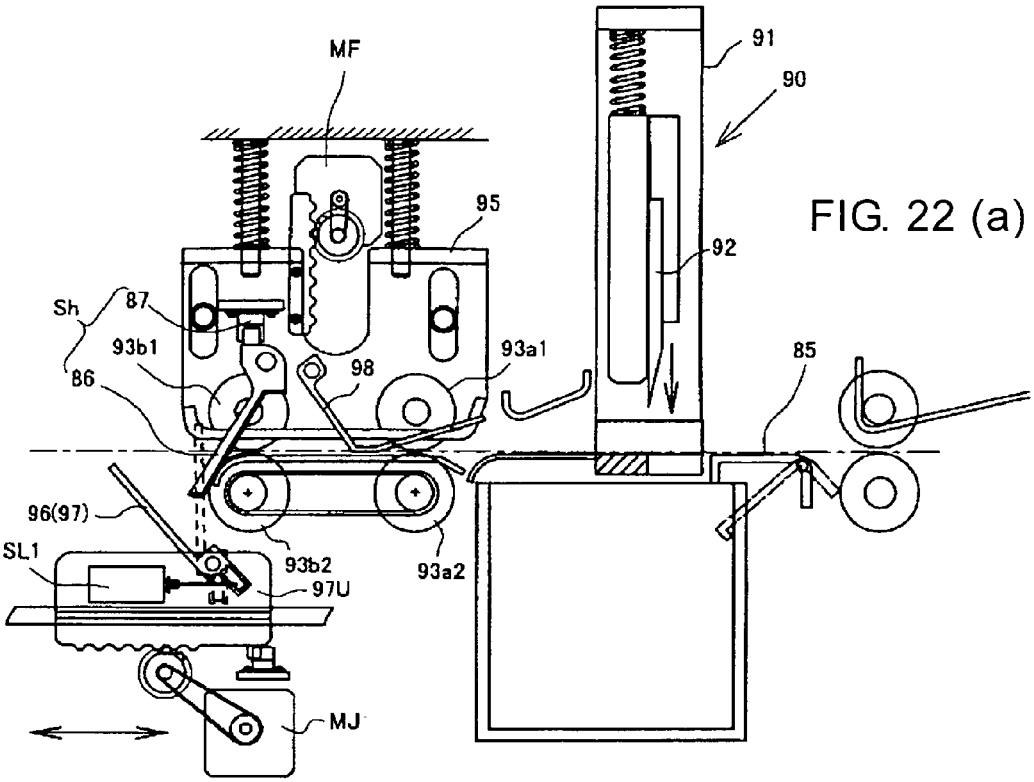
FIG. 22(*a*) is an explanatory view of an entire configuration of a trimmer unit in the apparatus of FIG. 3, FIG. 22(*b*) is an explanatory view of a driving system.
Figure 22:
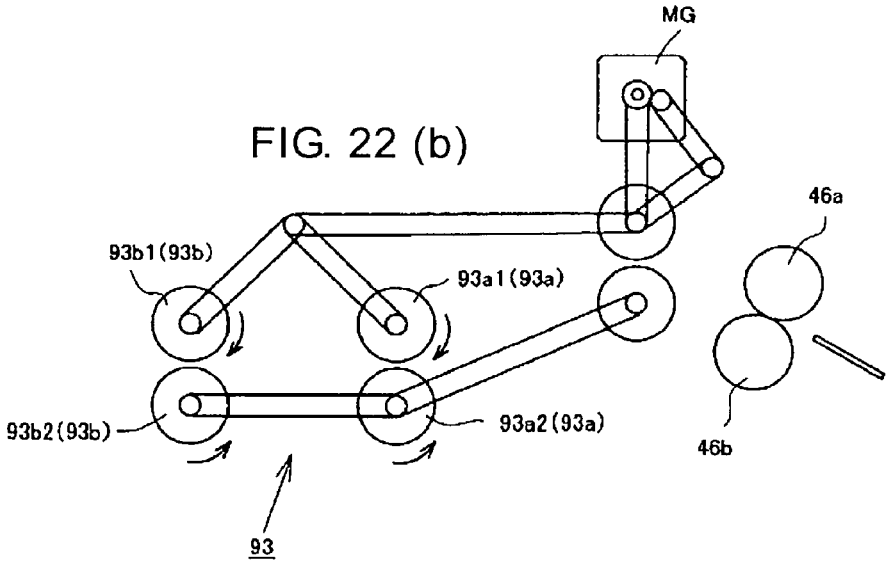
Figure 23:
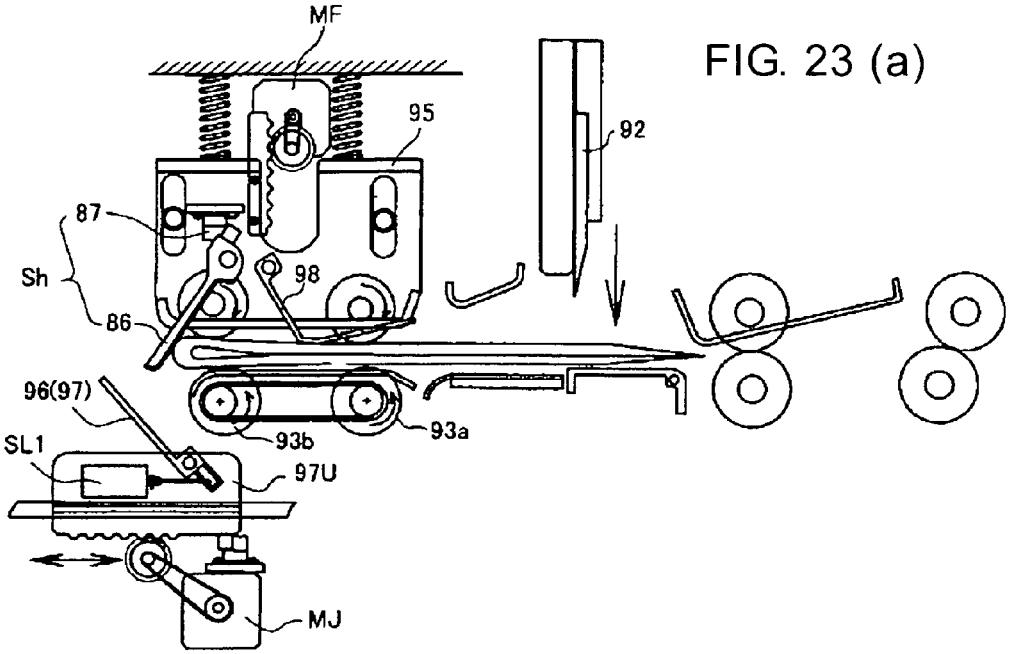
FIG. 23 contains explanatory views of the positioning state in the trimmer unit of FIG. 22, where FIG. 23(*a*) shows a state where a bunch of sheets are carried, and FIG. 23(*b*) shows a state where a pressurizing roller of the bunch of sheets is released.
Figure 23:
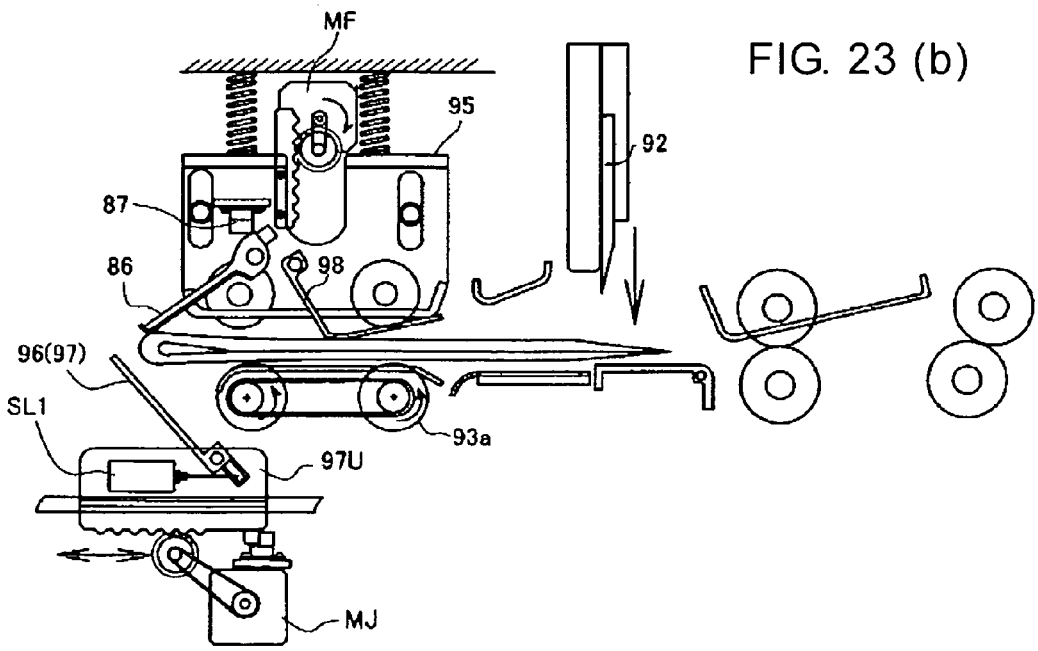
Figure 24:
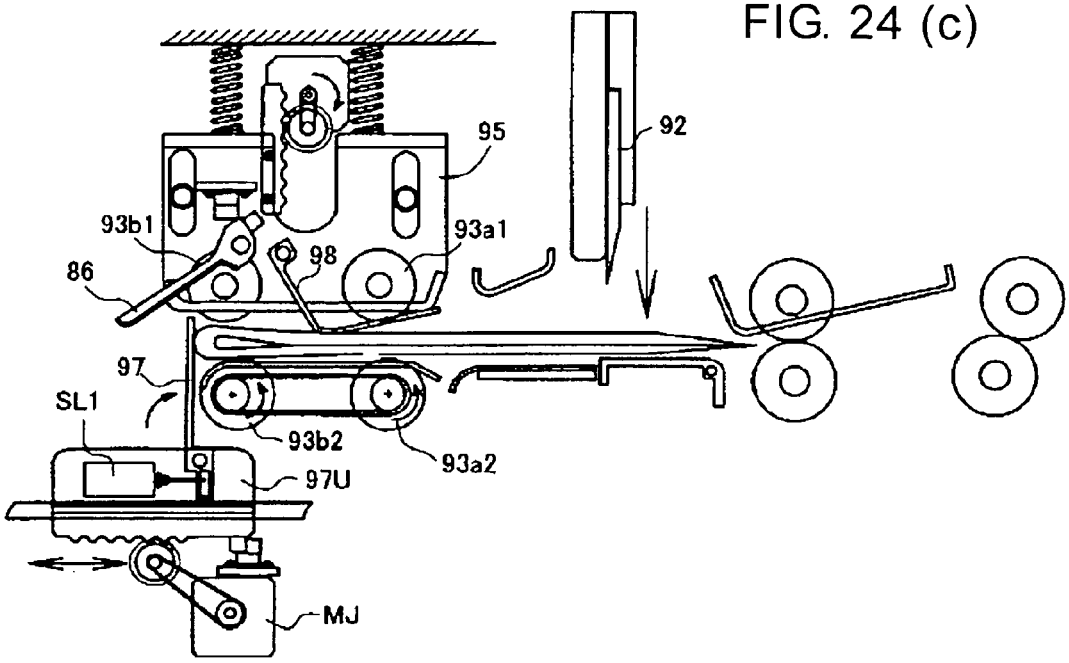
FIG. 24 contains explanatory views of the positioning state in the trimmer unit of FIG. 22, where FIG. 24(*c*) shows a register modification state for positioning a bunch of sheets, and FIG. 24(*d*) shows a state for trimming the bunch of sheets.
Figure 24:
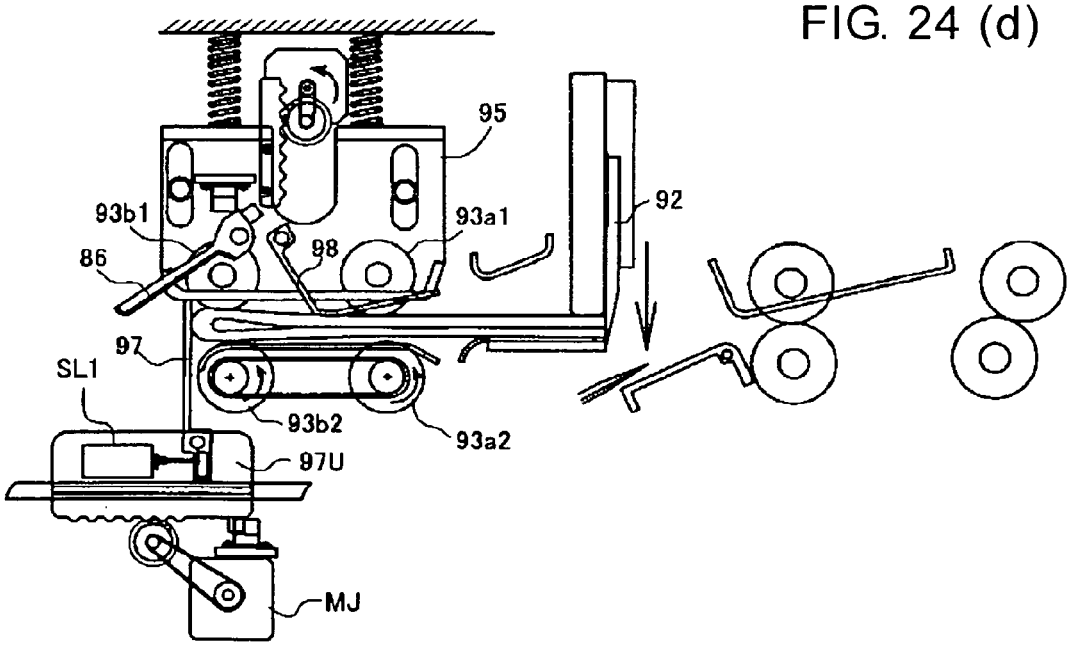

The carrying mechanism is formed of a carrying roller pair 93 for nipping the folded bunch of sheets to carry. The carrying roller pair 93 is formed of a pair of rollers coming into pressure-contact with each other with the sheet discharge path 85 located therebetween. One of the rollers is a fixed roller, the other roller is a movable roller, and the rollers are able to come into pressure-contact with and separate from each other. In the carrying roller pair 93 shown in the figure, provided are a front carrying roller pair 93*a* and rear carrying roller pair 93*b*. The distance between the front and rear carrying roller pairs 93*a*, 93*b* is set shorter than the length in the carrying direction of the folded bunch of sheets. Then, movable rollers 93*a*1, 93*b*1 of both carrying roller pairs are installed in a same support frame 95, and as shown in FIG. 22(*a*), the support frame 95 is supported by a guide rail to move up and down with respect to the apparatus frame (not shown). Accordingly, the carrying roller pairs 93*a*, 93*b* disposed at the front and back along the sheet discharge path 85 are arranged so that the movable rollers 93*a*1, 93*b*1 come into pressure-contact with and separate from the fixed rollers 93*a*2, 93*b*2, respectively. "MF" shown in the figure denotes a shift motor for moving the support frame 95 up and down. In addition, the movable rollers 93*a*1, 93*b*1 are provided with pressuring springs, and come into pressure-contact with the respective fixed rollers by predetermined pressure.

[Driving Mechanism]

Further, the front carrying roller pair 93*a* and rear carrying roller pair 93*b* rotate at the same peripheral velocity by a driving mechanism shown in FIG. 22(*b*). Transmission belts are used to couple so that the rotation of fold rollers 46*a*, 46*b* forming the fold roll means 46 acts on the rear carrying roller pair 93*b* and front carrying roller pair 93*a*. "MG" shown in the figure denotes its driving motor.

[Positioning Mechanism]

The positioning mechanism is formed of a register means 96 for positioning the folded bunch of sheets carried by the carrying roller pair 93 in a predetermined cutting position to set. The register means 96 is configured as described below to position the folded bunch of sheets, while correcting its attitude. The register means 96 is formed of a regulating stopper for striking and regulating a front end edge of the folded bunch of sheets and backing in the carrying direction and opposite direction by a predetermined amount. The regulating stopper shown in the figure is formed of a pivot arm member 97 for pivoting forward and backward in the sheet carrying direction. The pivot arm member 97 is axially supported to pivot between a solid attitude (standby position) withdrawing from the sheet discharge path 85 and a chain-line attitude (operation position) where the folded bunch of sheets are backed along the sheet discharge path 85 as shown in FIG. 22(*a*), and at the base end portion is provided an operation solenoid SL1.

A frame 97U (referred to as a stopper frame) 97U installed with the pivot arm member 97 and operation solenoid SL1 is attached to the apparatus frame to be able to move to positions forward and backward in the carrying direction, and is provided with a stopper shift motor MJ for shifting the stopper frame 97U to positions. Accordingly, the pivot arm member 97 is moved to positions forward and backward in the carrying direction by controlling rotation of the stopper shift motor MJ corresponding to the length size of the folded bunch of sheets.

[Biasing Guide Member]

When the folded bunch of sheets are backed by the pivot arm member 97, the carrying roller pair 93 releases the nip of the folded bunch of sheets, and the movable rollers 93*a*1, 93*b*1 are controlled to separate from the folded bunch of sheets (see "Stopper position control means" as described later). At this point, the folded bunch of sheets in the sheet discharge path are in a free state, and may be displaced by impact of the pivot arm member 97. Therefore, in the sheet discharge path 85 is disposed a biasing guide member 98 for adding a displacement force in the forward direction to the sheets when the sheets are backed by a predetermined amount by the pivot arm member (regulating stopper) 97. The biasing guide member 98 is formed of a plate member, shoe member or the like coming into contact with the folded bunch of sheets, and exerts brake action on the folded bunch of sheets backing. The biasing guide member 98 as shown in the figure is formed of a guide piece pivotably supported by the support frame 95 to press the top sheet of the folded bunch of sheets under its own weight.

[Front End Detection Sensor]

In the sheet discharge path 85 is disposed a front end detection sensor Sh for detecting that the folded bunch of sheets arrive at the predetermined cutting position. The front end detection sensor Sh is formed of a sensor flag 86 for engaging with the sheet front end moving in the carrying direction in the sheet discharge path 85, and a sensor element 87 for detecting a position of the sensor flag 86.

[Stopper Position Control Means]

A control means 170 formed of the control CPU 161 as described later moves the pivot arm member 97 to positions corresponding to the length size information (for example, information transferred from the image formation means) of the folded bunch of sheets sent from the folding processing mechanism 44. In other words, for example, the means 170 moves the member 97 to an "A4 position" shown in the figure when the folded bunch of sheets are of JIS A4-size, while moving the member 97 to a "B4 position" shown in the figure when the sheets are of JIS B5-size with the stopper shift motor. At this point, the pivot arm member 97 is held at the standby attitude, and at the same time, the carrying roller pair 93 is held at a pressure-contact state (home position)

Then, the control means 170 detects that the folded bunch of sheets arrive at the cutting position by the front end detection sensor Sh, halts rotation of the carrying roller pair 93 with the detection signal, and concurrently, starts the shift motor MF to release the nip of the folded bunch of sheets. At this point, the biasing guide member 98 maintains the state for pressing the folded bunch of sheets under its own weight.

Next, the control means 170 starts the operation solenoid SL1 after a lapse of predetermined time since the front end detection signal of the front end detection sensor Sh. By this means, the pivot arm member 97 rotates clockwise from the standby position shown by the solid line in FIG. 22(*a*) and shifts to the operation position in the chain-line state. With the pivot arm member 97 shifted, the folded bunch of sheets are backed. At this point, the folded bunch of sheets undergo the brake action of the biasing guide member 98, and the front end edge undergoes skew correction following the pivot arm member 97. In other words, even when the folded bunch of sheets are sent to the cutting position while tilting, the attitude is corrected in positioning in the cutting position.

Further, in the apparatus as shown in the figure, the carrying roller pair 93 and biasing guide member 98 are arranged in the positional relationship as described below. The folding processing mechanism 44 for folding a plurality of sheets is disposed on the upstream side of the register means in the sheet discharge path 85. Then, the folding processing mechanism 44 is formed to transfer the folded end forward in the carrying direction. Further, in the sheet discharge path 85 is disposed the cutting means (cutting blade) 92 for trimming the rear end edge of the folded bunch of sheets. Then, on the downstream side of the cutting means 92 are disposed the biasing guide member 98, carrying roller pair 93 and regulating stopper 97 in this order. Then, the carrying roller pair 93 is situated in the position for pressing the folded front end portion of folded sheets, and the biasing guide member 98 is situated in the position for pressing the center portion of the folded sheets. This is because of pressing the rear folded portion by the roller pair in trimming the folded bunch of sheets, and concurrently, preventing the sheet center portion from rising by the pressuring guide (the biasing guide member 98).

The carrying roller pair 93 is configured to be able reciprocate between the nip releasing position separate from the sheets and the nip position for nipping the sheets. The control means (1) moves the carrying roller pair to the nip releasing position, then (2) backs the stopper member to back the sheets by a predetermined amount, and at this point, (3) pushes the sheets in the forward direction by the biasing guide to bias the sheet front end toward the stopper member.

[Storage Section]

On the side wall of the casing 20 are disposed the stack tray 21 and saddle tray 22 in the vertical direction as shown in FIG. 2, and the stack tray 21 is situated on the downstream side of the processing tray 29 to store a bunch of sheets undergoing binding processing from the first processing section BX1. The saddle tray 22 is provided with the sheet discharge outlet 22*x*, and situated on the downstream side of the collection guide 45 to store a bunch of sheets processed in book form from the second processing section BX2. Then, the stack tray 21 is adjacent to the exit end (tray sheet discharge outlet) 29*x* of the processing tray 19 to be coupled, and the saddle tray 22 is disposed on the downstream side of the collection guide 45 via the folding processing mechanism 44 and trimmer unit 90.

[Lifting/Lowering Mechanism of the Stack Tray]

A configuration of the stack tray 21 will be described below according to FIG. 25. The stack tray (hereinafter, referred to as an "up-and-down tray") 21 is configured to move up and down corresponding to a load amount of sheets. The up-and-down tray 21 is formed in the shape of a tray for holding sheets, and configured to protrude outside the apparatus from the side wall of the casing 20. Therefore, as shown in FIG. 25, a tray base end portion 21*a* is provided at its lower and upper portions with two guide rollers 20*r*, and the guide rollers 20*r* are fitted and supported with an up-and-down guide 20*u* provided in the apparatus frame (not shown).

Then, the up-and-down tray 21 is installed in its bottom with a lifting/lowering motor MS, and a driving pinion 21*p* is coupled to the lifting/lowering motor MS via a reduction mechanism. Meanwhile, in the apparatus frame provided with the up-and-down guide 20*u* is disposed a rack gear 20*h* in the sheet load direction (vertical direction as viewed in FIG. 25), and the driving pinion 21*p* meshes with the rack gear 20*h*. Meanwhile, the lifting/lowering motor MS is formed of a motor capable rotating forward and backward, and its driving shaft is provided with an encoder (not shown) for detecting the amount of rotation. Further, the up-and-down tray 21 is provided with a level sensor Sr for detecting a height position of the uppermost sheet loaded on the up-and-down tray 21. Accordingly, the up-and-down tray 21 moves to positions in the sheet load direction (vertical direction as viewed in FIG. 25) by rotating the lifting/lowering motor MS forward and backward by a predetermined amount. Then, the level sensor Sr detects a height position of the up-and-down tray 21, and based on the detection result, the lifting/lowering motor MS is driven and rotated forward or backward. The amount of rotation of the lifting/lowering motor MS is detected by the encoder.

[Configuration of the Level Sensor]

Figure 25:
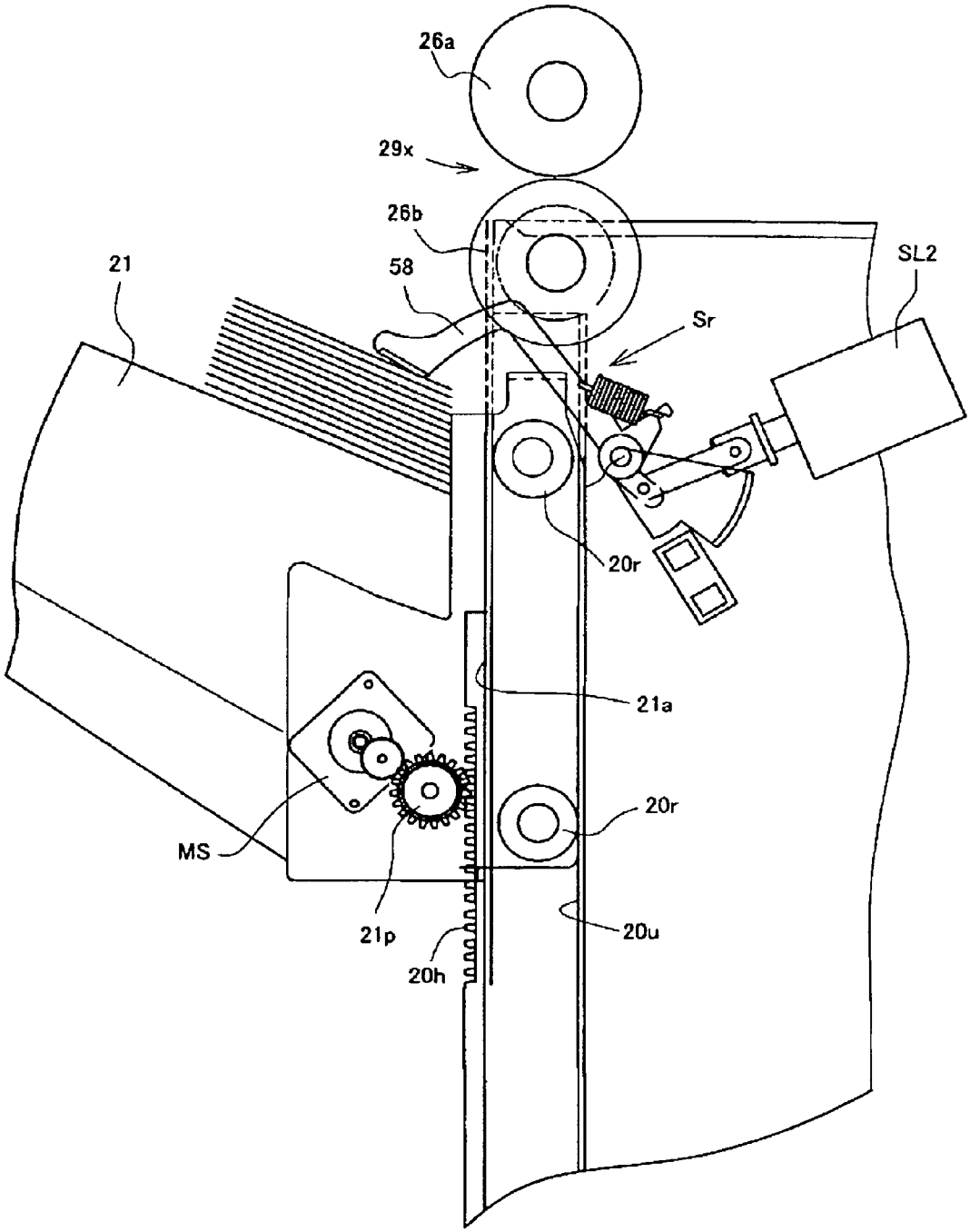
FIG. 25 is an explanatory view of a lifting/lowering mechanism of the stack tray in the apparatus of FIG. 3.

As shown in FIG. 25, the level sensor Sr is formed of an arm lever 58, and a sensor for detecting a position of the arm lever 58, and the arm lever 58 is coupled to an operation solenoid SL2. Then, a lifting/lowering means 164 moves the arm lever 58 up and down with a sheet discharge instruction signal. The sheet discharge instruction signal is notified at timing after a lapse of predicted time that a sheet reaches the stack tray 21, for example, after a rear end pass signal of the sheet from the sheet discharge sensor S2. Meanwhile, the stack tray 21 is moved up and down with a timing signal after a lapse of predicted time that a rear end of a bunch of sheets reaches the stack tray 21 after an operation signal of the bunch carrying means described previously.

[Lifting/Lowering Control Means]

The lifting/lowering control means (control CPU 161 as described later) 164 for controlling the lifting/lowering motor (shift means) MS is configured in the following way. Described first are control modes for carrying a sheet from the sheet discharge outlet 25*x* onto the stack tray. A sheet is carried out from the sheet discharge outlet 25*x* in a "straight sheet discharge mode", "bridge carrying-out mode", or "processed bunch carrying-out mode". The carrying-out mode is selected, for example, in setting the post-processing mode of the image formation apparatus A.

Figure 26:
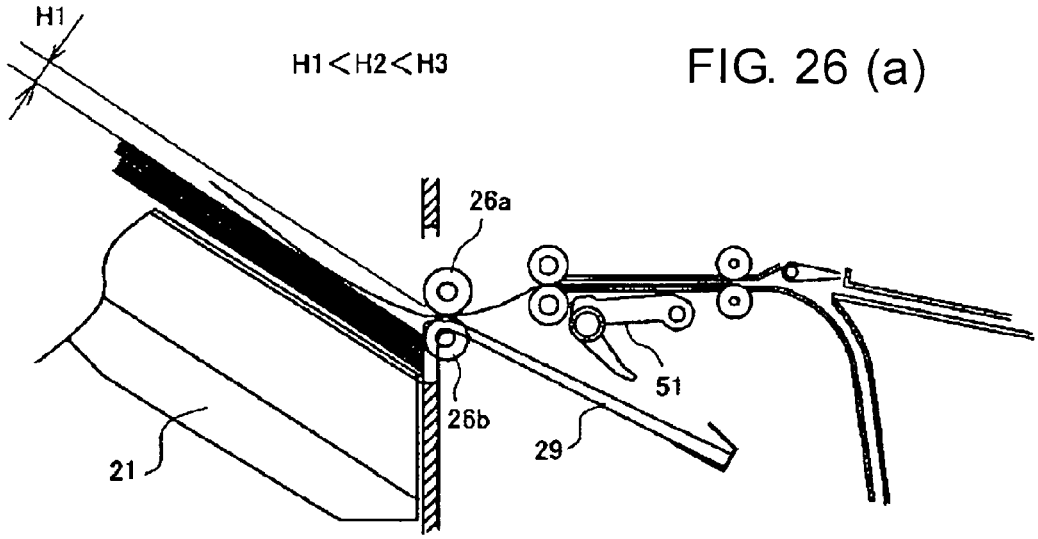
FIGS. 26 contains explanatory views of rising and lowering states of the stack tray in the apparatus of FIG. 3, where FIG. 26(*a*) shows a state where a sheet is stored in the stack tray from a sheet discharge path, FIG. 26(*b*) shows a state where sheets are collected as a set on the processing tray from the sheet discharge path, and FIG. 26(*c*) shows a state where a bunch of sheets are carried out onto the stack tray from the processing tray.
Figure 26:
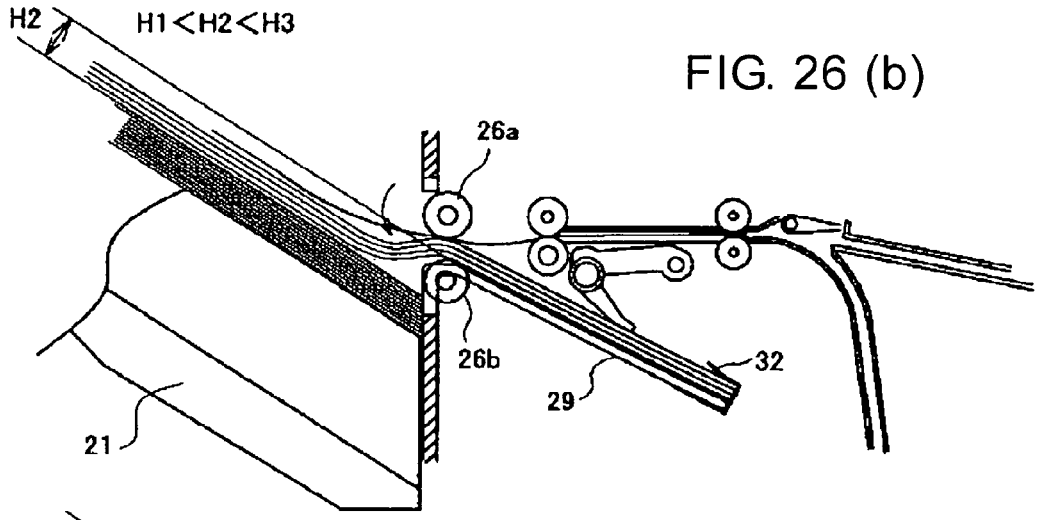
Figure 26:
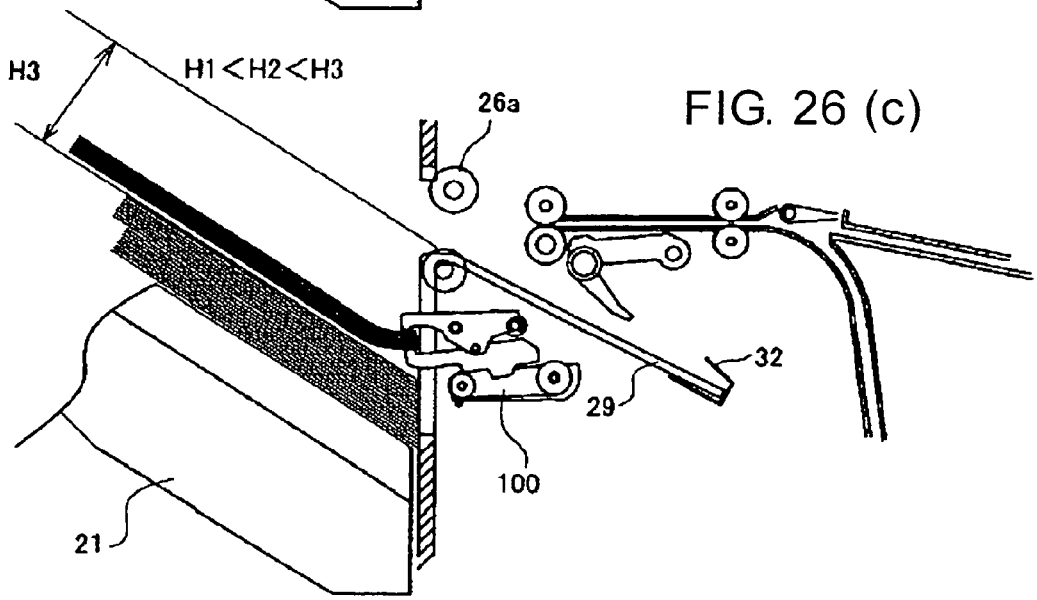

Then, the "straight sheet discharge mode" is to directly carry out a sheet with an image formed thereon from the sheet discharge outlet 25*x* without performing post-processing. In this mode, the sheet sent to the carry-in entrance 23*a* is sent to the first carry-in path P1, and carried out onto the processing tray 29 via the sheet discharge rollers 25 and sheet discharge sensor S2. On the processing tray 29, the switch back roller 26*a* rotates in the sheet discharge direction (clockwise as viewed in FIG. 26(*a*)) while being in pressure-contact with the following roller 26*b* disposed on the sheet support surface 29*a*. Accordingly, the sheet from the sheet discharge outlet 25*x* is carried out onto the processing tray 29, sent onto the up-and-down tray 21 by the switch back rollers 26*a*, 26*b* prepared on the tray, and loaded on the upper most sheet.

The "bridge carrying-out mode" is to collect sheets with images formed thereon from the sheet discharge outlet 25*x* on the processing tray 29 for each set to perform post-processing. In this mode, a sheet sent to the carry-in entrance 23*a* is sent to the first carry-in path PI, and carried out to the processing tray 29 via the sheet discharge rollers 25 and sheet discharge sensor S2. In the processing tray 29 are prepared the sheet end regulating means 32, switch back roller 26*a*, aligning means 51, and side aligning means 34. Then, the sheet from the sheet discharge outlet 25*x* is collected in a bunch form on the uppermost sheet on the processing tray 29. The "processed bunch carrying-out mode" is to carry out a bunch of sheets which are collected for each set on the processing tray and undergo biding processing by the end binding stapling means 31 from the processing tray 29 to the up-and-down tray 21. Therefore, the processing tray 29 is provided with the sheet-bunch carrying-out means 100 as described previously.

Then, the lifting/lowering control means 164 sets a height different H between the uppermost sheet stored in the up-and-down tray 21 and the sheet support surface 29*a* of the processing tray 29 at a first height position H1 in the "straight sheet discharge mode", at a second height position H2 in the "bridge carrying-out mode", and at a third height position H3 in the "processed bunch carrying-out mode". The height differences H are set to increase in the order of the first, second and third height positions (H1<H2<H3). The control of the height position is performed, as described previously, by detecting a position of the uppermost sheet on the tray by the level sensor Sr, and rotating the lifting/lowering motor MS by a predetermined amount with respect to the detection signal to set the height difference H.

The first height position H1 is set to make a height difference between the uppermost sheet and the sheet support surface 29*b* substantially zero. In other words, it is set to smoothly carry a discharged sheet sent to the sheet support surface 29*a* onto the uppermost sheet. At this point, considering that the rear end of the uppermost sheet curls and rises, and that the uppermost sheet is positioned upward by control error, the setting is made so that the uppermost sheet is slightly lower than the sheet support surface 20*a*.

Concurrently with such considerations, it is difficult to control the processing tray 29 to lower corresponding to a thickness of a single sheet whenever the sheet is carried in. Therefore, usually, the processing tray 29 is configured to lower after the level sensor Sr detects that the sheet is carried out from the sheet discharge outlet 25*x* repeatedly several times. Therefore, the first height position H1 is set at, for example, 5 mm to 10 mm.

The second height position H2 is set so that the height difference between the uppermost sheet and the sheet support surface 29*a* is at least equal to or slightly greater than a bunch thickness of a bunch of sheets to load, in collecting sheets on the processing tray 29 for each set. This is because when the height difference therebetween is set at substantially zero, sheets carried out from the sheet discharge outlet 25*x* are gradually piled thereon, and a problem arises that the sheet collected on the top should be displaced while feeding out the uppermost sheet whenever carrying in. Concurrently with the displacement problem, when the up-and-down tray 21 is arranged to tilt so that the forward portion in the sheet discharge direction is higher (see FIG. 26(*b*)), a bunch of sheets collected on the processing tray 29 curve so that the front end side in the sheet discharge direction rises upward. The curving causes rear end edges (binding processing end) of sheets collected in a bunch form for each set to become ragged, and when the sheets undergo binding processing in this state, the sheet end edges are displaced to the front and back and become ragged.

Therefore, the second height position H2 is formed to be a height difference greater than the first height position H1, and the height difference is experimentally determined from a position displacement amount of the processing end edge due to curving when a bunch of sheets with the maximum acceptable amount are loaded on the sheet support surface 29*a* of the processing tray. The second height position H2 shown in the figure is set at about 10 mm to 30 mm.

In the third height position H3, the height difference between the uppermost sheet and the sheet support surface 29*a* is set at a value sufficiently larger than a thickness of a bunch of sheets with the beforehand set maximum acceptable amount. In other words, when a bunch of sheets which are collected for each set on the processing tray 29 and undergo the binding processing are carried onto the up-and-down tray 21, the height difference H3 between the uppermost sheet and the sheet support surface 29*a* is set at a value sufficiently larger than at least a thickness of a bunch of sheets with the maximum acceptable amount. In this case, the apparatus as shown in the figure adopts the configuration that a bunch of sheets are gripped by the gripper member (means) 105 and carried out from the processing tray 29. This is because when a bunch of sheets are dropped from the sheet support surface 29*a* of the processing tray 29 and stored, the alignment state deteriorates. Therefore, the rear end portion of a bunch of sheets is gripped by the gripper member (means) 105 and released from the grip immediately before the sheet rear end lands on the uppermost sheet on the up-and-down tray 21, and the alignment state is thereby maintained. In the apparatus as shown in the figure, the third height position H3 is set at 30 mm to 50 mm.

In moving the up-and-down tray 21 from the second height position to the third height position in the "processed bunch carrying-out mode", the lifting/lowering control means 164 controls the tray 21 to move from the second height position to the third height position by (i) starting the lifting/lowering motor MS using an operation completion signal of the stapling means 31 or a timing signal for starting the carrier member 110 to move in the sheet carrying-out direction by the operation completion signal, or controls the tray 21 to move from the second height position to the third height position by (ii) starting the lifting/lowering motor MS immediately before a binding-processed bunch of sheets reach the up-and-down tray 21 subsequently to an operation completion signal of the stapling means 31 and the sheet rear end falls onto the uppermost sheet.

Further, the lifting/lowering control means 164 controls the grip releasing means so that the grip of the gripper member (means) 105 is released in the process during which the rear end of the bunch of sheets falls in the height difference (the third height position H3) between the sheet support surface 29*a* of the processing tray 29 and the up-and-down tray 21. Accordingly, the bunch of sheets gently fall onto the uppermost sheet by a small drop and are collected. It is thereby possible to maintain alignment of sheets collected on the up-and-down tray 21.

[Explanation of the Control Configuration]

A control configuration of the image formation system as described above will be described below according to a block diagram of FIG. 30. The image formation system as shown in FIG. 1 is provided with a control section (hereinafter referred to as a "main body control section") 150 of the image formation apparatus A and a control section (hereafter referred to as a "post-processing control section") 160 of the post-processing apparatus B. The main body control section 150 is provided with an image formation control section 151, feeding control section 152 and input section 153. Then, the settings of "image formation mode" and "post-processing mode" are made from a control panel 18 provided in the input section 153. As described previously, the image formation mode is to set image formation conditions such as the number of print out sets, sheet size, color/monochrome printing, scaling printing, one-side/two-side printing and others. Then, the main body control section 150 controls the image formation control section 151 and feeding control section 152 corresponding to the set image formation conditions, forms an image on a predetermined sheet, and then, sequentially carries out the sheet from the main-body sheet discharge outlet 3.

Concurrently therewith, the post-processing mode is set by input from the control panel 18. For example, the "print-out mode", "end binding finish mode", "sheet-bunch folding finish mode" or the like is set. Then, the main body control section 150 transfers the finish mode of post-processing, the number of sheets, information of the number of sets, and binding mode (one-portion binding, two-portion binding, or multiple-portion binding) information to the post-processing control section 160. Concurrently therewith, the main body control section 150 transfers a job finish signal to the post-processing control section 160 whenever image formation is completed.

The post-processing control section 160 is provided with the control CPU 161 for operating the post-processing apparatus B corresponding to the designated finish mode, ROM 162 for storing an operation program, and RAM 163 for storing control data. Then, the control CPU 161 is comprised of a sheet feeding control section 164*a* for executing feeding of a sheet sent to the carry-in entrance 23*a*, sheet collection operation control section 164*b* for executing the operation of collecting sheets, end binding operation control section 164*c* for executing sheet binding processing, and sheet-bunch folding operation control section 164*d* for executing the operation of folding a bunch of sheets.

The sheet feeding control section 164*a* is coupled to a control circuit of driving motors (not shown) of the carry-in roller 23 and sheet discharge roller 25 of the first carry-in path P1, and is configured to receive a detection signal from the sheet sensor S1 disposed in this carry-in path. Further, the sheet feeding control section 164*a* is connected to the forward/backward rotation motor MY of the switch back roller 26*a* to gather a sheet on the processing tray 29. The sheet collection operation control section 164*b* is connected to the shift motors MZ1 and MZ2 of the left and right aligning plates 34L, 34R for aligning the sheet on the processing tray, and further, the end binding operation control section 164*c* is connected to a driving circuit of driving motors MD incorporated into the end binding stapling unit 31 of the processing tray 29 and into the saddle-stitching stapling unit 40 of the collection guide 45.

The sheet-bunch folding operation control section 164*d* is connected to a driving circuit of a driving motor for driving and rotating the fold rolls 46*a*, 46*b*, and a driving circuit of the clutch means. Further, the sheet-bunch folding operation control section 164*d* is connected to a control circuit of the shift means for controlling the feeding rollers 27 of the second carry-in path P2 and the front end stopper 43 of the collection guide 45 to shift to predetermined positions. Furthermore, the section 164*d* is connected to receive detection signals from sheet sensors disposed in these paths.

The control section configured as described above causes the post-processing apparatus B to execute the following processing operation.

[Print-out Mode]

In this mode, the image formation apparatus A forms images as a series of documents, for example, starting with the first pate, and carries out the sheet face down sequentially from the main-body sheet discharge outlet 3, and the sheet sent to the first carry-in path P1 is guided to the sheet discharge rollers 25. Then, using a signal for detecting the sheet front end in the sheet discharge outlet 25*x*, after a lapse of predicted time the sheet front end reaches the switch back roller 26*a* of the processing tray 29, the sheet feeding control section 164*a* lowers the switch back roller 26*a* from the upper standby position onto the tray, and rotates the roller 26 clockwise as viewed in FIG. 2. Upon the rotation, the sheet entering onto the processing tray 29 is carried out toward the stack tray 21 by the switch back roller 26*a*, and stored on the tray 21. Thus, subsequent sheets are sequentially carried out to the stack tray 21, and stacked and stored on the tray.

Accordingly, in this print-out mode, sheets with images formed thereon in the image formation apparatus A are held on the stack tray 21 via the first carry-in path P1 of the post-processing apparatus B, and for example, loaded and stored in the order of from the first page to nth page upward in the attitude of face-down.

[Staple Binding Finish Mode]

In this mode, as in the aforementioned mode, the image formation apparatus A forms images as a series of documents in the order of from the first page to nth page, and carries out the sheet from the main-body sheet discharge outlet 3 face down, and the sheet sent to the first carry-in path P1 is guided to the sheet discharge rollers 25. Then, using a signal for detecting the sheet front end in the sheet discharge outlet 25*x*, after a lapse of predicted time the sheet front end reaches the switch back roller 26*a* of the processing tray 29, the sheet feeding control section 164*a* lowers the switch back roller 26*a* from the upper standby position onto the tray, and rotates the switch back roller 26*a* clockwise as viewed in FIG. 2. Next, after a lapse of predicted time the sheet rear end is carried onto the processing tray 29, the sheet feeding control section 164*a* rotates and drives the switch back roller 26*a* counterclockwise as viewed in FIG. 2. Upon the rotation, the sheet entering from the sheet discharge outlet 25*x* is switch-backed and fed onto the processing tray 29. By repeating this sheet feeding, a series of sheets is collected on the processing tray 29 face down in a bunch form.

In addition, whenever the sheet is collected on the processing tray 29, the control CPU 161 operates the side aligning means 34, and aligns the position in the width direction of the sheet to collect. Next, the control CPU 161 operates the end edge binding stapling unit 31 by a job finish signal from the image formation apparatus A to bind the rear end edge of a bunch of sheets collected on the processing tray. After this stapling operation, the control CPU 161 moves the sheet-bunch carrying-out means 100. Upon the moving, the bunch of sheets bound by stapling are carried out and stored on the stack tray 21. By this means, a series of sheets with images formed in the image formation apparatus A is bound by stapling and stored on the stack tray 21.

In addition, this application claims priority from Japanese Patent Application No. 2008-111415 incorporated herein by reference.

What is claimed is:

1. A sheet post-processing apparatus comprising:

a carry-in entrance disposed in one side face of an apparatus frame to receive a sheet fed from an image formation apparatus;

end binding means for gathering sheets received from the carry-in entrance in a bunch form and performing binding processing in an end portion of a bunch of sheets;

saddle-stitching means for gathering sheets received from the carry-in entrance in a bunch form and performing binding processing in a center portion of a bunch of sheets;

center-folding means for performing center-folding processing on the bound bunch of sheets;

a cutting device for cutting a fore edge of the bunch of sheets subjected to the center-folding processing;

a first discharge outlet disposed in the other side face of the apparatus frame to discharge the bunch of sheets subjected to the end binding processing;

a second discharge outlet disposed below the first discharge outlet to discharge the bunch of sheets subjected to the center-folding processing in the center-folding means, a buffer path for piling a predetermined number of sheets received from the carry-in entrance; and buffer carrying means for carrying the predetermined number of sheets piled in the buffer path to the end binding means, after a predetermined time delayed;

wherein the saddle-stitching means and the center-folding means are disposed below the carry-in entrance on the side of the one side face of the apparatus frame, the end binding means is disposed, above the saddle-stitching means and the center-folding means, between the carry-in entrance and the first discharge outlet, the cutting device is disposed within a space, below the end binding means, surrounded by the center-folding means and the second discharge outlet, and the buffer path is disposed between the carry-in entrance and the end binding means, and downwardly extending in a vertical direction toward between the center-folding means and the cutting device.

2. The sheet post-processing apparatus according to claim 1, further comprising:

punch means for performing punching processing on a sheet received from the carry-in entrance, wherein the punch means is disposed in a carrying path between a sheet branch portion and the end binding means, the sheet branch portion for turning a sheet fed from the carry-in entrance to the saddle-stitching means and the center-folding means.

3. The sheet post-processing apparatus according to claim 1, further comprising:

a stack tray disposed on the side of the other side face of the apparatus frame, wherein the stack tray moves up and down, and thereby receives the bunch of sheets subjected to the end binding processing discharged from the first discharge outlet, and the bunch of sheets subjected to the center-folding processing discharged from the second discharge outlet.

4. The sheet post-processing apparatus according to claim 3, wherein the stack tray has a plurality of sheet discharge trays, in which at least one of the sheet discharge trays is capable of moving up and down, and when a volume of bunches of sheets discharged onto an uppermost sheet discharge tray reaches a predetermined amount, a sheet discharge tray located under the uppermost sheet discharge tray receives bunches of sheets that are sequentially discharged.

5. The sheet post-processing apparatus according to claim 3, further comprising:

a booklet stacker disposed below the stack tray, wherein the booklet stacker receives the bunch of sheets discharged from the second discharge outlet, and when bunches of sheets stacked on the stack tray reach a predetermined amount, sequentially receives bunches of sheets subsequently discharged from the second discharge outlet.

6. The sheet post-processing apparatus according to claim 4, further comprising:

a booklet stacker disposed below the stack tray, wherein the booklet stacker receives the bunch of sheets discharged from the second discharge outlet, and when bunches of sheets stacked on the stack tray reach a predetermined amount, sequentially receives bunches of sheets subsequently discharged from the second discharge outlet.

7. The sheet post-processing apparatus according to claim 1, wherein the cutting device comprises:

a register device for regulating an edge of the folded bunch of sheets at an upstream side of the second discharge outlet, and a cutting blade for cutting an edge of the folded bunch of sheets regulated by the register means.

* * * * *